US012774614B2

(12) United States Patent
Kandrashou et al.

(10) Patent No.: US 12,774,614 B2
(45) Date of Patent: Oct. 27, 2026

(54) INTERMODAL-CONTAINER-BASED FACTORY

(71) Applicant: Cuby Technologies, Inc., New York, NY (US)

(72) Inventors: Aleh Kandrashou, Philadelphia, PA (US); Aleksandr Gampel, New York, NY (US)

(73) Assignee: Cuby Technologies, Inc., New York, NY (US)

( * ) Notice: Subject to any disclaimer, the term of this patent is extended or adjusted under 35 U.S.C. 154(b) by 0 days.

(21) Appl. No.: 19/536,099

(22) Filed: Feb. 10, 2026

(65) Prior Publication Data

US 2026/0168276 A1 Jun. 18, 2026

Related U.S. Application Data

(60) Division of application No. 19/232,667, filed on Jun. 9, 2025, now Pat. No. 12,559,964, which is a (Continued)

(51) Int. Cl.
*E04H 5/02* (2006.01)
*E04H 1/12* (2006.01)

(52) U.S. Cl.
CPC ..... *E04H 5/02* (2013.01); *E04H 2001/1283* (2013.01)

(58) Field of Classification Search
CPC ..... E04H 1/1205; E04H 2001/1283; E04H 15/20; E04H 2015/206; E04H 2015/201; E04B 2001/1939; E04C 3/005
See application file for complete search history.

(56) References Cited

U.S. PATENT DOCUMENTS 2,854,014 A 9/1958 Hasselquist
3,497,606 A 2/1970 Caminker et al.
(Continued)

FOREIGN PATENT DOCUMENTS

AU 2018101639 A4 12/2018
AU 2022264681 A1 11/2023
(Continued)

OTHER PUBLICATIONS

AUAR. "Welcome to Automated Architecture." Auar.io, Mar. 19, 2023, 8 pages, [Online] [Retrieved Jun. 16, 2025], Retrieved from the Internet Archive <URL:https://web.archive.org/web/20230319110314/https://automatedarchitecture. io/>.
(Continued)

*Primary Examiner* — Gisele D Ford
(74) *Attorney, Agent, or Firm* — Fenwick & West LLP

(57) ABSTRACT

An intermodal-container-based factory for manufacturing building construction components is disclosed. The factory includes a plurality of intermodal containers that have been converted into specialized workstations and arranged into one or more assembly lines. Each workstation includes manufacturing equipment permanently mounted within an intermodal container, where the equipment is configured to fabricate a particular type of building component such as windows, doors, walls, plumbing modules, aluminum panels, or structural frames. The assembly lines are configured to produce different building components in a sequential process, receiving raw materials at a first container, processing intermediate parts through subsequent containers, and outputting completed building components at a final container for installation in a building under construction.

15 Claims, 21 Drawing Sheets

Related U.S. Application Data continuation-in-part of application No. 18/655,898, filed on May 6, 2024.

(60) Provisional application No. 63/466,066, filed on May 12, 2023.

(56) References Cited

U.S. PATENT DOCUMENTS

| | | | | |
|---|---|---|---|---|
| 3,890,748 | A | 6/1975 | Fencl | |
| 3,897,662 | A | 8/1975 | Fencl | |
| 4,711,058 | A | 12/1987 | Patton | |
| 6,513,231 | B1 | 2/2003 | Hafenrichter et al. | |
| 7,803,466 | B2 | 9/2010 | Dorsy | |
| 8,621,818 | B1 | 1/2014 | Glenn et al. | |
| 8,800,243 | B2 | 8/2014 | Reid et al. | |
| 9,439,329 | B1 | 9/2016 | Towner et al. | |
| 9,499,970 | B2 | 11/2016 | Milo et al. | |
| 10,340,696 | B2 | 7/2019 | Paine et al. | |
| 10,400,448 | B2 | 9/2019 | Gosling et al. | |
| 10,633,877 | B2 | 4/2020 | Wolff | |
| 10,689,840 | B2 * | 6/2020 | Bonlin | E04G 21/14 |
| 11,007,921 | B2 | 5/2021 | Tiramani et al. | |
| 11,473,292 | B2 * | 10/2022 | Brezan | E04B 1/34336 |
| 11,603,260 | B2 | 3/2023 | Tompane et al. | |
| 11,629,491 | B1 | 4/2023 | Meagher et al. | |
| 11,718,984 | B2 | 8/2023 | Tiramani et al. | |
| 11,727,633 | B2 | 8/2023 | Glenn et al. | |
| 11,739,547 | B2 | 8/2023 | Tiramani et al. | |
| 11,801,990 | B2 | 10/2023 | Tompane et al. | |
| 11,821,196 | B2 | 11/2023 | Tiramani et al. | |
| 12,031,317 | B2 | 7/2024 | Tiramani et al. | |
| 12,179,361 | B2 | 12/2024 | Attar et al. | |
| 12,233,559 | B2 | 2/2025 | Ames et al. | |
| 2002/0007605 | A1 | 1/2002 | Cohen et al. | |
| 2002/0129566 | A1 | 9/2002 | Piccolo et al. | |
| 2006/0207193 | A1 * | 9/2006 | Lilke | E04B 1/3483 52/79.7 |
| 2008/0053033 | A1 | 3/2008 | Collins | |
| 2008/0178537 | A1 | 7/2008 | Spangler et al. | |
| 2008/0184630 | A1 | 8/2008 | Rhodes et al. | |
| 2010/0032107 | A1 | 2/2010 | Schumacher et al. | |
| 2010/0058708 | A1 | 3/2010 | Tondini et al. | |
| 2010/0088973 | A1 | 4/2010 | Deloget et al. | |
| 2010/0107551 | A1 | 5/2010 | Berry et al. | |
| 2011/0036018 | A1 * | 2/2011 | Hsu | E04G 21/30 52/79.9 |
| 2011/0047889 | A1 | 3/2011 | Gad et al. | |
| 2011/0146164 | A1 | 6/2011 | Haney et al. | |
| 2011/0209321 | A1 | 9/2011 | Kilibarda et al. | |
| 2011/0271625 | A1 | 11/2011 | Clark et al. | |
| 2014/0008359 | A1 * | 1/2014 | Ferren | E04H 5/02 220/1.5 |
| 2015/0101258 | A1 | 4/2015 | Milo et al. | |
| 2015/0240474 | A1 * | 8/2015 | Kokoschka | E04H 5/02 52/745.02 |
| 2015/0337526 | A1 | 11/2015 | Cantin et al. | |
| 2016/0130795 | A1 * | 5/2016 | Downey | E04H 1/005 52/745.02 |
| 2016/0160515 | A1 | 6/2016 | Wallance | |
| 2017/0081867 | A1 | 3/2017 | Wasson | |
| 2017/0121990 | A1 | 5/2017 | Armstrong et al. | |
| 2017/0321443 | A1 | 11/2017 | Biffiger et al. | |
| 2018/0251292 | A1 | 9/2018 | Marchini | |
| 2019/0100908 | A1 | 4/2019 | Tiramani et al. | |
| 2019/0153720 | A1 | 5/2019 | Bonlin | |
| 2019/0234063 | A1 | 8/2019 | Garcia-Abril Ruiz | |
| 2020/0080294 | A1 * | 3/2020 | Hartschuh | E04H 5/06 |
| 2020/0109554 | A1 * | 4/2020 | Hartschuh | E04B 1/34861 |
| 2020/0327795 | A1 | 10/2020 | Burke et al. | |
| 2021/0207359 | A1 | 7/2021 | Konduc | |
| 2021/0383033 | A1 | 12/2021 | Glenn et al. | |
| 2022/0058862 | A1 | 2/2022 | Glenn et al. | |
| 2022/0106803 | A1 | 4/2022 | Mahlanen et al. | |
| 2022/0316797 | A1 | 10/2022 | Kishimoto et al. | |
| 2022/0333400 | A1 | 10/2022 | Beaudry et al. | |
| 2022/0396947 | A1 * | 12/2022 | Moore | E04B 1/3442 |
| 2023/0312000 | A1 | 10/2023 | Tiramani et al. | |
| 2023/0313523 | A1 | 10/2023 | Huo et al. | |
| 2023/0383522 | A1 | 11/2023 | Tiramani et al. | |
| 2024/0017408 | A1 | 1/2024 | Attar et al. | |
| 2024/0354457 | A1 | 10/2024 | Ames et al. | |
| 2024/0354458 | A1 | 10/2024 | Ronen et al. | |
| 2024/0375281 | A1 | 11/2024 | Ames et al. | |
| 2024/0376731 | A1 | 11/2024 | Kandrashou | |
| 2024/0378333 | A1 | 11/2024 | Ames et al. | |
| 2024/0412308 | A1 | 12/2024 | Joseph et al. | |
| 2025/0068787 | A1 | 2/2025 | Debby et al. | |
| 2025/0129628 | A1 | 4/2025 | Crozier et al. | |

FOREIGN PATENT DOCUMENTS

| | | | |
|---|---|---|---|
| AU | 2023206948 | A1 | 7/2024 |
| AU | 2023307500 | A1 | 1/2025 |
| CA | 3186723 | A1 | 12/2021 |
| CA | 3188808 | A1 | 2/2022 |
| DE | 602018064089 | T2 | 1/2024 |
| EP | 4330480 | A1 | 3/2024 |
| EP | 4463290 | A1 | 11/2024 |
| ES | 2973577 | T3 | 6/2024 |
| IT | 202400006979 | T2 | 1/2024 |
| NZ | 817773 | A | 1/2024 |
| RU | 2145375 | C1 | 2/2000 |
| WO | 2021/252148 | A2 | 12/2021 |
| WO | 2022/039816 | A1 | 2/2022 |
| WO | 2022/231680 | A1 | 11/2022 |
| WO | 2023/031918 | A1 | 3/2023 |
| WO | 2023/126924 | A1 | 7/2023 |
| WO | 2023/137180 | A1 | 7/2023 |
| WO | 2023/192010 | A1 | 10/2023 |
| WO | 2023/225192 | A1 | 11/2023 |
| WO | 2024/011331 | A1 | 1/2024 |
| WO | 2024/220970 | A1 | 10/2024 |

OTHER PUBLICATIONS

Boxabl. "Boxabl—Think Inside the Box." Boxabl.com, Sep. 14, 2017, 8 pages, [Online] [Retrieved Jun. 17, 2025], Retrieved from the Internet Archive <URL:https://web.archive.org/web/20170914172533/https://www.boxabl.com/>.

Cover. "Build a Custom Home in Your Backyard." Cover Technologies Inc, Apr. 5, 2023, 7 pages, [Online] [Retrieved Jun. 16, 2025], Retrieved from the Internet Archive <URL:https://web.archive.org/web/20230405221500/ https://buildcover.com/>.

Facit. "Mobile Micro Factory." Facit Technologies, Jul. 22, 2024, 5 pages, [Online] [Retrieved Jun. 16, 2025], Retrieved from the Internet <URL:https://www.facit-technologies.com/micro-factory>.

ONX. "Onx Homes: Sustainable Communities for Every Family." Onx Homes, Nov. 17, 2021, 7 pages, [Online] [Retrieved Jun. 17, 2025], Retrieved from the Internet Archive <URL:https://web.archive.org/web/20211117191527/ https://www.onxhomes.com/ >.

Peretz, A. "Pneumatic Frame Building, Aviation Hangar, Based on Sea Containers." LinkedIn, Aug. 16, 2018, 3 pages, [Online] [Retrieved Jun. 13, 2025], Retrieved from the Internet <URL:https://www.linkedin.com>.

Reframe. "Microfactory: Building Better and Faster." Reframe Systems, Apr. 14, 2025, 9 pages, [Online] [Retrieved Jun. 16, 2025], Retrieved from the Internet <URL:https://www.reframe.systems/microfactory>.

Samara. "How it Works—Backyard." Samara Living Inc, Nov. 14, 2022, 6 pages, [Online] [Retrieved Jun. 17, 2025], Retrieved from the Internet Archive <URL:https://https://web.archive.org/web/20221114182624/www.samara.com/backyard/how-it-works >.

United States Office Action, U.S. Appl. No. 18/655,898, filed Dec. 10, 2025, 12 pages.

United States Office Action, U.S. Appl. No. 19/232,667, filed Sep. 23, 2025, 19 pages.

United States Patent Office, Third-Party Submission Under 37 CFR 1.290, Submitted by K&L Gates LLP, May 20, 2025, 18 pages.

(56) References Cited

OTHER PUBLICATIONS

Vector M. "Hangar for Repair of Special Equipment: Stroytransgaz Region." Vector M, Jul. 2, 2022, 8 pages, [Online] [Retrieved Jun. 13, 2025], Retrieved from the Internet Archive <URL:https://web.archive.org/web/20220702044931/https:/air-dome.ru/portfolio/strojtransgaz-region/>.

Vector-M AG. "Vector-M AG's Post." Facebook, Mar. 15, 2018, 1 page, [Online] [Retrieved Jun. 13, 2025], Retrieved from the Internet <URL:https://www.facebook.com/vectormag/posts/pfbidOAULgi4Ar4uUygWc713ciPaMaWZbfsSSqVkiEhszcU5qlHffrTSapR2Y9yRUBMPXI>.

* cited by examiner

120

1000

1100

INTERMODAL-CONTAINER-BASED FACTORY

CROSS-REFERENCE TO RELATED APPLICATION(S)

This application is a divisional of U.S. application Ser. No. 19/232,667, filed Jun. 9, 2025, which is a continuation-in-part of U.S. patent application Ser. No. 18/655,898, filed on May 6, 2024, entitled "Modular Mobile Temporary Structures and Method of Formation," which claims benefit to U.S. Provisional Application No. 63/466,066, filed on May 12, 2023. All of the aforementioned applications are incorporated by reference herein for all purposes.

BACKGROUND

Traditional construction methods often rely on contractors arranging materials delivery to a building site, where various trades manually assemble structural and architectural components. This approach is labor-intensive, time-consuming, and often constrained by weather, site conditions, and coordination challenges among different subcontractors. Many existing solutions for construction require contractors to wait for the availability of components and have limited flexibility to scale construction. Conventional construction methods also struggle to adapt to varying regional construction needs, leading to inefficiencies in logistics, transportation, and site coordination.

SUMMARY

In some embodiments, the disclosure described herein relates to an intermodal-container-based factory for manufacturing building construction components. The intermodal-container-based factory includes: a plurality of intermodal containers converted into workstations of the intermodal-container-based factory; and an assembly line configured to produce different types of building components in each of the workstations that are to be used in a building being constructed, the assembly line including specialized manufacturing equipment mounted permanently to each of the intermodal containers, the specialized manufacturing equipment each configured to produce a specific type of building component for constructing the building.

In some embodiments, the assembly line includes: a first container-based workstation including a glass cutting station permanently mounted to a first intermodal container, the glass cutting station configured to cut a full-size glass sheet into a dimensioned glass pane; and a second container-based workstation including a window assembly station permanently mounted to a second intermodal container, the window assembly station configured to assemble the dimensioned glass pane and reinforced frame components to form a finished window to be installed in the building.

In some embodiments, the assembly line includes: a first container-based workstation including a CNC milling machine permanently mounted to a first intermodal container, the CNC milling machine configured to machine door frame elements; and a second container-based workstation including an assembly jig permanently mounted to a second intermodal container, the assembly jig configured to join machined frame elements and door panels to form a door assembly to be installed in the building.

In some embodiments, the assembly line includes: a first container-based workstation including a CNC panel mill permanently mounted to a first intermodal container, the CNC panel mill configured to cut a panel according to predefined profile; and a second container-based workstation including a panel assembly jig permanently mounted to a second intermodal container, the panel assembly jig configured to combine the panel with insulation form a wall panel to be installed in the building.

In some embodiments, the assembly line includes: a first container-based workstation including a rolling mill permanently mounted to a first intermodal container, the rolling mill configured to fabricate a metal-faced panel with insulation core; and a second container-based workstation including a flying cut-off saw permanently mounted to a second intermodal container, the flying cut-off saw configured to trim the metal-faced panel to length to form a sandwich panel to be installed in the building.

In some embodiments, the assembly line includes: a first container-based workstation including a CNC milling machine permanently mounted to a first intermodal container, the CNC milling machine configured to mill an aluminum composite panel with a predefined pattern; and a second container-based workstation including a vinyl application station permanently mounted to a second intermodal container, the vinyl application station configured to apply vinyl to a milled aluminum composite panel to form a cladding panel to be installed in the building.

In some embodiments, the assembly line includes: a first container-based workstation including a pipe cutting station permanently mounted to a first intermodal container, the pipe cutting station configured to cut a pipe to a length; and a second container-based workstation including a plumbing module assembly table permanently mounted to a second intermodal container, the plumbing module assembly table configured to the pine with a fitting and a structural support to form a preassembled plumbing module to be installed in the building.

In some embodiments, at least one of the intermodal containers includes removable composite wall panels to enable open access to the specialized manufacturing equipment mounted permanently to the at least one of the intermodal containers.

In some embodiments, the assembly line includes three or more intermodal containers that are interconnected and arranged in a predefined sequence such that raw materials are received at a first container, processed through intermediate containers, and a finished building component is produced at a final container, the finished building component to be installed in the building.

In some embodiments, the manufacturing equipment in the intermodal-container-based factory includes: a laser cutting machine configured to process metal profiles, a press brake for bending metal sheets, a computer numerical control (CNC) milling machine for aluminum panels, and a profile saw bed for cutting window frame components.

In some embodiments, at least one of the intermodal containers includes pre-installed environmental control systems including ventilation, heating, and air conditioning for climate control.

In some embodiments, the intermodal-container-based factory further includes a first intermodal container that includes lockers and a changing room and a second intermodal container that includes a dining area.

In some embodiments, the plurality of intermodal containers includes a finishing section container includes a packaging station that includes a strapping machine, a motorized turntable, and a film wrapping table for palletizing completed building components.

In some embodiments, the intermodal containers in the assembly line are arranged in linear configuration such that the intermodal containers are physically aligned end-to-end.

In some embodiments, at least a subset of the plurality of intermodal containers are interconnected to form an exterior wall of the intermodal-container-based factory.

In some embodiments, the intermodal-container-based factory further includes an inflatable roof connected to the intermodal containers on two sides of the intermodal-container-based factory.

In some embodiments, the intermodal-container-based factory further includes a second plurality of intermodal containers that are used as storage units for the building components produced by the assembly line.

In some embodiments, the intermodal-container-based factory further includes a plurality of assembly lines, the plurality of assembly lines include three or more assembly lines below: a window assembly line, a wall panel assembly line, a door panel assembly line, a structural wall framing line, a sandwich panel manufacturing line, an aluminum composite cladding line, a plumbing module assembly line, and an electrical module assembly line.

In some embodiments, at least one workstation that includes specialized manufacturing equipment mounted permanently to an intermodal container is shared between two or more assembly lines.

In some embodiments, at least two of the assembly lines are separated by distinguishable regions in the intermodal-container-based factory.

In some embodiments, the disclosure described herein relate to a method of manufacturing building construction components using an intermodal-container-based factory, the method including: receiving building design specifications associated with a building; generating manufacturing instructions based on the building design specifications; accessing an intermodal-container-based factory, the intermodal-container-based factory comprising a plurality of intermodal containers that form container-based workstations; executing manufacturing tasks at the container-based workstations along one or more assembly lines in the intermodal-container-based factory; packaging building construction components at the intermodal-container-based factory; and delivering the packaged building construction components to a construction site for installation in the building.

In some embodiments, generating manufacturing instructions includes assigning task-level instructions to designated container-based workstations.

In some embodiments, generating manufacturing instructions includes translating the building design specifications into geometric dimensions, cutting sequences, or assembly steps.

In some embodiments, deploying the intermodal-container-based factory includes transporting the plurality of intermodal containers to a factory location.

In some embodiments, deploying the intermodal-container-based factory includes stacking at least two of the intermodal containers vertically to form a multi-level structure.

In some embodiments, each container-based workstation includes specialized manufacturing equipment permanently mounted to at least one of the intermodal containers.

In some embodiments, the manufacturing tasks include cutting, bending, welding, or assembling components used in the building.

In some embodiments, the one or more assembly lines include intermodal containers configured to produce structural frames, wall panels, plumbing modules, or window assemblies.

In some embodiments, executing manufacturing tasks includes operating a cutting station mounted to an intermodal container to produce prefabricated building components.

In some embodiments, executing manufacturing tasks includes operating a glass cutting station and an assembly table to produce double-glazed window units.

In some embodiments, executing manufacturing tasks includes assembling wall panels by combining oriented strand board, light steel thin-walled profiles, and expanded polystyrene foam.

In some embodiments, executing manufacturing tasks includes assembling plumbing modules by cutting pipes and sealing joints to produce preassembled utility systems.

In some embodiments, packaging includes palletizing the building construction components for transport.

In some embodiments, packaging includes labeling the building construction components based on installation sequence.

In some embodiments, delivering includes coordinating delivery times based on real-time progress at the construction site.

The figures depict, and the detailed description describes, various non-limiting embodiments for purposes of illustration only.

DETAILED DESCRIPTION

The figures (FIGs.) and the following description relate to preferred embodiments by way of illustration only. One of skill in the art may recognize alternative embodiments of the structures and methods disclosed herein as viable alternatives that may be employed without departing from the principles of what is disclosed.

Reference will now be made in detail to several embodiments, examples of which are illustrated in the accompanying figures. It is noted that wherever practicable similar or like reference numbers may be used in the figures and may indicate similar or like functionality. The figures depict embodiments of the disclosed system (or method) for purposes of illustration only. One skilled in the art will readily recognize from the following description that alternative embodiments of the structures and methods illustrated herein may be employed without departing from the principles described herein.

Configuration Overview

The disclosed intermodal-container-based factory provides a modular, scalable, and rapidly deployable solution for manufacturing building construction components using standard shipping intermodal containers converted into specialized workstations. Each intermodal container may house permanently-mounted manufacturing equipment configured to fabricate specific building components such as windows, wall panels, doors, plumbing modules, aluminum panels, and structural frames. These containers are physically aligned and interconnected to form one or more assembly lines, enabling a continuous, task-specific workflow from raw material intake to finished component output. The system supports multi-line configurations with the flexibility to share resources across production lines and to adapt to project-specific construction demands.

In some embodiments, the intermodal-container-based factory may be designed to operate as a self-sufficient factory environment. For example, the intermodal-container-based factory may also include climate-controlled containers, worker support units (e.g., changing rooms and dining areas), and integrated packaging stations for palletizing finished components. Optional features such as inflatable roofing, storage units, and removable container panels enhance environmental protection, accessibility, and operational flexibility. By bringing the factory closer to the construction site, this system reduces transportation logistics, supports parallel production workflows, and accelerates the overall construction process, offering a transformative approach to industrialized building production.

System Overview

Figure 1:
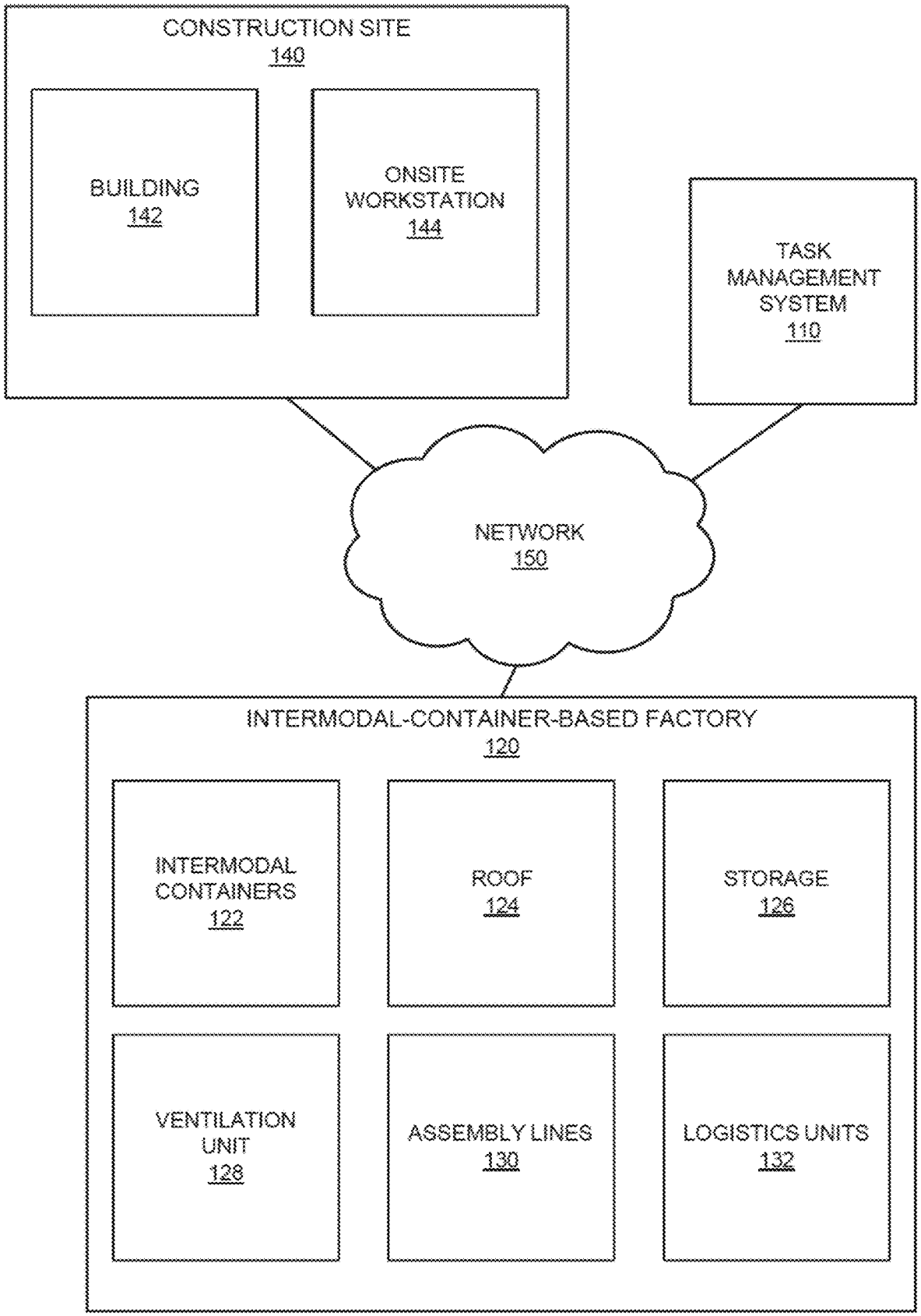
FIG. 1 is a block diagram of a building construction system, in accordance with some embodiments.

Referring now to FIG. 1, shown is a block diagram illustrating a building construction system environment 100 for carrying out a vertically integrated building manufacturing and construction process, in accordance with some embodiments. By way of example, the system environment 100 includes a task management system 110, an intermodal-container-based factory 120, and a construction site 140. Entities and certain components in the system environment 100 may communicate with each other through a network 150 or locally. In various embodiments, the system environment 100 may include fewer or additional components. The system environment 100 also may include different components.

The components in the system environment 100 may each correspond to a separate and independent entity or may be controlled by the same entity. For example, in some embodiments, a task management system 110 and an intermodal-container-based factory 120 may be operated by the same entity. In some embodiments, one or more components may also be operated by different entities, such as in situations where the operating entity of the intermodal-container-based factory 120 provides various building components to different builder companies that operate different construction sites 140.

While each of the components in the system environment 100 is sometimes described in disclosure in a singular form, the system environment 100 may include one or more of each of the components. For example, a single intermodal-container-based factory 120 may provide components for multiple manufacturing sites 140, even though in this disclosure the phrase "manufacturing site 140" may at times be described in a singular form. Likewise, while on some occasions a component may be described in a plural form, in various embodiments, the component may be present in a single instance.

In some embodiments, a task management system 110 may be used to manage and coordinate design, manufacturing and operational tasks for an intermodal-container-based factory 120 and a construction site 140. The task management system 110 may generate or process building specifications and translate such specifications into modular components for manufacturing by the intermodal-container-based factory 120. The task management system 110 may include software and algorithms that define manufacturing designs and instructions, including geometric designs, cutting sequences, assembly configurations, and installation parameters. The task management system 110 may also generate component-level instructions tailored to specific stations of one or more assembly lines 130. For example, the task management system 110 may assign tasks such as glass cutting, window frame milling, or panel assembly to particular intermodal containers 122 that are configured to execute those tasks. In some embodiments, the task management system 110 may integrate project-specific architectural plans to generate a construction-ready catalog of components, such as wall panels, window systems, or plumbing assemblies. The task management system 110 may design each component with a defined sequence of manufacturing and quality control operations. In some embodiments, the task management system 110 may additionally issue work orders and task lists for execution at the intermodal-container-based factory 120 and/or a construction site 140, In some embodiments, a task management system 110 may be implemented in various forms, depending on system requirements and deployment conditions. In some embodiments, the task management system 110 may be an on-site processing unit within an intermodal-container-based factory 120. In some embodiments, an onsite task management system 110 may simply be a computer, a tablet, or a smartphone that is installed with software applications for managing design, manufacturing and operational tasks. In some embodiments, the task management system 110 may be a remote computing server, such as a server that leverages cloud-based computing resources, storing large datasets in a data store and executing computationally intensive machine learning algorithms remotely. The task management system 110 may be equipped with interfaces for remote monitoring and control, allowing operators to adjust manufacturing and construction parameters and report progress.

By way of example, in various embodiments, the task management system 110 may be a single server or a distributed system of servers that function collaboratively. In some embodiments, the task management system 110 may be implemented as a cloud-based service, a local server, or a hybrid system in both local and cloud environments. In some embodiments, the task management system 110 may be a server computer that includes one or more processors and memory that stores code instructions that are executed by one or more processors to perform various processes described herein. In some embodiments, the task management system 110 may also be referred to as a computing device, a computing system, or a computing server. In some embodiments, the task management system 110 may be a pool of computing devices that may be located at the same geographical location (e.g., a server room) or be distributed geographically (e.g., cloud computing, distributed computing, or in a virtual server network). In some embodiments, the task management system 110 may be a collection of servers that independently, cooperatively, and/or in a distributed manner provide various products and services described in this disclosure. The task management system 110 may also include one or more virtualization instances such as a container, a virtual machine, a virtual private server, a virtual kernel, or another suitable virtualization instance.

In some embodiments, an intermodal-container-based factory 120 may serve as a vertically integrated mobile manufacturing system that is configured to manufacture building components tailored for on-site assembly at a construction site 140. The intermodal-container-based factory 120 may be formed of multiple interconnected intermodal containers 122. An intermodal container 122 may be configured as a workstation that performs specific manufacturing operations related to component fabrication, processing, or logistics. In some embodiments, the intermodal-container-based factory 120 may be expanded or reconfigured over time by adding or removing intermodal containers 122 to adjust to project requirements. The intermodal-container-based factory 120 may manufacture a diverse array of prefabricated components including, but not limited to, windows, walls, doors, ceiling panels, structural frames, plumbing modules, and electrical kits, which may be assembled or installed at a building 142. The intermodal-container-based factory 120 may support various production stages such as cutting, milling, bending, welding, washing, assembly, packaging, and material handling. The intermodal-container-based factory 120 may support an end-to-end manufacturing process in a controlled and reconfigurable mobile environment. In some embodiments, the intermodal-container-based factory 120 may coordinate with task management system 110 that provides task instructions, manufacturing parameters, and just-in-time scheduling aligned with construction progress at the construction site 140. The task management system 110 may provide instructions to both workers and machines.

U.S. Patent Application Publication, US2024/0376731, entitled "Modular Mobile Temporary Structures and Method of Formation," published on Nov. 14, 2024, is incorporated by reference herein for all purposes.

In some embodiments, the intermodal-container-based factory 120 may be deployed in a wide variety of configurations, depending on the building design, factory site constraints, and project scale. In some embodiments, the intermodal-container-based factory 120 may include intermodal containers 122 of varying types and dimensions, such as standard forty-foot containers, high-cube containers, double-door containers, or custom-modified REM-type containers that include structural reinforcements and removable wall sections. In some embodiments, the intermodal-container-based factory 120 may be implemented with containers that are permanently equipped with specialized machinery, such as laser cutters, CNC mills, press brakes, robotic welders, or automated washing systems. Each specialized machinery may be pre-installed and permanently mounted to the frames of an intermodal container 122. In some embodiments, the intermodal-container-based factory 120 may include both indoor and semi-external container configurations, such as covered container warehouses with PVC-spanned roofs, or outdoor warehouse containers positioned along the site perimeter for high-throughput storage. In some embodiments, the intermodal-container-based factory 120 may be used in conjunction with reusable or transportable containers to support future projects, thereby enhancing system modularity and deployment efficiency.

In various embodiments, equipment may be mounted permanently to an intermodal container 122 in different manners. For example, permanently mounting of a machine may involve mounting the machine to framing or surfaces of an intermodal container 122 by bolting, nailing, welding, joining by any other suitable method for the equipment to secure to a framing or surface for enhanced stability and for indefinite use at a fixed location. In other aspects, such equipment may be relocated to other locations or other containers, for recycling of use or refurbishing prior to reinstallation and reuse in its original permanent location. In some embodiments, various attachment techniques that are suited for long-term deployment. For example, such equipment may be affixed to floor plates or internal support beams using embedded anchor bolts that are cast or drilled into the structural members of an intermodal container 122. In some embodiments, the intermodal container 122 may be outfitted with reinforced base frames or floor recesses that receive and secure machine bases through cast-in-place grouting or resin-based anchoring systems. In some embodiments, machinery may be fastened to steel rails or brackets that are pre-installed along the interior walls or ceilings of an intermodal container 122, enabling equipment to be both structurally supported and vibration-isolated using elastomeric or spring-damper mounts. In some embodiments, the intermodal container 122 may include pre-welded steel reinforcement plates that align with mounting flanges of industrial tools, allowing for direct bolting or clamping in a manner that is durable under heavy loads. In some embodiments, custom bracketing systems may be welded into place to cradle or cage equipment for both stability and safety, particularly where tools with dynamic or rotational components are involved. In some embodiments, fastening systems may be supplemented with composite or concrete-filled bases that are cast inside an intermodal container 122 for securing equipment that requires extremely low movement tolerances. In some embodiments, interior wall sections may be fabricated with modular panels that integrate mounting rails, cable conduits, and fluid lines, which may support both the mechanical and utility attachment of equipment in a semi-permanent or permanent fashion. In other aspects, equipment that is initially permanently mounted may be detached and relocated to other intermodal containers 122 or production sites, allowing the intermodal container-based factory 120 to support recycling of use, refurbishment, or adaptive reconfiguration for other manufacturing roles. In some embodiments, an intermodal container 122 may be considered having equipment permanently mounted to the container if the intermodal container 122 has been modified to have embedded anchor points, integrated base frames, alignment rails, or recessed mounting platforms to receive the equipment so that the intermodal container 122 is specialized in carrying the particular equipment. In some embodiments, an intermodal container 122 may be considered having equipment permanently mounted to the container if the intermodal container 122 has been modified to have embedded anchor points, integrated base frames, alignment rails, or recessed mounting platforms to receive the equipment so that the intermodal container 122 is specialized in carrying the particular equipment.

While the intermodal-container-based factory 120 is described with having intermodal containers 122 that have equipment permanently mounted to the intermodal containers 122, in various embodiments, one or more intermodal containers 122 may also carry equipment that is not mounted. For example, such intermodal containers 122 may transport portable tools, palletized machinery, assembly jigs, or freestanding equipment modules that are positioned within the container for transit and later removed or repositioned for deployment at the construction site 140. In some embodiments, such equipment may be temporarily secured using mechanical restraints, brackets, or shock-absorbing inserts during transport, but may remain fully detachable and not structurally affixed to the intermodal container 122. In some embodiments, the equipment carried within the intermodal container 122 may be designed to slide out, roll out, or be lifted out using forklifts or cranes, enabling deployment outside the container for use in open-air work zones or as part of semi-external factory extensions. In some embodiments, the intermodal container 122 may include features such as removable side panels, retractable ramps, or forklift access points to facilitate the movement of equipment out of the container. In some embodiments, the intermodal containers 122 may function as transport-only modules that deliver specialized tools or machines to the construction site 140, where such tools or machines are unloaded and integrated into external workstations or mobile task areas.

In some embodiments, the intermodal-container-based factory 120 may be configured for rapid deployment and disassembly to enable flexible manufacturing in geographic proximity to a construction site 140. In some embodiments, components, such as individual intermodal containers 122, of the intermodal-container-based factory 120 may be transported using standard freight logistics, such as container trucks or rail systems. An intermodal-container-based factory 120 may be assembled directly adjacent to or within a short distance of the construction site 140. In some embodiments, intermodal containers 122 may be placed onto prepared foundations or leveled ground, and connected using modular interfaces, including locking mechanisms, structural braces, and input modules that facilitate alignment between units. In some embodiments, the intermodal-container-based factory 120 may be designed to minimize setup time by including pre-installed equipment, pre-routed utility connections, and modular wall sections that can be removed or installed without specialized tools. In some embodiments, the intermodal-container-based factory 120 may be disassembled by reversing the deployment steps, including the disconnection of utility lines, detachment of interface modules, and reinstallation of transport fixtures.

The proximity of the intermodal-container-based factory 120 to the construction site 140 may allow for just-in-time delivery of manufactured components to reduce transit time and improve synchronization between off-site manufacturing and on-site assembly activities. For example, in some embodiments, the intermodal-container-based factory 120 may be located within 10 miles of a target construction site 140. In some embodiments, the intermodal-container-based factory 120 may be located within 20 miles of a target construction site 140. In some embodiments, the intermodal-container-based factory 120 may be located within 30 miles of a target construction site 140. In some embodiments, the intermodal-container-based factory 120 may be located within 40 miles of a target construction site 140. In some embodiments, the intermodal-container-based factory 120 may be located within 50 miles of a target construction site 140. In some embodiments, the intermodal-container-based factory 120 may be located within 100 miles of a target construction site 140. In some embodiments, the intermodal-container-based factory 120 may be located within 200 miles of a target construction site 140. In some embodiments, the intermodal-container-based factory 120 may be located within 300 miles of a target construction site 140. In some embodiments, the intermodal-container-based factory 120 may be located within 400 miles of a target construction site 140. In some embodiments, the intermodal-container-based factory 120 may be located within 500 miles of a target construction site 140. In some embodiments, the intermodal-container-based factory 120 may be located within 1000 miles of a target construction site 140.

In some embodiments, intermodal containers 122 may serve as modular enclosures that form the functional and structural basis of the intermodal-container-based factory 120. For example, various intermodal containers 122 may serve different functional roles, such as housing manufacturing tools, permanently carrying specialty equipment for performing specific production tasks, storing raw materials or finished goods, or supporting worker operations. In some embodiments, an intermodal container 122 may be pre-mounted with machines, fixtures, control panels, lighting, ventilation, and power supply connections. In some embodiments, an intermodal containers 122 is pre-equipped with the electrical wiring, plumbing, sewage, and only requires connection. One or more intermodal containers 122 may function as ready-to-use mobile workstations upon deployment as part of the intermodal-container-based factory 120. In some embodiments, the intermodal-container-based factory 120 may also include containerized staff facilities, such as changing rooms and offices, In some embodiments, some of intermodal containers 122 may serve as structural components of the intermodal-container-based factory 120, such as by forming load-bearing units that support other containers, roofing systems, or ancillary enclosures. In some embodiments, intermodal containers 122 may be positioned to define the external wall of the intermodal-container-based factory 120, enclosing interior workspaces and forming a perimeter that protects the factory environment. In some embodiments, intermodal containers 122 may be stacked two or more levels high, with lower-level containers serving as structural supports for upper-tier modules, such as offices, storage units, or observation decks. For example, structurally reinforced intermodal containers 122 may include upgraded corner posts, longitudinal beams, and roof members to withstand vertical stacking and external environmental loads. In some embodiments, the structural arrangement of intermodal containers 122 may enable integration of modular wall sections, input modules, or shared walkways, thereby allowing the formation of enclosed corridors, work cells, or integrated task zones within the intermodal-container-based factory 120. Structural intermodal containers 122 may be fastened together using mechanical locks, welded joints, or bolted brackets, and anchored to foundation blocks to improve the overall structural stability of the intermodal-container-based factory 120.

In various embodiments, intermodal containers 122 may take the form of internationally recognized standard intermodal containers configured for transportation across multiple freight systems, including ships, railcars, and trucks. In some embodiments, each intermodal container 122 may comply with ISO 668 and ISO 6346 standards, which define container dimensions, structural strength, stacking requirements, and identification markings. In some embodiments, intermodal containers 122 may include standardized container types such as twenty-foot containers (20'×8'×8'6"), forty-foot containers (40'×8'×8'6"), and forty-foot high-cube containers (40'×8'×9'6"). In some embodiments, intermodal containers 122 may also include less common but standardized forms such as forty-five-foot containers (45'×8'×9'6") and twenty-foot high-cube containers (20'×8'×9'6"). In some embodiments, additional standard container sizes may include ten-foot containers (10'×8'×8'6"), thirty-foot containers (30'×8'×8'6"), and refrigerated containers or "reefers," which may conform to ISO dimensions while incorporating insulation and climate control systems. In some embodiments, specialized container formats such as open-top containers, flat rack containers, and tank containers may also be used, provided such containers adhere to ISO standards for intermodal handling and transport compatibility. In some embodiments, intermodal containers 122 may be classified as insurable containers, meaning that the intermodal containers 122 satisfy criteria required for commercial insurance coverage, including compliance with structural integrity standards, traceable identification, and transport certification required by freight carriers and insurance underwriters. In some embodiments, intermodal containers 122 may be made based on compatibility with global logistics equipment, including twist-lock connectors, corner castings, reach stackers, and ship-to-shore gantry cranes.

In some embodiments, intermodal containers 122 may include various types tailored to structural or functional roles within the intermodal-container-based factory 120. In some embodiments, intermodal containers 122 may include standard metal containers that are repurposed to hold equipment and function as production units. In some embodiments, intermodal containers 122 may include forty-foot high-cube containers configured to provide increased vertical clearance for taller machinery or expanded interior workflows. In some embodiments, intermodal containers 122 may include double-door containers, which may have full-width openings on both ends and may be used for staff facilities such as dining rooms, changing rooms, or storage areas requiring easy loading and unloading. In some embodiments, intermodal containers 122 may include reconfigurable equipment modules, which may be structurally reinforced and outfitted with removable wall sections, reinforced roof beams, and modular end panels to support operational access, inter-container connectivity, or task-specific reconfiguration. In some embodiments, intermodal containers 122 may also include modified containers that integrate mechanical systems such as crane beams with suction cups, internal conveyor belts, or mobile material lifts. In some embodiments, the arrangement and quantity of intermodal containers 122 within an intermodal-container-based factory 120 may be selected based on project scale, required manufacturing capabilities, or spatial constraints at a factory site. In some embodiments, the intermodal-container-based factory 120 may include containers with removable walls or modular partitions that may be adapted for worker access or connection with adjacent containers. In some embodiments, the intermodal-container-based factory 120 may incorporate containers designed for auxiliary functions, such as conveyance belt that links containers across an assembly line 130, or containers that provide electrical or plumbing storage for downstream installation.

While the factory is described throughout using intermodal containers as an example, other types of containers may be used in other embodiments of the factory. The factory may also be designed without intermodal containers or with intermodal containers only for certain portions of the factory.

In some embodiments, a roof 124 may be provided to cover a set of intermodal containers 122 that form the intermodal-container-based factory 120 to create a protected interior environment. In some embodiments, the roof 124 may be an inflatable structure configured to span across designated sections of the intermodal-container-based factory 120. In some embodiments, the inflatable structure of the roof 124 may include a series of air-supported membranes, reinforced beams, or tubular air chambers that are anchored to reinforced intermodal containers 122. In some embodiments, the inflatable roof 124 may include integrated air compressors, pressure sensors, and fastening hooks that secure the inflated sections to the container edges. In some embodiments, roof 124 may include translucent or light-diffusing material to allow natural light into the enclosed area while providing thermal insulation and weather protection.

In some embodiments, the roof 124 may include a non-inflatable stretch cover spanning across a set of intermodal containers 122 that form the intermodal-container-based factory 120. In some embodiments, the stretch cover may be a tensioned membrane, tarpaulin, or fabric canopy that is mechanically fastened to adjacent containers using hooks, brackets, or cable systems. In some embodiments, such roof 124 may form a flat or slightly arched shelter between two parallel intermodal containers 122, creating a covered corridor or shaded work area. In some embodiments, the stretch cover of roof 124 may be modular and reconfigurable, allowing it to be installed, removed, or adjusted based on the deployment layout of the intermodal-container-based factory 120. In some embodiments, the roof 124 may be weather-resistant and include drainage features such as grommets, sloped tension lines, or integrated gutters to manage precipitation. In some embodiments, the selection between an inflatable structure and a stretch cover for roof 124 may depend on site conditions, environmental exposure, or the type of operations being performed underneath the covered area.

In some embodiments, an intermodal-container-based factory 120 may include various types of storage 126 that may be used to house raw materials, semi-finished goods, finished building components, packaging supplies, tools, and other operational inventory for use in the intermodal-container-based factory 120. In some embodiments, storage 126 may take the form of intermodal containers 122, which may be stacked one or more levels high to create vertical warehouse zones. In some embodiments, storage 126 may be located outside the primary production footprint of the intermodal-container-based factory 120, such as being positioned at a distance to enable high-throughput logistics without interfering with assembly line operations. In some embodiments, storage 126 may include covered warehouse areas formed by placing two rows of intermodal containers 122 in parallel and spanning a roof structure, such as a PVC tarp or fabric membrane, across the top to create an enclosed or semi-enclosed corridor. In some embodiments, upper-level containers of storage 126 may be accessed using staircases, mezzanine walkways, or mobile lifts.

In some embodiments, storage 126 may be organized by material type or functional purpose. For example, one section of storage 126 may be designated for bulk materials such as board panels, aluminum composite sheets, structural profiles, or foam. Another section of storage 126 may be used for pre-packed kits such as plumbing assemblies, electrical wiring kits, or handheld devices that are used in the intermodal-container-based factory 120. In some embodiments, storage 126 may include containers with shelving systems, pallet racks, or bin compartments arranged according to a Kanban inventory methodology, allowing for visual tracking and replenishment of materials. In some embodiments, storage 126 may also include containers dedicated to tools, spare machine parts, safety gear, or maintenance supplies. In some embodiments, certain storage 126 containers may feature environmental controls such as insulation, ventilation, or integrated HVAC systems for preserving temperature-sensitive materials.

In some embodiments, the intermodal-container-based factory 120 may include a ventilation unit 128 configured to regulate airflow, temperature, humidity, and airborne particulates within the intermodal-container-based factory 120. In some embodiments, the ventilation unit 128 may be carried within a dedicated intermodal container 122 that houses mechanical ventilation systems such as air handling units, exhaust fans, intake blowers, ducting assemblies, particulate filters, and/or heating, ventilation and air conditioning (HVAC) modules. In some embodiments, the ventilation unit 128 may distribute conditioned air to other intermodal containers 122 through a network of ducts, conduits, and/or vents that are connected through container walls or ceilings of the intermodal containers 122. In some embodiments, the ventilation unit 128 may provide both localized and centralized climate control, with zone-specific configurations to match the thermal or filtration requirements of different stations along the assembly lines 130.

In various embodiments, a ventilation unit 128 may take different forms. For example, in some embodiments, a ventilation unit 128 may be a function-specific intermodal container 122 that carries centralized air handling systems, including intake fans, exhaust blowers, duct manifolds, filtration assemblies, and climate control modules configured to supply or extract air from multiple interconnected intermodal containers 122 of the intermodal-container-based factory 120. In some other embodiments, a ventilation unit 128 may include smaller, container-mounted ventilation subsystems that are individually integrated into specific intermodal containers 122, each subsystem configured to provide localized airflow management, particulate extraction, or temperature control for a designated task station. In some embodiments, such distributed ventilation units may include modular fan units, portable HVAC units, or ductless ventilation kits mounted directly within or on top of a container structure. In some embodiments, a ventilation unit 128 may also include hybrid systems where both centralized and distributed ventilation units are deployed concurrently to meet airflow demands of high-load equipment areas and worker-occupied zones.

In some embodiments, the intermodal-container-based factory 120 may contain one or more assembly lines 130. An assembly line 130 may include a sequence of container-based workstations formed from intermodal containers 122, such as one or more intermodal containers 122 arranged to perform a sequence of interrelated manufacturing tasks. In some embodiments, an assembly line 130 may be configured to perform a defined series of manufacturing tasks for producing building components such as window assemblies, structural wall panels, utility modules, or facade elements. In some embodiments, each assembly line 130 may include multiple intermodal containers 122 that are positioned in series or in parallel. One or more intermodal containers 122 may form an individual workstation assigned to a specific step in the manufacturing process. In some embodiments, material flow along an assembly line 130 may be managed using internal conveyor systems, pallet carts, transfer tables, or overhead crane beams, allowing components to move efficiently between container-based workstations. In some embodiments, work-in-progress may be transferred between intermodal containers 122 either through mechanized interfaces or through shared access openings in adjoining container walls.

In some embodiments, an assembly line 130 may take the form of a coordinated manufacturing pathway in which partially completed components are processed through a series of specialized operations distributed across intermodal containers 122. Each intermodal container 122 within an assembly line 130 may be dedicated to a specific fabrication, processing, or assembly function, such as cutting, welding, fastening, or surface finishing, thereby enabling division of labor and task specialization across modular units. In some embodiments, the spatial arrangement of intermodal containers 122 forming an assembly line 130 may follow a linear, U-shaped, looped, or parallel layout depending on available site conditions and the nature of the manufacturing tasks. The sequence and interconnection of container-based workstations may be defined by manufacturing logic established by the task management system 110, which may optimize task order, equipment utilization, and throughput for producing the desired building components.

In some embodiments, an assembly line 130 may also be defined by the integration of control systems, worker assignments, and material logistics that collectively govern the synchronized progression of tasks across intermodal containers 122. For example, assembly line 130 may incorporate embedded computing systems, sensor networks, or visual task boards that coordinate timing and task completion between adjacent workstations. In some embodiments, each assembly line 130 may operate with defined input and output stations, where raw materials or pre-cut subcomponents enter at the beginning of the sequence and finished assemblies exit at the end. In some embodiments, the operational identity of an assembly line 130 may be characterized by the grouping of intermodal containers 122 configured to produce a specific type of building component or system, and such configuration may be redefined dynamically as production needs change across different construction site 140 deployments.

In some embodiments, a container-based workstation may be formed from an intermodal container 122 that includes specialized manufacturing equipment permanently mounted to its structure. In some embodiments, container-based workstations may be preconfigured with task-specific machines, such as computer numerical control (CNC) routers, laser cutters, press brakes, welding stations, robotic arms, or automated fastening systems. In some embodiments, each container-based workstation may include auxiliary systems such as tool racks, dust extraction hoods, localized lighting, inspection stations, and programmable control panels. In some embodiments, such workstations may be connected to shared infrastructure, including power supply circuits, data links, ventilation networks, and compressed air systems, routed along or between containers. In some embodiments, container-based workstations may be organized to support modular product families. The container-based workstations allow a flexible reconfiguration of the assembly line 130 depending on component type or project phase.

In some embodiments, various types of assembly lines 130 may be present in an intermodal-container-based factory 120. Each assembly line 130 is configured for manufacturing of a particular category of building components. For example, one assembly line 130 may be configured for producing structural wall panels, including stations for framing, sheathing, insulation, and surface finishing. In some embodiments, another assembly line 130 may be dedicated to the fabrication of window or door assemblies, with container-based workstations for glass cutting, frame milling, hardware installation, and sealing. In some embodiments, an assembly line 130 may be specialized for plumbing or electrical utility modules, integrating containers equipped for pipe fitting, cable routing, connector installation, and functional testing. In some embodiments, additional assembly lines 130 may be configured for producing exterior cladding systems, roof components, or prefabricated stair units. In some embodiments, each type of assembly line 130 may include a tailored sequence of intermodal containers 122 arranged according to the manufacturing flow for that component category. In some embodiments, the selection and layout of assembly lines 130 within the intermodal-container-based factory 120 may be determined by the design specifications generated by the task management system 110 and may reflect the component requirements of a building 142 under construction at a nearby construction site 140.

In some embodiments, logistics units 132 may be included in the intermodal-container-based factory 120 to manage the internal and external movement of materials, components, and tools across various intermodal containers 122 and between the intermodal-container-based factory 120 and a construction site 140. In some embodiments, the intermodal-container-based factory 120 may incorporate internal logistics such as palletized transport carts, Kanban inventory tracking, overhead crane systems, and modular packaging stations to coordinate flow of raw materials and output components within and between intermodal containers 122. In some embodiments, logistics units 132 may be intermodal containers 122 configured with equipment or systems for handling pallets, organizing material flow, staging components, or facilitating transfer between assembly lines 130. In some embodiments, logistics units 132 may include container-based workstations with integrated pallet racks, modular shelving, conveyor tracks, or programmable material lifts. In some embodiments, logistics units 132 may be configured to temporarily store in-process components before the in-process components are advanced to downstream container-based workstations. In some embodiments, logistics units 132 may include robotic carts, manual trolleys, or transport lanes used for circulating goods within the intermodal-container-based factory 120.

In some embodiments, logistics units 132 may include receiving and outbound transfer zones, where raw materials are offloaded or finished components are prepared for shipment to a construction site 140. In some embodiments, such logistics units 132 may be positioned adjacent to the perimeter of the intermodal-container-based factory 120 and may include covered loading docks or staging pads. In some embodiments, logistics units 132 may also include barcode scanners, RFID readers, or other tracking systems to monitor material movement and maintain synchronization with task data managed by the task management system 110.

In some embodiments, a construction site 140 may be the physical location where one or more building structures, such as a building 142, are assembled using prefabricated components manufactured by the intermodal-container-based factory 120. The construction site 140 may be located in proximity to the intermodal-container-based factory 120, allowing for just-in-time delivery and immediate installation of finished components. In some embodiments, the construction site 140 may include work areas where prefabricated assemblies such as wall panels, window systems, plumbing modules, and electrical kits are installed into the building 142 according to predefined construction plans. The construction site 140 may be organized with dedicated zones for material staging, assembly, inspection, and equipment operation. In some embodiments, the construction site 140 may include one or more on-site workstations 144 that are configured with specialized tools to facilitate integration of the prefabricated components into the building 142. In some embodiments, the construction site 140 may be monitored or coordinated using the task management system 110, which may generate and distribute work orders, track completion of installation steps, and adjust delivery or production schedules based on real-time progress. The construction site 140 may be designed to reduce manual field construction by emphasizing the use of factory-manufactured assemblies that are pre-tested, standardized, and installation-ready.

In some embodiments, a building 142 may refer to any structure assembled at a construction site 140 using prefabricated components manufactured by the intermodal-container-based factory 120. The building 142 may include a wide range of architectural and structural types, each characterized by different materials, configurations, and intended uses. For example, a building 142 may be a residential building, such as a single-family home, multi-family unit, apartment complex, or temporary housing module. In some embodiments, a building 142 may be a commercial building, such as a retail storefront, office space, hospitality unit, or mixed-use structure that includes both residential and commercial functions. In some embodiments, the building 142 may be a specialized structure designed for industrial, agricultural, or other commercial applications.

In some embodiments, a building 142 may vary in its primary structural material system. For example, in some embodiments, the building 142 may be a wood-based structure comprising timber framing, oriented strand board (OSB) panels, and insulation cores, which are often used in residential or light commercial applications. In some embodiments, the building 142 may be a metal-based structure formed from cold-rolled steel framing members, galvanized profiles, or light steel thin-walled components integrated into modular panels, commonly used in commercial, industrial, or mid-rise configurations. In some embodiments, the building 142 may include hybrid construction approaches that combine wood, steel, and composite materials depending on local codes, structural loads, and design preferences. In some embodiments, the building 142 may incorporate exterior finishes such as aluminum composite cladding, fiber cement panels, or stucco-coated sheathing. In some embodiments, the building 142 may be constructed to meet a variety of building code classifications, such as seismic zones, hurricane-rated enclosures, or energy-efficient passive house standards. In some embodiments, the building 142 may be permanent, semi-permanent, or relocatable in nature, depending on foundation systems and regulatory context. In some embodiments, the building 142 may include subsystems for plumbing, electrical, HVAC, and fire safety that are pre-integrated into wall or ceiling panels manufactured by the intermodal-container-based factory 120. In some embodiments, the building 142 may support stackable or horizontally arrayed configurations to achieve larger footprints or multi-level layouts to extend the applicability of component-based construction across different building typologies.

In some embodiments, a construction site 140 may include one or more onsite workstations 144 for supporting the installation of prefabricated building components manufactured by the intermodal-container-based factory 120. An onsite workstation 144 may include equipment, tools, and fixtures for installing (e.g., aligning, anchoring, fastening, sealing, or otherwise integrating) manufactured components into a building 142. In some embodiments, the onsite workstation 144 may be organized as an intermodal container that is transported to the construction site 140 and deployed with minimal setup. The onsite workstation 144 may be equipped with power tools, lifting devices, jigs, welding stations, and measurement systems to facilitate component installation tasks. In some embodiments, the onsite workstation 144 may include inspection equipment for verifying installation tolerances, as well as digital tablets or terminals for accessing installation instructions or recording task completion. In some embodiments, the onsite workstation 144 may be used by field crews to receive just-in-time deliveries of manufactured components from the intermodal-container-based factory 120.

In some embodiments, an onsite workstation 144 may be tailored for specific component categories, such as plumbing modules, electrical kits, window assemblies, or wall panels. For example, in some embodiments, an onsite workstation 144 may include pipe threading equipment, conduit benders, sealant dispensers, or electrical testing devices depending on the nature of the components being installed. In some embodiments, the onsite workstation 144 may include storage compartments, Kanban racks, or tool boards that are arranged to mirror configurations in the intermodal-container-based factory 120. In some embodiments, the onsite workstation 144 may be configured as a general-purpose unit with tools and accessories for multiple component types, or as a specialized unit dedicated to high-precision installation tasks or structural anchoring operations. In some embodiments, multiple onsite workstations 144 may be deployed in parallel across different areas of the construction site 140 to accommodate concurrent installation of various prefabricated components.

In some embodiments, the intermodal-container-based factory 120 may include one or more assembly lines 130, where each assembly line 130 may be formed from one or more intermodal containers 122 arranged to perform a sequence of interrelated manufacturing tasks. In some embodiments, the intermodal-container-based factory 120 may incorporate internal logistics such as palletized transport carts, Kanban inventory tracking, overhead crane systems, and modular packaging stations to coordinate flow of raw materials and output components within and between intermodal containers 122. In some embodiments, the intermodal-container-based factory 120 may also include containerized staff facilities, such as changing rooms and offices, as well as optional inflatable roofing systems for environmental protection and year-round operation.

The communications among certain components in the system environment 100 may be through direct communication on site or may be transmitted via a network 150. In some situations, a network 150 may be a local network. In some situations, a network may be a public network such as the Internet. In some embodiments, the network uses standard communications technologies and/or protocols. Thus, the network can include links using technologies such as Ethernet, 802.11, worldwide interoperability for microwave access (WiMAX), 3G, 4G, LTE, 5G, digital subscriber line (DSL), asynchronous transfer mode (ATM), InfiniBand, PCI Express Advanced Switching, etc. Similarly, the networking protocols used on the network can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network can be represented using technologies and/or formats, including the hypertext markup language (HTML), the extensible markup language (XML), etc. In addition, all or some of the links can be encrypted using conventional encryption technologies such as secure sockets layer (SSL), transport layer security (TLS), virtual private networks (VPNs), Internet Protocol security (IPsec), etc. The network also includes links and packet-switching networks such as the Internet.

Examples of an Intermodal-Container-Based Factory

Figure 2A:
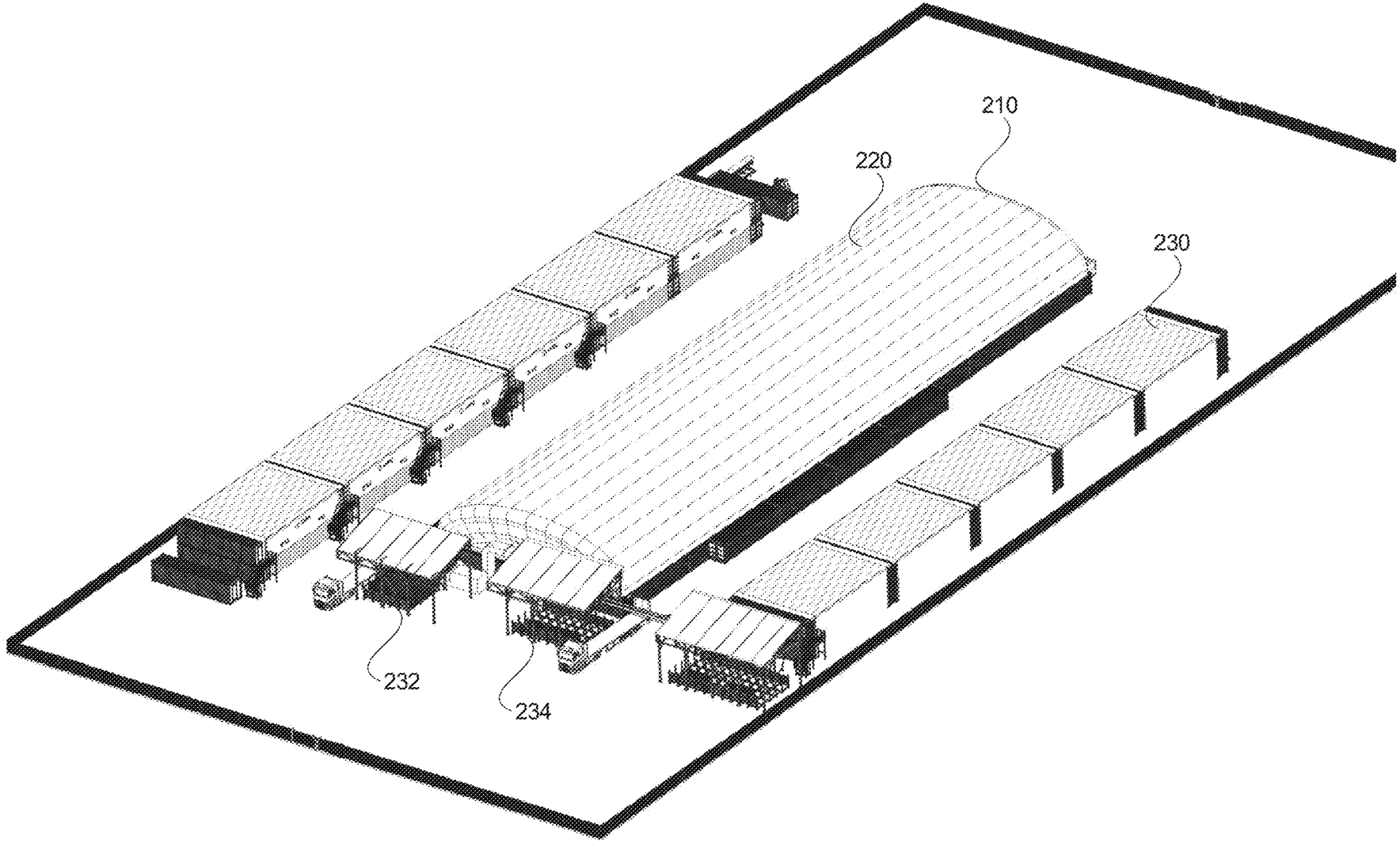
FIG. 2A is a perspective view of an example of a factory site, in accordance with some embodiments.
Figure 2B:
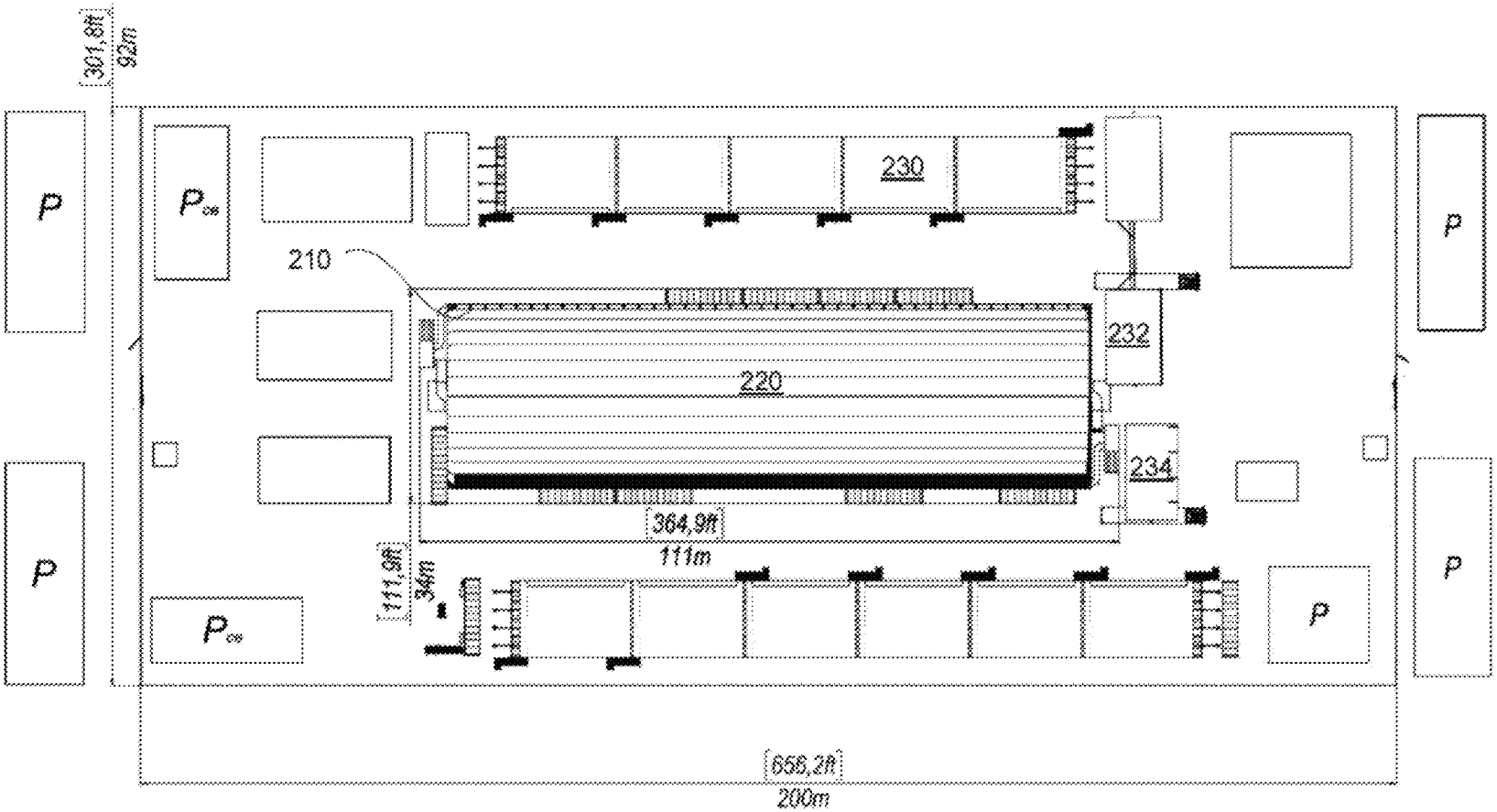
FIG. 2B is a plan view of the factory site illustrating the layout of various structures and zones, in accordance with some embodiments.

FIG. 2A is a perspective view of an example of a factory site 200, in accordance with some embodiments. FIG. 2B is a plan view of the factory site 200 illustrating the layout of various structures and zones, in accordance with some embodiments. A factory site 200 may include a main factory building 210 that serves as the central processing structure where primary manufacturing operations are executed. The main factory building 210 may be an example of intermodal-container-based factory 120 and other surrounding structures in the factory site 200 may be ancillary units or structures. The main factory building 210 may house one or more assembly lines 130. An assembly line 130 may be formed from intermodal containers 122 positioned in a linear configuration beneath an air-framed roof 220. For the exterior wall of the main factory building 210, it may include two or more intermodal containers 122 stacked vertically to create additional height clearance inside the main factory building 210. The air-framed roof 220 may be an inflatable membrane structure supported by air pressure, forming an enclosed and climate-controlled environment that spans over multiple intermodal containers 122. The air-framed roof 220 is an example of the roof 124 and may be replaced by other possible roof 124 as discussed in FIG. 1. The air-framed roof 220 may be anchored along structural frames or container-mounted supports.

While the exterior wall of an intermodal-container-based factory 120 described in this disclosure is described as being formed of one or more intermodal containers 122, in some embodiments, an intermodal-container-based factory 120 may also use other components, such as metallic sheets, to form the exterior wall or a portion of the exterior wall. An intermodal-container-based factory 120 does not require that the entire factory is formed by intermodal containers 122.

Along the sides of the main factory building 210, a series of intermodal containers 122 may be stacked in various directions (e.g., longitudinally, laterally, and vertically) to form one or more warehouse buildings 230. In some embodiments, each warehouse building 230 may be formed by arranging intermodal containers 122 to define enclosed or semi-enclosed volumes suitable for the organized storage of raw materials, processed components, packaging materials, or spare equipment used by the intermodal-container-based factory 120. In some embodiments, the intermodal containers 122 forming the warehouse buildings 230 may be modified to include shelving, climate control systems, lighting, or secure access mechanisms depending on the type of material stored. In some embodiments, the arrangement of intermodal containers 122 may be modular and reconfigurable, allowing the warehouse buildings 230 to be expanded, relocated, or adapted to changing inventory requirements. In some embodiments, the warehouse buildings 230 may be distributed along both longitudinal sides of the main factory building 210 to ensure proximity to the input and output ends of one or more assembly lines 130. While the warehouse buildings 230 are shown as separated from the main factory building 210, in some embodiments the warehouse buildings 230 may also be in touch with the sides of the main factory building 210, as shown in FIG. 4B.

In some embodiments, the factory site 200 may include specialized warehouses such as warehouse 232 for profile pipes and warehouse 234 for round pipes, which may be positioned adjacent to or in direct connection with the main factory building 210 to enable direct material transfer. In some embodiments, a specialized warehouse may be aligned with designated entry points of the main factory building 210, allowing raw materials to be transferred into the interior without requiring intermediate staging or external handling. In some embodiments, the warehouses 232 and 234 may be equipped with mechanized delivery systems, such as overhead tracks, conveyor belts, or guided transport vehicles, that move material units directly from storage racks into workstations housed within intermodal containers 122. For example, the delivery systems may be intermodal containers 122 that form as part of the periphery of the main factory building 210 so that components can be directly transferred from the warehouse 232 (or warehouse 234) to the interior of the main factory building 210. For example, the wall of the main factory building 210 adjacent to the specialized warehouses 232 or 234 may include removable panels, retractable canopies, or transfer ports configured to permit material flow.

In some embodiments, the main factory building 210 may further include industrial ventilation units 128 that provide temperature and humidity control across the interior of the factory building. The ventilation unit 128 may be mounted adjacent to or integrated into one or more intermodal containers 122 that forms the periphery of the main factory building 210. In the example configuration shown in FIG. 2B, the main factory building 210 includes two ventilation unit 128 located at each end of the main factory building 210.

In some embodiments, the intermodal-container-based factory 120 may also include other zones and components, such as fences along the factory perimeter, access gates, guest parking, dumpsters for garbage collection, a canteen, a changing room, parking areas for construction equipment and containers, storage areas for packed components, a repair site, manufacturing and storage zones for shipping packaging, raw material storage, and one or more security posts. These additional elements may be distributed across the factory site to support operational logistics, workforce management, material flow, and safety requirements.

Examples of Reinforced Intermodal Containers

Figure 3:
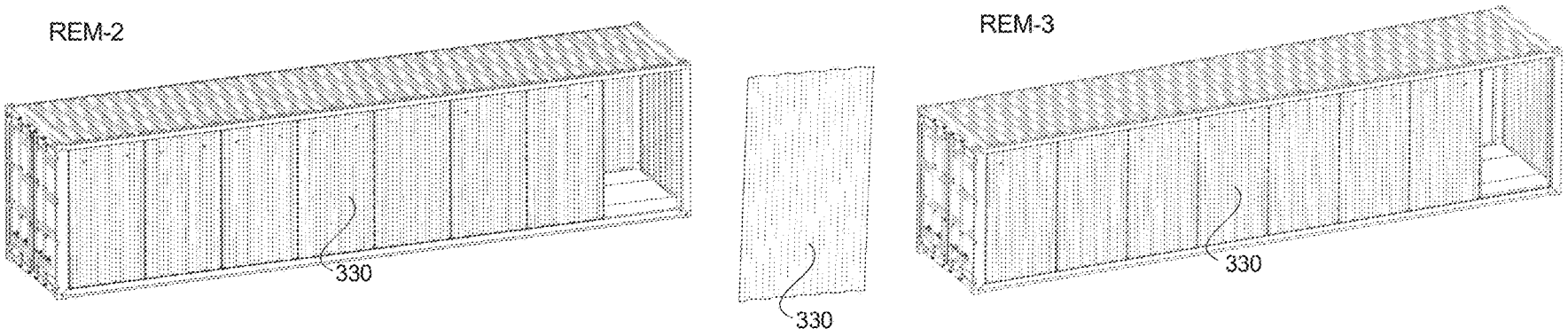
FIG. 3 includes perspective views of two types of reinforced intermodal containers, in accordance with some embodiments.

FIG. 3 includes perspective views of two types of reinforced intermodal containers 122, in accordance with some embodiments. The two types of reinforced intermodal containers 122, REM-2 and REM-3 containers, may serve as the structural components of an intermodal-container-based factory 120.

In some embodiments, reinforced intermodal containers 122 (REM-2 and REM-3 containers) may each include structural reinforcements, removable wall systems, and configurable workspaces suited for integration into an intermodal-container-based factory 120. In some embodiments, the reinforced intermodal containers 122 may include a structural frame that includes tubular beams that form the primary load-bearing skeleton of the container. The roof may be supported by a series of reinforced spacer posts and standard spacer posts, which may be vertically aligned to distribute weight from the roof to the base frame. The longitudinal beams integrated into the roof may be dimensioned with increased thickness or cross-section relative to those found in standard forty-foot high-cube containers to allow a reinforced intermodal container 122 to support additional factory infrastructure such as overhead cranes, pneumatic roofing systems, or additional intermodal containers 122 stacked on top of each other. Plywood sheets may be mounted along interior surfaces to serve as substrates for mounting fixtures, tools, or insulation panels. Spring pins 316 may be arranged near removable panels or joints to enable secure yet detachable fastening of structural or enclosure elements. The container gate 303 may be positioned at one end of the container and may be designed for modular integration with adjacent container units or factory equipment. The combination of reinforced vertical members, cross bracing, and enhanced longitudinal roof beams may provide sufficient rigidity to withstand dynamic manufacturing loads while allowing modular adaptability.

In some embodiments, reinforced intermodal containers 122 may differ from conventional freight containers by including structural enhancements and functional modifications designed for factory integration. Unlike traditional containers used primarily for transportation, reinforced intermodal containers 122 may include internal frames made of tubular beams, preconfigured mounting points for equipment, and environmental reinforcements to support rooftop structures or pneumatic roofing systems. These structural upgrades may provide additional stability for use in semi-permanent or permanent installations as part of assembly lines 130. While not shown in FIG. 3, one or more intermodal containers 122 may also include specialized manufacturing equipment permanently mounted to the framing or surfaces of the intermodal containers 122. Examples of specialized manufacturing equipment include welding stations, CNC milling machines, glass cutting systems, automated panel assembly jigs, pneumatic presses, laser cutters, and conveyor systems. Such equipment may be permanently mounted to interior surfaces, floor panels, or tubular beams of the reinforced intermodal containers 122 to enable continuous manufacturing operations without requiring on-site installation. Additional examples may include robotic arms for material handling, adhesive application stations, or integrated HVAC and filtration units for clean-room operations. On or more permanently mounted systems may be aligned with the modular configuration of the intermodal-container-based factory 120 to support specific stages of manufacturing within assembly lines 130.

In some embodiments, reinforced intermodal containers 122 may include removable wall sections along both longitudinal and lateral directions. The reinforced intermodal containers 122 are distinguishable from conventional freight containers which typically include fixed side walls and only a single pair of hinged doors at one end. Structural reinforcement may be provided for the intermodal containers 122 with removable wall panels that may be detached or replaced based on operational needs. The ability to open both longitudinal ends or lateral side walls may allow for direct access to machinery, material flow, and workspace entry to enhance operational flexibility. The removable wall panels may be secured with bolts or fitted into slots and lifting hooks for mechanical assistance. In contrast, conventional freight containers lack such reconfigurable walls. Here, the longitudinal ends refer to the sides that are opposite along the longitudinal direction. For example, in a standard 20-foot container, the longitudinal ends are the two sides that are 20 feet apart. In a standard 40-foot container, the longitudinal ends are the two sides that are 40 feet apart. In contrast, the lateral sides refer to the two sides that are 20 feet or 40 feet wide. Conventional freight containers' lateral sides are closed and do not contain removable wall panels.

The ability to open both longitudinal ends or lateral side walls may allow reinforced intermodal containers 122 to connect longitudinally or laterally to form a larger workstation. In some embodiments, the ability to open both longitudinal ends (in contrast with conventional containers that have a hinge door at only at longitudinal end) may permit multiple intermodal containers 122 to be arranged in series to create extended linear assembly lines 130, where raw materials may enter one end and undergo sequential processing across container units before exiting as finished components. In other embodiments, containers may be arranged laterally side-by-side with shared open lateral walls to create a wide-format workstation that accommodates larger equipment footprints, cross-functional team collaboration, or simultaneous processing of multiple subassemblies. The open interfaces between containers may also be configured with transitional floor panels, overhead conduit paths, and integrated lighting systems to create a continuous, unified interior workspace. In some embodiments, intermodal containers 122 may be connected at right angles to form U-shaped, L-shaped, or grid-like arrangements to allow flexible layouts that are based on spatial constraints or task dependencies within the intermodal-container-based factory 120. Connection hardware may include locking pins, alignment flanges, and sealing gaskets to ensure structural stability and environmental continuity between units. Such modular connectivity may support reconfigurable factory designs where intermodal containers 122 can be detached, relocated, or replaced to accommodate evolving production goals or site-specific requirements.

In some embodiments, a reinforced intermodal container 122 may include a permanent wall on one lateral side and a removable wall panel on the opposite lateral side. Such an arrangement may allow the permanent wall to function as an exterior boundary of the intermodal-container-based factory 120, while the removable panel enables interior connectivity with adjacent intermodal containers 122 to form an integrated and enclosed workstation environment.

In some embodiments, the intermodal-container-based factory 120 may include reinforced intermodal containers 122 having dedicated doors or windows integrated along the longitudinal direction (e.g., on one of the lateral sides). For example, an intermodal container 122 may include an integrated longitudinal door assembly and may optionally include glazed window panels. These additions may serve operational functions such as controlled worker entry, material loading, or enhanced interior visibility. The presence of such door or window modules along the container sidewalls may improve natural lighting, ventilation, and worker access, and may support modular safety features such as emergency egress or localized climate control zones. The side-access interfaces distinguish one or more intermodal containers 122 from traditional containers, which typically lack longitudinal openings or fixed fenestration.

In some embodiments, external surfaces of reinforced intermodal containers 122 may include attachment features to support modularity and interconnection. The container surface may include fasteners and locking brackets positioned along vertical support ribs. The attachment components may be used to secure removable walls, connect adjacent containers, or support auxiliary equipment such as platforms or canopies. A intermodal container 122 may include lifting hooks, bolt interfaces, or alignment tabs configured to permit tool-free assembly and disassembly. The surface-mounted features may enable rapid deployment, structural scalability, and customized assembly configurations within the intermodal-container-based factory 120.

Example Layout

Figure 4A:
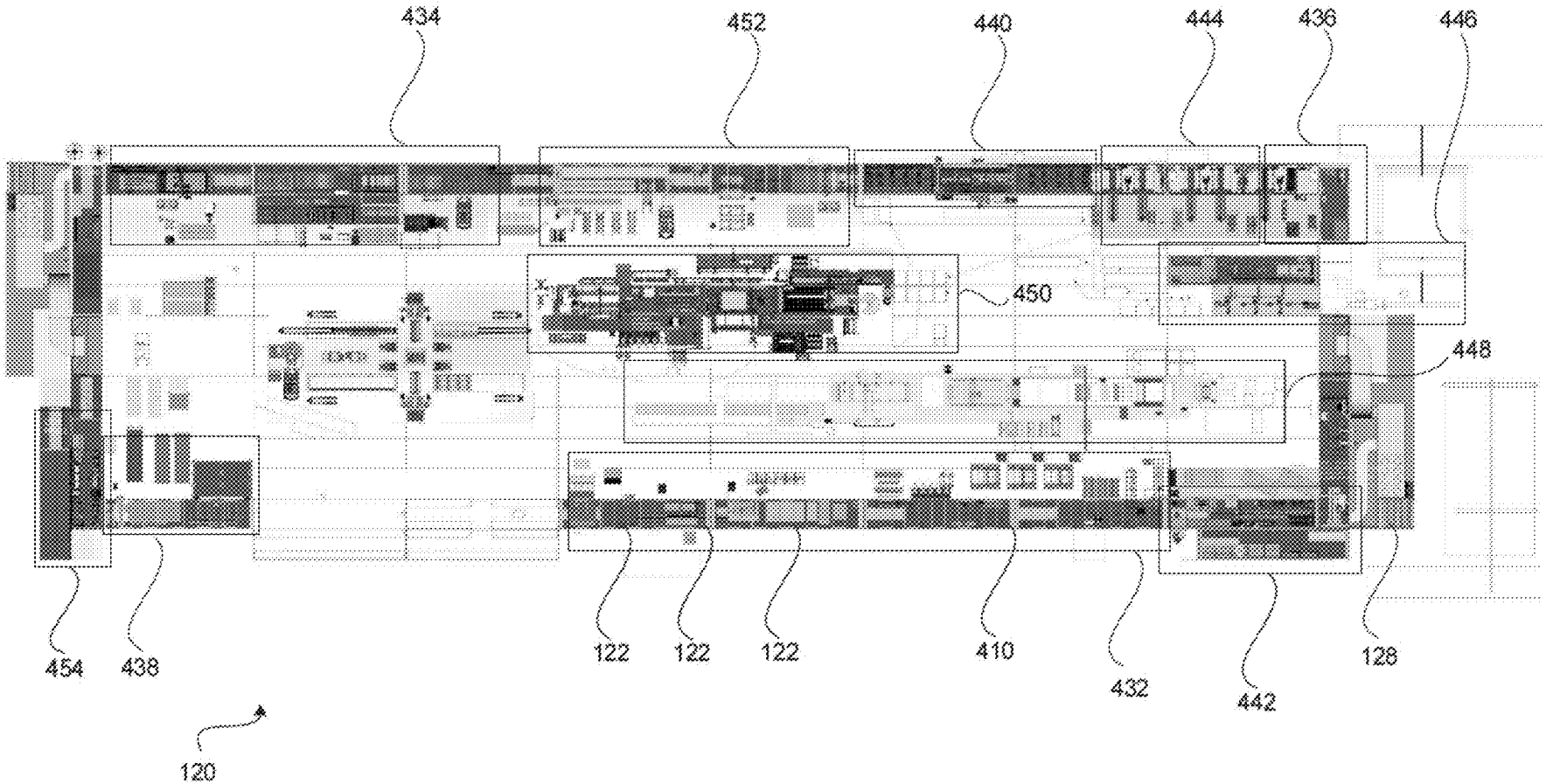
FIG. 4A is an example of a layout of an intermodal-container-based factory, in accordance with some embodiments.
Figure 4B:
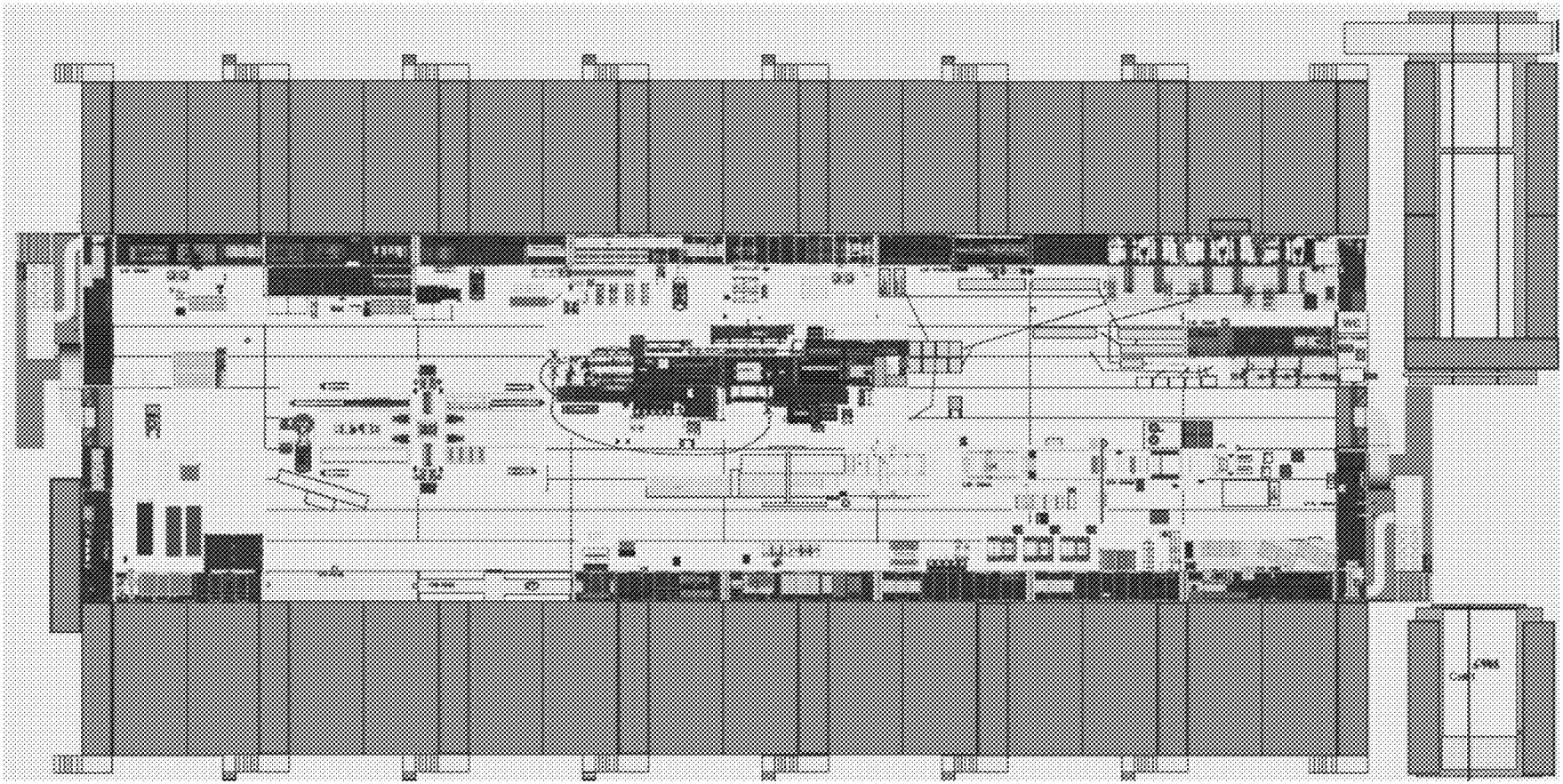
FIG. 4B is another example of a layout of intermodal-container-based factory, in accordance with some embodiments.

FIG. 4A is an example of a layout of an intermodal-container-based factory 120, in accordance with some embodiments. FIG. 4B is another example of a layout of intermodal-container-based factory 120, in accordance with some embodiments. Illustrations are mainly discussed using FIG. 4A and similar discussion is not repeated for FIG. 4B. In some embodiments, the intermodal-container-based factory 120 may include an exterior wall 410 formed from a plurality of intermodal containers 122 arranged to define the perimeter of the intermodal-container-based factory 120. The intermodal containers 122 may have the dimensions of standard 40-foot containers. For example, the longitudinal walls of the intermodal-container-based factory 120 may be formed by connecting sixteen (16) intermodal containers 122 in series, and the lateral walls may be formed by connecting eight (8) intermodal containers 122 in series, resulting in an overall footprint of approximately 640 feet in length and 320 feet in width. In some embodiments, the total enclosed area of the intermodal-container-based factory 120 may be approximately 204,800 square feet. In some embodiments, the intermodal-container-based factory 120 may include one or more intermodal containers 122 located within the area bounded by the exterior wall. In some embodiments, such interior intermodal containers 122 may serve various functions, including offices, workstations, storage zones, personnel facilities, or integrated logistics modules. In some embodiments, the inclusion of interior intermodal containers 122 may allow the intermodal-container-based factory 120 to house specialized functions at the center location of the intermodal-container-based factory 120.

In some embodiments, the exterior wall 410 of the intermodal-container-based factory 120 may be formed by intermodal containers 122 arranged to define an enclosed interior space that is sufficiently large to accommodate industrial-scale machinery, automated production lines, and additional intermodal containers 122 positioned within the defined footprint. In some embodiments, the enclosed area defined by the exterior wall 410 may serve as the interior factory floor, supporting continuous manufacturing activities across one or more assembly lines 130, and providing space for staging zones, packing stations, or internal material transfer routes. In some embodiments, the exterior wall 410 may include vertically stacked intermodal containers 122 to increase the vertical capacity of the intermodal-container-based factory 120, allowing for elevated offices, mezzanines, elevated material storage, or secondary work platforms situated above ground-level operations.

In some embodiments, the vertically stacked intermodal containers 122 forming the exterior wall 410 may be used to support additional infrastructure, such as lighting, ventilation, structural roof trusses, or a deployable pneumatic roof system. In some embodiments, stacked configurations may include stairwells or personnel access modules that enable movement between tiers, and such stacked modules may also house control rooms, break areas, or observation platforms for supervisory staff. In some embodiments, the layout of the exterior wall 410 may include selectively spaced intermodal containers 122 to create intentional access corridors or logistics bays, where large-format components or vehicles may enter or exit the interior factory floor. In some embodiments, container segments forming the exterior wall 410 may include cutaway sections, retractable panels, or roll-up access doors to enable modular reconfiguration of the perimeter, such as for re-routing material flows or expanding operational zones.

In some embodiments, the intermodal containers 122 forming the exterior wall 410 may be structurally reinforced to allow stacking of two or more container levels, and may be fitted with interconnection elements such as twist-lock mechanisms, vertical posts, or cross-bracing systems to ensure stability under dynamic loading conditions. In some embodiments, the exterior wall 410 may be integrated with environmental control systems, including thermal insulation, HVAC units, and dust suppression modules, to maintain operational conditions suitable for sensitive manufacturing processes occurring on the interior factory floor. In some embodiments, the enclosed space formed by the exterior wall 410 may also house interior pathways for autonomous material handling systems, electric pallet jacks, or ceiling-mounted crane beams, allowing for efficient circulation of materials and components throughout the intermodal-container-based factory 120.

In some embodiments, one or more intermodal containers 122 that form part of the exterior wall 410 of the intermodal-container-based factory 120 may be configured with an open interior-facing side to provide access to the factory floor, while maintaining a closed exterior-facing side that functions as a structural or environmental boundary. In some embodiments, such intermodal containers 122 may be positioned with one longitudinal wall removed or replaced with modular framing to create a workstation or storage area that directly interfaces with the interior space of the intermodal-container-based factory 120. In some embodiments, the opposite wall of the same container may remain fully intact to serve as an external perimeter barrier, providing security, insulation, or weather resistance. This configuration may allow the intermodal containers 122 to perform dual functions, which provide physical enclosure of the factory while simultaneously housing operational features such as material racks, processing stations, or logistics modules oriented toward the factory floor.

In various embodiments, an intermodal-container-based factory 120 may include different dimensions. For example, in some embodiments, the longitudinal walls of the intermodal-container-based factory 120 may be formed by connecting at least two intermodal containers 122 in series, and the lateral walls may be formed by at least a single intermodal container 122, resulting in an overall footprint of approximately 80 feet in length and 40 feet in width. In some embodiments, the total enclosed area of the intermodal-container-based factory 120 may be approximately 3200 square feet or more.

In some embodiments, the longitudinal walls of the intermodal-container-based factory 120 may be formed by connecting at least 3 intermodal containers 122 in series, and the lateral walls may be formed by connecting at least 2 intermodal containers 122, resulting in an overall footprint of approximately 120 feet in length and 80 feet in width. In some embodiments, the total enclosed area of the intermodal-container-based factory 120 may be approximately 9,600 square feet or more.

In some embodiments, the longitudinal walls of the intermodal-container-based factory 120 may be formed by connecting at least 4 intermodal containers 122 in series, and the lateral walls may be formed by connecting at least 2 intermodal containers 122, resulting in an overall footprint of approximately 160 feet in length and 80 feet in width. In some embodiments, the total enclosed area of the intermodal-container-based factory 120 may be approximately 12,800 square feet or more.

In some embodiments, the longitudinal walls of the intermodal-container-based factory 120 may be formed by connecting at least 4 intermodal containers 122 in series, and the lateral walls may be formed by connecting at least 4 intermodal containers 122, resulting in an overall footprint of approximately 160 feet in length and 160 feet in width. In some embodiments, the total enclosed area of the intermodal-container-based factory 120 may be approximately 25,600 square feet or more.

In some embodiments, the longitudinal walls of the intermodal-container-based factory 120 may be formed by connecting at least 5 intermodal containers 122 in series, and the lateral walls may be formed by connecting at least 5 intermodal containers 122, resulting in an overall footprint of approximately 200 feet in length and 200 feet in width. In some embodiments, the total enclosed area of the intermodal-container-based factory 120 may be approximately 40,000 square feet or more.

In some embodiments, the longitudinal walls of the intermodal-container-based factory 120 may be formed by connecting at least 6 intermodal containers 122 in series, and the lateral walls may be formed by connecting at least 3 intermodal containers 122, resulting in an overall footprint of approximately 240 feet in length and 120 feet in width. In some embodiments, the total enclosed area of the intermodal-container-based factory 120 may be approximately 28,800 square feet or more.

In some embodiments, the longitudinal walls of the intermodal-container-based factory 120 may be formed by connecting at least 7 intermodal containers 122 in series, and the lateral walls may be formed by connecting at least 6 intermodal containers 122, resulting in an overall footprint of approximately 280 feet in length and 240 feet in width. In some embodiments, the total enclosed area of the intermodal-container-based factory 120 may be approximately 67,200 square feet or more.

In some embodiments, the longitudinal walls of the intermodal-container-based factory 120 may be formed by connecting at least 8 intermodal containers 122 in series, and the lateral walls may be formed by connecting at least 4 intermodal containers 122, resulting in an overall footprint of approximately 320 feet in length and 160 feet in width. In some embodiments, the total enclosed area of the intermodal-container-based factory 120 may be approximately 51,200 square feet or more.

In some embodiments, the longitudinal walls of the intermodal-container-based factory 120 may be formed by connecting at least 10 intermodal containers 122 in series, and the lateral walls may be formed by connecting at least 5 intermodal containers 122, resulting in an overall footprint of approximately 400 feet in length and 200 feet in width. In some embodiments, the total enclosed area of the intermodal-container-based factory 120 may be approximately 80,000 square feet or more.

In some embodiments, the longitudinal walls of the intermodal-container-based factory 120 may be formed by connecting at least 12 intermodal containers 122 in series, and the lateral walls may be formed by connecting at least 6 intermodal containers 122, resulting in an overall footprint of approximately 480 feet in length and 240 feet in width. In some embodiments, the total enclosed area of the intermodal-container-based factory 120 may be approximately 115,200 square feet or more.

In some embodiments, the longitudinal walls of the intermodal-container-based factory 120 may be formed by connecting at least 14 intermodal containers 122 in series, and the lateral walls may be formed by connecting at least 7 intermodal containers 122, resulting in an overall footprint of approximately 560 feet in length and 280 feet in width. In some embodiments, the total enclosed area of the intermodal-container-based factory 120 may be approximately 156,800 square feet or more.

In some embodiments, the intermodal-container-based factory 120 may include a functional layout defined by a plurality of zones configured to support a complete building component manufacturing process. The layout may be organized such that different intermodal containers 122 are grouped together to form assembly lines 130. An assembly line 130 may be assigned to a distinct category of building component manufacturing, such as windows, doors, wall panels, cladding, plumbing systems, or electrical kits. These zones may be arranged to optimize material flow, with raw materials entering at one end of the intermodal-container-based factory 120 and completed components exiting at the other.

In some embodiments, an intermodal-container-based factory 120 may include one or more, two or more, or three or more assembly lines 130 such as a window assembly line, a wall panel assembly line, a door panel assembly line, a structural wall framing line, a sandwich panel manufacturing line, an aluminum composite cladding line, a plumbing module assembly line, and an electrical module assembly line. In some embodiments, at least one workstation of an assembly line that includes specialized manufacturing equipment mounted permanently to an intermodal container 122 is shared between two or more assembly lines 130. In some embodiments, at least two of the assembly lines 130 are separated by distinguishable regions in the intermodal-container-based factory.

By way of example, the intermodal-container-based factory 120 may include a window assembly line 432 for fabricating insulated window units. Such a window assembly line 432 may include a first container-based workstation including a glass cutter permanently mounted to a first intermodal container 122, the glass cutter configured to cut a glass piece into a size of a window to be installed in the building 142. The assembly line 130 may further include a second container-based workstation including an assembly table permanently mounted to a second intermodal container 122, the assembly table configured to insert the cut glass piece into a window frame. An intermodal container 122 with a crane beam and suction cups may be included to assist with handling large glass sheets. The sequence of operations may be aligned in a linear or U-shaped layout to support efficient handling and transfer of glass and frame components among intermodal containers 122.

In some embodiments, the intermodal-container-based factory 120 may include an assembly line 434 configured to manufacture structural or non-structural wall panels using a combination of oriented strand board sheets (OSB sheets), light steel thin-walled profiles (LSTK profiles), and expanded polystyrene insulation material (EPS foam). Oriented strand board sheets may be milled or shaped using a CNC workstation installed in one or more intermodal containers 122 to form precise structural faces for panel modules. The light steel thin-walled profiles may be cut to length and shaped in adjacent containers configured for metal profile processing. Expanded polystyrene insulation material may be manually inserted between the oriented strand board sheets and light steel thin-walled profiles to form the thermal and acoustic core of the wall panel. The intermodal-container-based factory 120 may include intermodal containers 122 that have fixtures and assembly stations to align wall panel components accurately to make prefabricated walls or ceiling panels with a layered sandwich structure.

In some embodiments, the assembly line 434 may additionally be configured to manufacture wall panels using plywood and structural lumber, allowing the intermodal-container-based factory 120 to support wood-framed building systems in addition to steel-based configurations. In some embodiments, plywood sheets may be processed using a CNC workstation permanently mounted within an intermodal container 122, the CNC workstation including a flatbed or vacuum bed designed to secure plywood panels during high-precision routing, drilling, or shaping operations. The CNC bed may be capable of accommodating standard plywood dimensions and may include integrated dust collection and tool change systems to support continuous operation. In some embodiments, plywood may serve as a structural face or sheathing layer in a prefabricated wall panel, and may be cut with pre-installed openings for electrical fixtures, plumbing penetrations, or window and door interfaces.

In some embodiments, intermodal containers 122 within the assembly line 434 may include additional workstations configured for processing and assembling wood framing members such as dimensional lumber or engineered wood products. These workstations may include saw beds, alignment tables, or automated fastening equipment permanently mounted within the container, enabling precise cutting, positioning, and joining of lumber components. In some embodiments, plywood panels may be joined to wood frames formed from processed lumber using nailing stations, adhesive applicators, or clamping systems integrated into the container layout. The resulting sandwich panels may incorporate plywood sheathing, wood framing, and optional insulation such as EPS foam, and may be staged for downstream operations including finishing, packaging, or transport to the construction site 140.

In some embodiments, the intermodal-container-based factory 120 may include an assembly line 436 for structural studs, configured to produce load-bearing wall frames or non-structural partitions. This assembly line 130 may include a first container-based workstation including a cutting station permanently mounted to a first intermodal container 122, the cutting station including an integrated saw bed configured to cut metal or wood studs to a specified length. The assembly line 130 may further include a second container-based workstation including an assembly jig permanently mounted to a second intermodal container 122, the assembly jig configured to join the cut studs to form a wall frame to be installed in the building 142. The layout may be designed to receive cut profiles from adjacent containers configured for laser cutting or bending and to feed completed frames into downstream panel assembly or finishing stations.

In some embodiments, the assembly line 130 for structural studs may be configured to support the manufacturing of wall frames using either metal or wood studs, depending on the specifications of the building 142 or the structural requirements of the construction site 140. In some embodiments, the cutting station permanently mounted to the first intermodal container 122 may include interchangeable saw blades, adjustable clamps, and variable-speed motors capable of processing both wood and metal materials. In some embodiments, the task management system 110 may be used to identify the material type specified for a given project and may adjust cutting parameters accordingly to ensure appropriate feed rates, cutting angles, and material tolerances are applied for wood studs.

In some embodiments, the assembly jig permanently mounted to the second intermodal container 122 may also be adapted for use with wood studs. For example, in addition to mechanical fasteners suitable for metal framing, the jig may support the use of nail guns, wood screws, or adhesive-based bonding systems designed for timber construction. In some embodiments, interchangeable jig components may be installed to align and secure wood studs during frame assembly while accounting for material-specific expansion, warping, or tolerances. The resulting wall frames may then be transferred to downstream panel assembly containers for integration with sheathing, insulation, or cladding, enabling the intermodal-container-based factory 120 to accommodate a broad range of structural and architectural requirements.

In some embodiments, the intermodal-container-based factory 120 may include specialized zones 438 configured for finishing and surface treatment. Such zones 438 may include a first container-based workstation including a milling machine permanently mounted to a first intermodal container 122, the milling machine configured to prepare an aluminum composite sheet. The finishing zone may also include a second container-based workstation including a finishing station permanently mounted to a second intermodal container 122, the finishing station configured to perform operations including deburring and edge treatment to the aluminum composite sheet to form an aluminum panel to be installed in the building 142. The intermodal containers 122 may be equipped with ventilation, dust collection systems, and precision tooling to ensure high-quality surface treatments. Milled and finished cladding panels may be labeled, stacked, and palletized for final packaging within adjacent storage or loading zones.

In some embodiments, the intermodal-container-based factory 120 may include a painting assembly line 440 formed from one or more intermodal containers 122 configured for surface coating, painting and finishing of structural or decorative components. The painting assembly line 440 may support the application of protective or aesthetic coatings to metal profiles, cladding panels, or other fabricated parts. The intermodal containers 122 used in the painting assembly line 130 may include priming stations, paint spray booths, drying zones, and ventilation systems to support controlled application and curing of coatings. Components may be prepared in upstream processing zones such as laser cutting or bending sections and transferred to the painting assembly line 130. Quick-drying primers and finishing paints may be applied using manual or semi-automated spray systems, and coated parts may be staged on racks or pallets for downstream integration. The painting assembly line 130 may be climate-controlled to ensure consistent surface quality and may include integrated filter systems for managing overspray and air quality within the container workspace.

In some embodiments, the intermodal-container-based factory 120 may include a plumbing module assembly line 442 formed from a group of intermodal containers 122 that include storage for pipes, fittings, and valves, as well as designated assembly stations. The assembly line 442 may include a first container-based workstation including a pipe cutting station permanently mounted to a first intermodal container 122, the pipe cutting station configured to cut plumbing pipes to specified lengths for installation in the building 142. The assembly line 130 may further include a second container-based workstation including a fitting and sealing station permanently mounted to a second intermodal container 122, the fitting and sealing station configured to assemble and seal pipe joints to form a plumbing module to be installed in the building 142. The assembly line 130 may include modular racks and labeling systems to support efficient retrieval of materials. The assembly line 130 may also include workstations for manual or semi-automated assembly of complete plumbing systems ready for delivery to the construction site 140.

In some embodiments, the intermodal container-based factory 120 may include a welding assembly line 444 formed from a sequence of intermodal containers 122 configured into a longitudinally connected layout that defines a series of enclosed welding sections. Each welding section may be structured as a manufacturing cell that includes one or more robotic welding systems and dual positioners configured to secure steel frame workpieces in predetermined orientations during the welding process. The welding sections may include specialized conductors, such as welding jigs, that are mounted to the positioners and adapted for different categories of structural elements, including connectors, joints, base plates, and other load-bearing steel members to be incorporated into the building 142 at construction site 140. In some embodiments, each welding section may be tailored to a specific frame geometry or assembly pattern and may be configured to receive blank steel components from upstream cutting containers, such as a laser cutting section, via dedicated transport carts designed for pipe and tube transfer.

In some embodiments, the intermodal container-based factory 120 may include safety features integrated within the welding assembly line 444 to support continuous and secure operation. Each robotic welding section may be enclosed by a safety curtain or shield, which may be semi-transparent and integrated with interlock systems that disable welding activity upon detection of unauthorized access or open access doors. Operational workflows may allow a worker to alternate between loading a blank workpiece onto one positioner while robotic welding is performed on the opposite positioner, enabling a non-idle manufacturing cycle. Following each welding operation, the welded steel element may be removed using a crane beam or magnetic gripper and positioned onto a pallet or bundled using straps for compact vertical stacking. The intermodal containers 122 forming the welding assembly line 444 may include dedicated storage compartments for service tools, consumables such as filters, and operator access panels for robotic system maintenance. In some embodiments, auxiliary infrastructure may be mounted within or adjacent to the containers, including ventilation systems, inspection stations, or internal racks for organizing welding consumables, contributing to a modular and self-contained robotic welding environment deployable in proximity to construction site 140.

In some embodiments, the intermodal container-based factory 120 may include a laser pipe cutting assembly line 446 configured to perform automated processing of tubular steel components used in structural assemblies for building 142. The laser pipe cutting assembly line 446 may include one or more intermodal containers 122 arranged to define a laser cutting tube workstation, with each intermodal container 122 housing pre-installed equipment such as a laser tube cutter, pneumatic compressor, pipe feed rollers, cutting belts, and positioning sensors. The laser tube cutter may be permanently mounted within one of the intermodal containers 122 and may be configured to process incoming raw pipe materials delivered from an adjacent outdoor warehouse zone. In some embodiments, the laser cutting tube workstation 700 may include a service console with an operator interface and a tool board for maintaining the laser system, including sensor-based alerts for tasks such as filter replacement or belt service.

In some embodiments, the laser pipe cutting assembly line 446 may be integrated with an outdoor pipe inventory system located under a canopy structure and adjacent to a rail-based transfer corridor. Raw pipe bundles may be accessed using a crane beam with a magnetic grip and placed onto an outdoor roller conveyor that includes cleaning and optional priming stations. The cleaning station may include a circular brush or abrasive surface to remove oxidation, while the priming module may apply a fast-drying galvanized coating. One of the intermodal containers 122 may include a wall opening that aligns with the roller conveyor, allowing pipes to be directly fed into the laser cutting tube workstation without manual handling. Once inside the container, the pipes may be automatically positioned using belt-driven alignment systems and guided through the laser cutter. After cutting, the pipe segments may be transferred onto a discharge roller system, lifted using an internal crane beam equipped with a magnetic grip, and organized into pallets or job-specific packs for delivery to downstream workstations such as welding assembly line 444. In some embodiments, the intermodal containers 122 forming the laser pipe cutting assembly line 446 may include ventilation and exhaust systems, allowing rapid deployment and immediate operation within the modular structure of the intermodal container-based factory 120.

In some embodiments, the intermodal container-based factory 120 may include a sandwich panel manufacturing assembly line 448. The assembly line 448 may begin with a storage and loading zone for metal strip coils, where coiled metal stock may be positioned using an overhead crane beam onto a rolling mill configured to fabricate the outer metal facings of the sandwich panels. The rolling mill may form lock seam profiles on both upper and lower facings, and the strip stock may be guided along a continuous flow path through each stage of processing.

In some embodiments, the sandwich panel manufacturing assembly line 448 may include an adhesive application module positioned downstream of the rolling mill, which may dispense polyurethane, IPS foam, or other bonding agents between the facings. Insulation cores may be inserted concurrently to form a multi-layered sandwich panel structure. A milling station, which may include a five-axis milling machine, may be configured to cut utility openings, channels, and other geometric features for mechanical or electrical routing. A flying cut-off saw may perform length-specific cuts in synchronized motion with the panel flow to minimize processing delays. Once cut, the panels may be repositioned using a vacuum-based transfer device and stacked by a palletizing system that organizes panels into project-specific bundles. A pallet wrapping gantry may apply protective film around each stack, and a downstream roller conveyor may advance the wrapped bundles to a logistics zone for outbound delivery to construction site 140. In some embodiments, the entire assembly line 448 may be equipped with workflow coordination systems that utilize Kanban or digital signaling mechanisms to synchronize production batches, enable component traceability, and ensure alignment with assembly needs at building 142.

In some embodiments, the intermodal container-based factory 120 may include a laser cutting workstation 450 formed from a modified intermodal container 122 that includes lateral structural extensions to accommodate expanded cutting zones, material handling paths, and staging areas for processed components. The laser cutting workstation 450 may include removable wall panels and integrated reinforcements that provide access from multiple directions and facilitate deployment in various production layouts. A laser cutting machine may be permanently mounted within the intermodal container 122 and configured to cut both flat sheet metal and tubular materials into specified geometries for downstream manufacturing tasks. Raw sheet metal may be stored in a dedicated rack organized by thickness, and retrieval may be governed by a Kanban-based inventory system. Material loading may be accomplished using a cantilevered crane beam with suction cups that lift and position metal sheets onto the cutting bed, with safety interlocks preventing activation of the cutting system unless the crane beam is returned to a safe position. In some embodiments, the laser cutting workstation 450 may further include a strip uncoiling machine configured for both manual and automated feed modes, enabling the processing of coiled painted strip materials for use in subsequent operations such as sandwich panel manufacturing.

In some embodiments, the intermodal container-based factory 120 may include a door assembly line 452 formed from a series of longitudinally connected intermodal containers 122 that define a continuous sequence of workstations configured for door manufacturing operations such as milling, assembly, and packaging. The door assembly line 452 may include a permanently mounted CNC milling machine adapted to produce precision grooves, recesses, and cutouts in door frame components. A dedicated milling jig may be used to secure frame elements during machining, and an integrated dust extraction system may maintain a clean operating environment. Adjacent areas within the intermodal containers 122 may include storage zones for raw panels and processed components, along with an assembly jig for aligning and fastening door modules. Assembled door units may be placed in a palletized staging area, where they may be retrieved for downstream packaging or direct deployment to building 142. Each completed door module may include pre-installed hardware and structural interfaces to support seamless installation at construction site 140, enabling standardized and efficient fabrication within the modular framework of the intermodal container-based factory 120.

In some embodiments, the intermodal-container-based factory 120 may include an electrical module assembly line 454. This assembly line 454 may include intermodal containers 122 configured for cable unwinding, measuring, cutting, and grouping of electrical kits. The intermodal containers 122 may support the production of pre-wired kits for lighting, outlets, and switches, each aligned with the architectural and engineering plans of the building 142. Internal features may include measuring counters, spool racks, and task boards to guide cable processing and packaging.

In some embodiments, additional examples of assembly lines may include an assembly line configured for the production of reinforcing rods and structural reinforcement frames used in foundation and load-bearing components of the building 142. This assembly line 130 may include a first container-based workstation configured to receive coiled rebar or rod stock, the workstation including uncoiling devices and straightening rollers permanently mounted to an intermodal container 122. In some embodiments, the rod stock may be fed into a cutting station configured to shear rods to designated lengths based on construction specifications processed by the task management system 110. A downstream container-based workstation may include welding tables, bending fixtures, or robotic welders adapted to assemble the cut rods into mesh frames or rebar cages. These reinforcement assemblies may be bundled and stored for use in concrete foundation systems or integrated into modular building components manufactured in adjacent assembly lines 130.

In some embodiments, the intermodal-container-based factory 120 may further include an assembly line configured for the manufacturing of reinforced concrete slabs or prestressed structural elements. This assembly line 130 may include intermodal containers 122 outfitted with casting beds, rebar placement systems, and concrete distribution modules. In some embodiments, a first workstation may receive pre-assembled rebar meshes or cages from the reinforcement assembly line, positioning them into casting molds permanently mounted to the floor of an intermodal container 122. A concrete batching and pouring unit may be included in an upstream or adjoining container, delivering a controlled mix of concrete into the molds using integrated conveyor systems or pump-assisted hoppers. Vibrating platforms, troweling machines, and curing enclosures may be mounted within downstream containers to ensure uniform compaction, surface finish, and strength development of the concrete slabs. Once cured, the slabs may be demolded and transferred via crane beams or transport carts to a storage or loading zone for shipment to the construction site 140. In some embodiments, inserts, lifting anchors, or conduit sleeves may be pre-positioned in the molds to enable integration with other building 142 components.

The components manufactured by various assembly lines 130 may become prefabricated components that are to be installed in a building 142 of a construction site 140.

In some embodiments, the intermodal-container-based factory 120 may include additional support zones such as storage containers, climate-controlled office modules, locker rooms, and input/output buffer containers. These zones may be housed within intermodal containers 122 modified to include HVAC systems, lighting, plumbing, or removable walls. One or more intermodal containers 122 may serve as transitional modules, facilitating the transfer of materials between vertically or horizontally aligned assembly lines 130. In some embodiments, a finishing section container may include a packaging station that includes a strapping machine, a motorized turntable, and a film wrapping table for palletizing completed building components.

For example, the intermodal-container-based factory 120 may include one or more HVAC systems (e.g., ventilation units 128) positioned along the perimeter of the intermodal-container-based factory 120. The HVAC system may be formed from one or more intermodal containers 122 that include components connected to one or more ventilation unit 128 for heating, ventilation, and air conditioning. The intermodal containers 122 may house integrated HVAC units, ducting interfaces, and power supply equipment that connect to adjacent production and support containers. The HVAC system may be configured to maintain temperature, air quality, and humidity levels across the interior of the intermodal-container-based factory 120, including sensitive zones such as double-glazed window assembly lines 130, electrical module assembly lines 130, and worker facilities. Climate-controlled airflow may be distributed through insulated ducts, with intake and exhaust units designed to accommodate both hot and cold weather conditions. Positioning the HVAC system at the perimeter may enable modular zoning and selective climate control of specific production lines or operational areas within the intermodal-container-based factory 120. At least one of the intermodal containers 122 may include pre-installed environmental control systems including ventilation, heating, and air conditioning for climate control.

In some embodiments, the intermodal-container-based factory 120 may include one or more offices positioned at the center of the intermodal-container-based factory 120. An office may be formed from intermodal containers 122 configured as modular, second-tier units mounted atop production containers or deployed independently. The office may serve as the command center of the intermodal-container-based factory 120. The office may include computing devices that support administrative functions such as planning, coordination, and quality assurance. For example, the office may include computing workstations, meeting areas, and monitoring equipment for overseeing production activities. In some embodiments, the intermodal-container-based factory 120 may include a first intermodal container 122 that includes lockers and a changing room and a second intermodal container 122 that includes a dining area.

In some embodiments, the intermodal-container-based factory 120 may be configured for field deployability, where the functional layout of zones and assembly lines 130 may be adjusted based on the available site footprint, local topography, or construction sequencing needs. The modular design of the intermodal containers 122 may allow the factory to be reconfigured by repositioning or replacing specific containers for scalable and adaptable deployment for different construction projects.

While the intermodal-container-based factory 120 may be divided into functional zones corresponding to distinct assembly lines 130, one or more intermodal containers 122 may be shared across multiple assembly lines 130 to support overlapping operations or cross-functional tasks. For example, a shared intermodal container 122 may include a laser cutting machine configured to process metal profiles, such as those used in both the structural wall framing assembly line 130 and the aluminum composite cladding assembly line 130. Similarly, an intermodal container 122 configured with a CNC milling machine for aluminum panels may serve both the aluminum panel production and surface finishing zones. In another example, a profile saw bed for cutting window frame components may be positioned in an intermodal container 122 that is shared by multiple window-related assembly lines 130. One or more shared intermodal containers 122 may be strategically positioned between zones to minimize transfer distances and may be integrated into the production flow using modular pathways, input modules, or material carts guided by Kanban-based task coordination.

In the following discussion related to FIG. 5A through FIG. 10B, various examples of workstations and specialized containers will be discussed. The specialized intermodal containers 122 discussed are merely examples that may or may not be present in a intermodal-container-based factory 120 in different embodiments. In any of the figures in FIG. 5A through FIG. 10B, any mentioned equipment may be permanently mounted to an intermodal container 122 or be movable relative to an intermodal container 122, depending on the configurations in a particular embodiment.

Example Vertically Stacked Containers

Figure 5A:
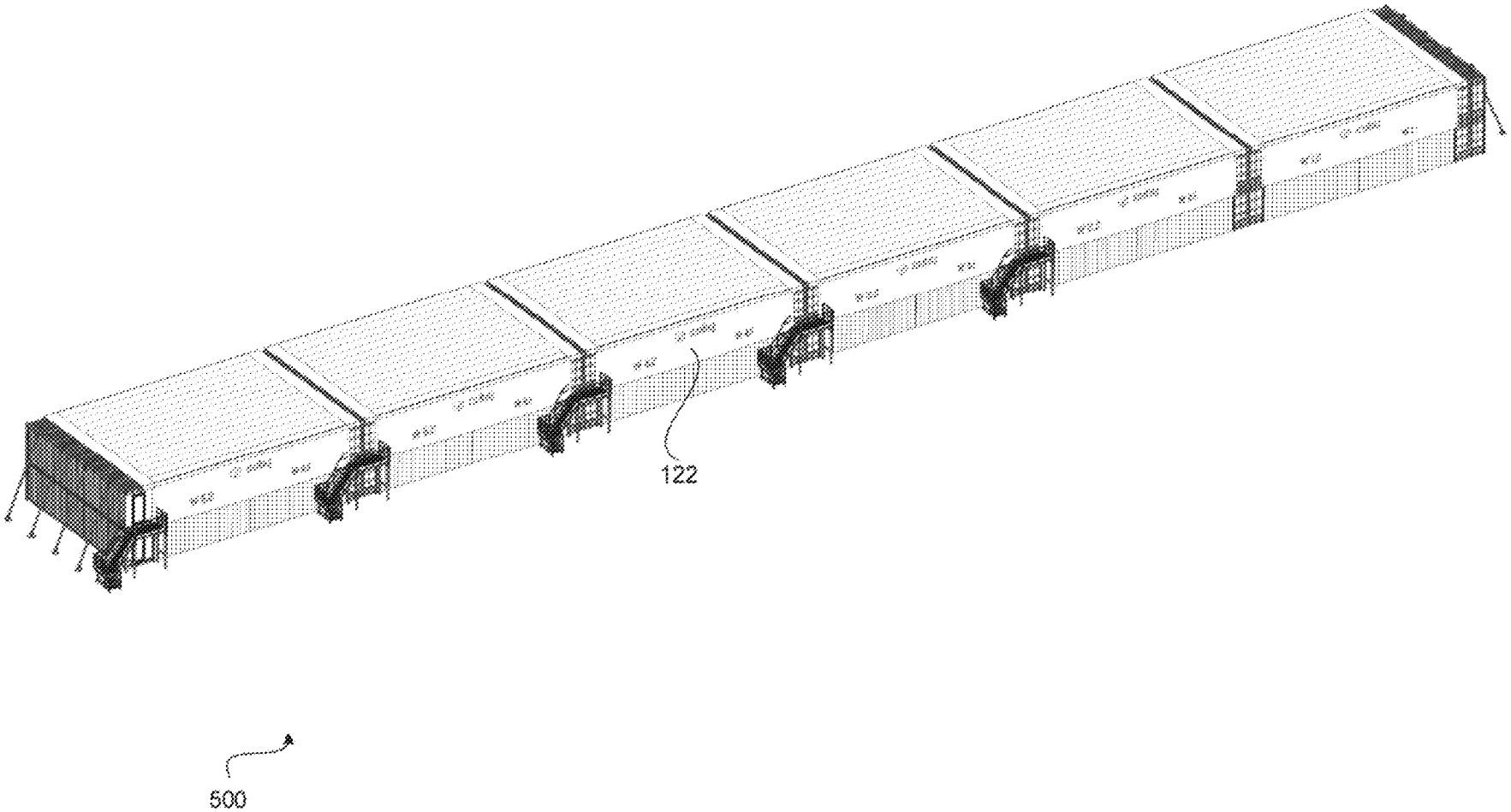
FIG. 5A is a perspective view of a group of vertically stacked intermodal containers that form a warehouse, in accordance with some embodiments.
Figure 5B:
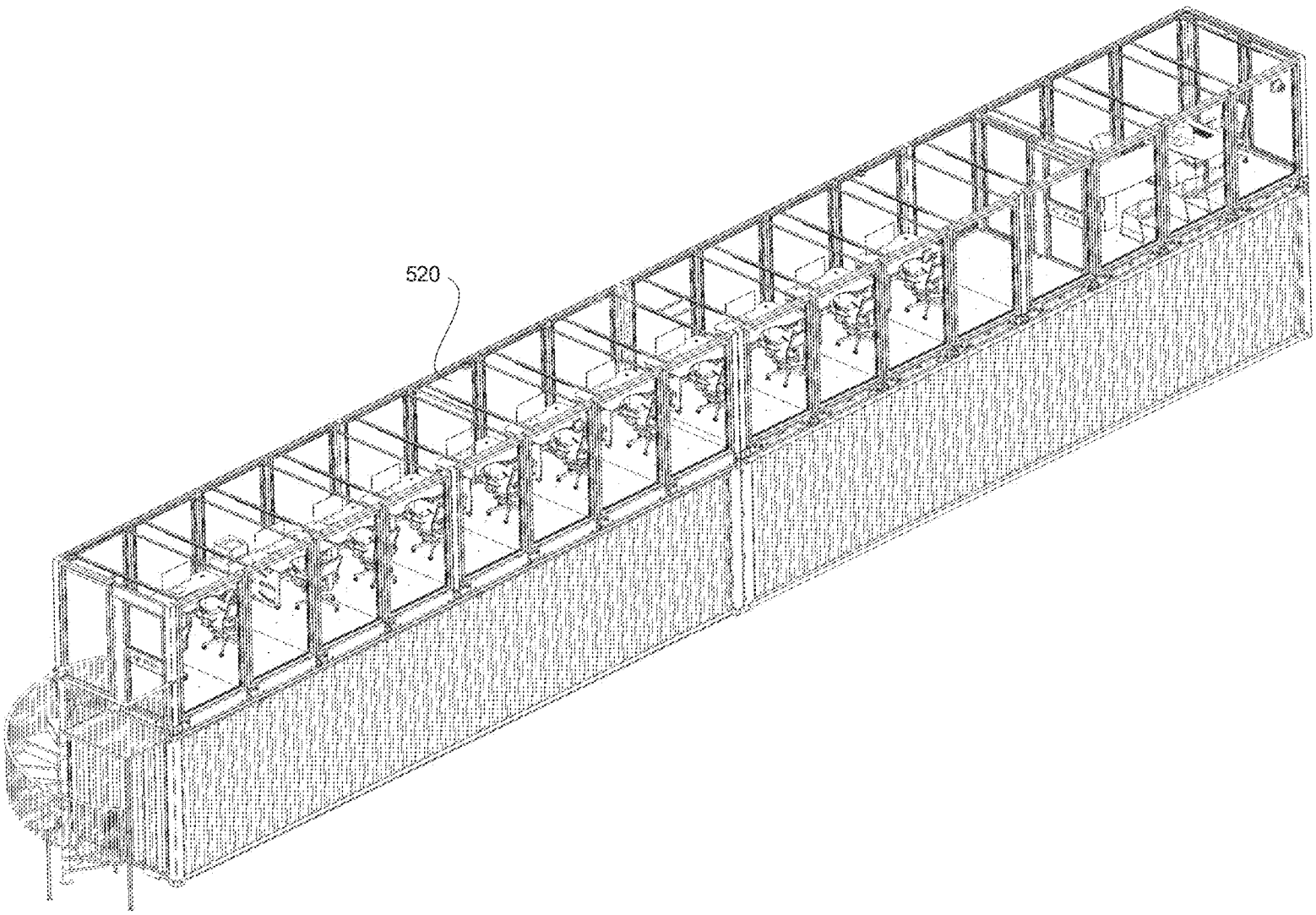
FIG. 5B is a perspective view of a group of vertically stacked intermodal containers that form an office, in accordance with some embodiments.

FIG. 5A and FIG. 5B illustrate examples of vertically stacked intermodal containers 122 that form larger functional units associated with an intermodal-container-based factory 120. FIG. 5A is a perspective view of a group of vertically stacked intermodal containers 122 that form a warehouse 500, in accordance with some embodiments.

In some embodiments, the intermodal-container-based factory 120 may include one or more warehouse zones that are configured for different storage needs. Such warehouse zones may include internal warehouses located within the footprint of the intermodal-container-based factory 120, covered warehouses formed alongside the perimeter of the intermodal-container-based factory 120, and outdoor warehouses positioned in open-air zones of a factory site. In some embodiments, the warehouse 500 may be located on the side of an intermodal-container-based factory 120. For example, the warehouse 500 is an example of the warehouse building 230 described in FIG. 2B.

In some embodiments, a warehouse 500 may be formed by vertically stacking two or levels of intermodal containers 122, such as stacking REM-Two or REM-Three containers, and stretching a tensioned cable system between the stacked intermodal containers 122. In some embodiments, upper-level containers may include stair access and swing gates that allow pallets to be lifted by loaders and transferred into the upper-level containers for unloading. Structural elements such as reinforcing frames and anchor bolts may be used to secure the intermodal containers 122 to form a warehouse 500. Additional bracing may be mounted at the corners of the container stack.

In some embodiments, the intermodal-container-based factory 120 may include different warehouse zones with functional subdivisions for organized material handling. For example, a warehouse zone may be divided into two sections with independent access gates, such as a pallet rack zone for storage of large-format materials and an open area for incoming bulk items. Materials stored in pallet rack zones may include building materials such as drywall, OSB panels, and aluminum composite panels. In some embodiments, smaller items such as spare toolkits, zip fasteners, and worker clothing may be stored in internal shelving compartments within the warehouse containers.

In some embodiments, the warehouse zones may be managed using a Kanban-based inventory control system, in which each item or bin is assigned a unique identifier code to enable real-time tracking of inventory depletion and restocking needs. The Kanban system may be used in various items stored in warehouse containers and may include visual labels, return baskets, and scanning stations. In some embodiments, modular staircases may be configured to allow access to upper-level intermodal containers 122 in a warehouse 500, and these staircases may be deployed using a base-mounted support system that aligns with the structural platform of the container stack.

FIG. 5B is a perspective view of a group of vertically stacked intermodal containers 122 that form an office 520, in accordance with some embodiments. In some embodiments, the intermodal-container-based factory 120 may include an office 520 formed from a group of vertically stacked intermodal containers 122 and the office 520 may be located inside the intermodal-container-based factory 120. In some embodiments, the office 520 may be installed as a second-tier structure mounted above production zones such as the laser cutting and bending sections. The office 520 may be centrally located within the intermodal-container-based factory 120 to enable efficient access and supervisory visibility across multiple assembly lines 130. In some embodiments, the office may have a disassemblable design, such that the structure, including walls, roof, windows, doors, and support frames, may be disassembled and packed within a standard transport container for redeployment. A modular spiral staircase may be used to provide access to the elevated office level.

The structural design of the office 520 may be based on prefabricated panels, each configured to match the width of a window opening. Such panels may be mounted to the surface of the supporting intermodal container 122 and connected to base structural elements to form a continuous enclosure. PVC windows may be installed into frame sections, and end walls may include door modules and additional window assemblies. Roof panels may be placed atop horizontal lintels supported by vertical structural members.

In some embodiments, the interior of the office 520 may be configured with features suitable for administrative and operational oversight functions. These features may include lighting, ventilation, air conditioning, and heating systems installed to support the work environment. Inside the office 520, dedicated spaces may be included for meetings and computing workstations, enabling factory staff to carry out supervisory, administrative, and coordination tasks related to the operation of the intermodal-container-based factory 120.

Example Connected Containers

Figure 6A:
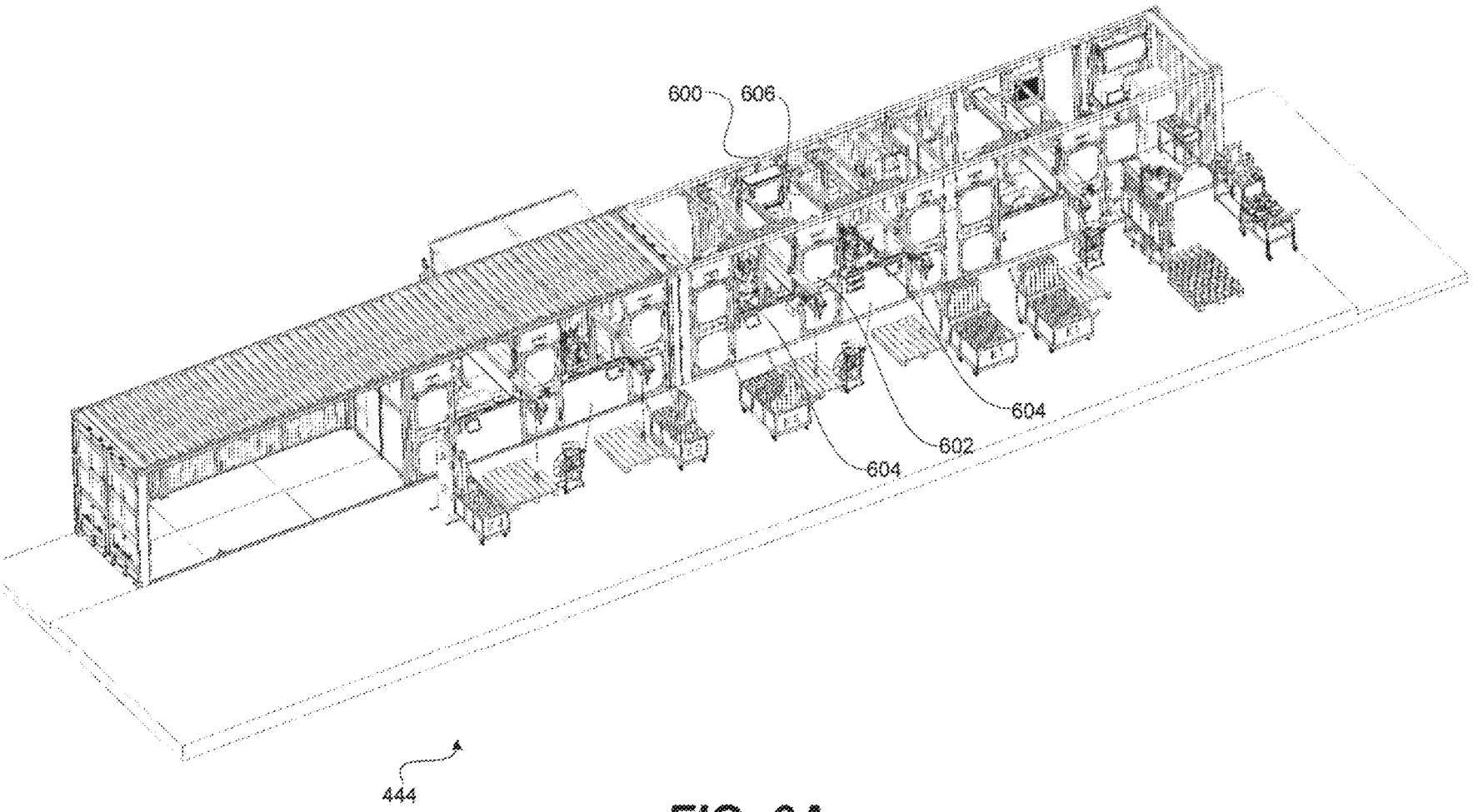
FIG. 6A is a perspective view of a group of intermodal containers that form a welding workstation, in accordance with some embodiments.

FIG. 6A is a perspective view of a group of intermodal containers 122 that form a welding assembly line 444 that includes one or more welding workstations 600, in accordance with some embodiments. In some embodiments, the welding assembly line 444 may be configured as a series of longitudinally interconnected intermodal containers 122 that form one or more enclosed manufacturing cells for robotic welding. The welding assembly line 444 may be organized into multiple welding sections (e.g., welding workstations 600) that are arranged in series. A welding workstation 600 may include a robot 602 and two positioners 604 configured to hold workpieces in precise orientations during the welding operation. A welding section may include specialized conductors (e.g., welding jigs) mounted to the positioners 604. Each welding section may be adapted for welding a particular category of steel frame elements. The steel frame elements may include structural joints, connectors, base plates, and other load-bearing members used in the construction of building 142 at construction site 140.

In some embodiments, the welding process within each welding section may be protected by a safety curtain 606, which may be semi-transparent and integrated with safety interlocks. The welding operation may automatically stop if the curtain or access door is opened. A worker may alternate between loading a new workpiece onto one positioner while the robot welds a workpiece on the other positioner, thereby enabling continuous, non-idle operation. After a welding cycle is completed, the worker may use a crane beam or magnetic gripper to remove the welded element from the positioner and load welded element onto a pallet for further transport or assembly. Welded components may be stacked vertically in compact bundles using straps to conserve transport volume. The workstation may further include storage zones for replacement filters and a service console with the tools for maintaining the robot system. The blank components used in welding may be transported to the workstation from the laser cutting section via dedicated material carts configured for pipe and tube transfer.

Figure 6B:
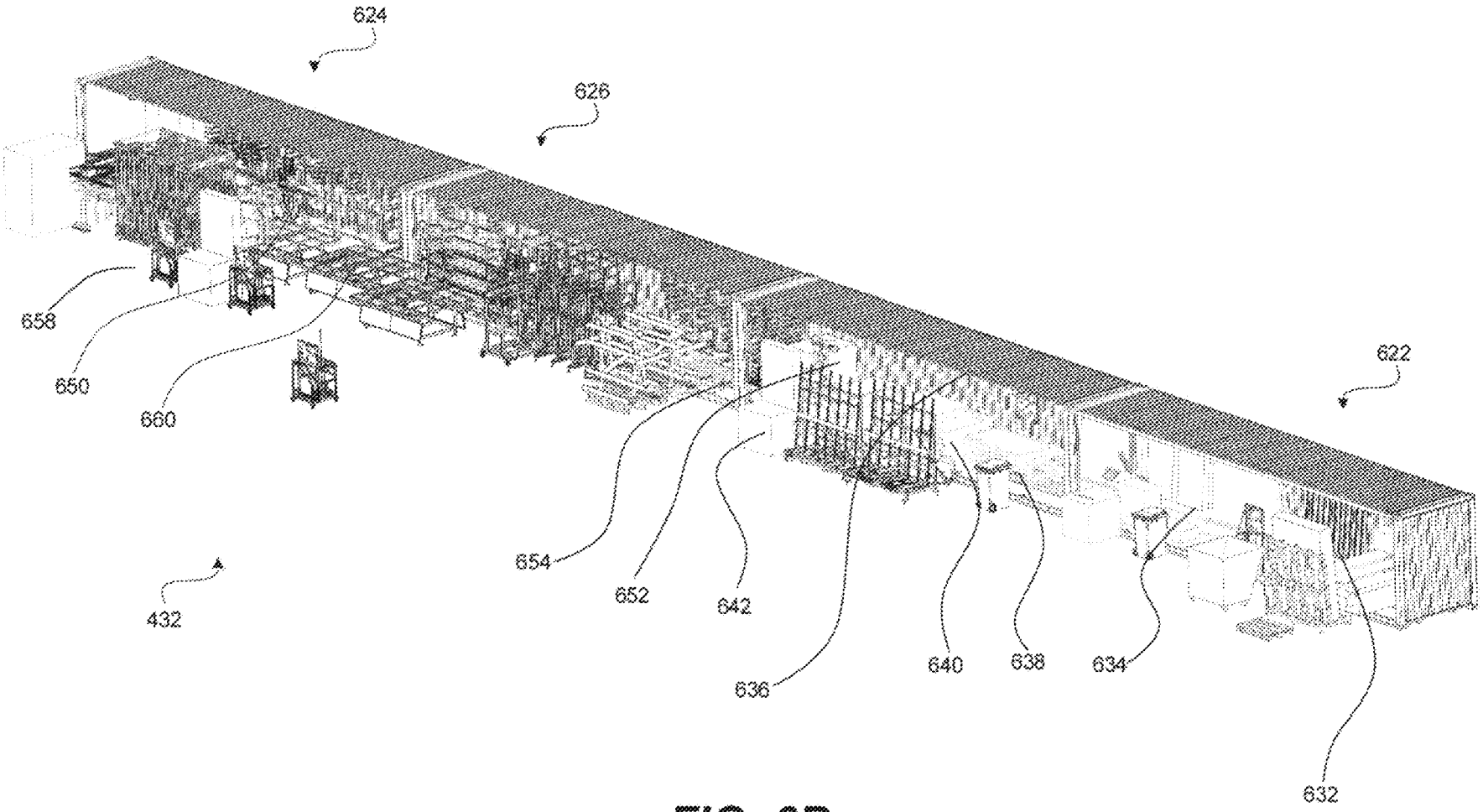
FIG. 6B is a perspective view of a group of intermodal containers that form an assembly line of window manufacturing, in accordance with some embodiments.

FIG. 6B is a perspective view of a group of intermodal containers 122 that form an assembly line 432 of window manufacturing, in accordance with some embodiments. The window manufacturing assembly line 432 is an example of an assembly line 130. The window manufacturing assembly line 432 may be formed from a sequence of intermodal containers 122 configured into three or more integrated workstations, such as an insulated glass unit manufacturing workstation 622, a window profile cutting workstation 624, and a window assembly workstation 626. The insulated glass unit manufacturing workstation 622 and workstation 624 may work in opposite directions so that the manufactured window glass and cut window frame converge at the middle of the window assembly line 432. Each workstation may occupy one or more intermodal containers 122 and may include dedicated processing stations, material handling equipment, and storage infrastructure tailored to the specific manufacturing tasks performed in each workstation.

The insulated glass unit manufacturing workstation 622 may be configured to produce sealed double-glazed glass units used in windows installed in building 142. The insulated glass unit manufacturing workstation 622 may include a glass cutting station permanently mounted to an intermodal container 122. The glass cutting station may include a sheet glass cutting and breaking machine configured to execute dimensioning tasks based on predefined cutting plans. A suction lift system may be used to move full-size glass sheets from a pyramid storage rack onto the cutting table, and a glass waste bin may be positioned adjacent to the cutting station to receive offcut material. Cut glass panes may be transferred via a crane beam 632 with pneumatic suction cups to a vertical washing and drying machine 634, which may be permanently mounted to the intermodal container 122. The vertical washing and drying machine 634 may include an integrated air intake and an industrial osmosis unit for purifying water used in the cleaning process. Washed panes may be lifted by another crane beam 636 with pneumatic suction cups and delivered to a spacer application table 638. The spacer application table 638 may include a spacer unwinder and a spacer softening device. A spacer may be adhered to one pane, and a second pane may be positioned and pressed into place to form an insulated glass unit. In some embodiments, warm-edge spacer technology may be used to eliminate the need for secondary sealing. The assembled unit may then be moved to a press-furnace 640 configured to thermally bond the unit. The bonded insulated glass unit may be transferred onto roller tables for cooling and staging. A self-propelled electric stacker 642 with suction cups may be used to lift the finished unit and place the finished unit onto a pyramid storage rack, which may be configured in either metal or wooden form depending on downstream logistics or transport requirements. One or more 5S boards may be mounted within the insulated glass unit manufacturing workstation 622 to organize maintenance tools and consumables.

The window profile cutting workstation 624 may be configured to convert raw-length window profiles into reinforced frame components for use in windows installed in building 142. The window profile cutting workstation 624 may include one or more racks for storing PVC profile blanks, reinforcing profiles, and cut profile components. Each rack may be configured with a Kanban-controlled locking mechanism, which may require retrieval of a task card prior to material access to improve traceable and organized inventory flow. Workers may retrieve task cards and transport profile blanks using picker carts or transport trolleys. The window profile cutting workstation 624 may include a window profile saw 650 with an automatic positioner, which may be permanently mounted to an intermodal container 122, which may execute cutting sequences based on pre-loaded programs corresponding to different profile types and window designs. In some embodiments, cut profiles may be evaluated for additional operations and, if required, routed to a milling station 652 configured to machine slots, channels, or holes into the profile, such as drainage slots, hardware interfaces, or fastener cutouts. The window profile cutting workstation 624 may also include a separate milling machine configured to process mullion profiles and other intermediate frame elements. Reinforcing operations may be performed on a dedicated reinforcement table where steel or rigid inserts are inserted into the window profiles. Reinforcing profiles may be stored on racks located adjacent to the reinforcement table 654. The window profile cutting workstation 624 may further include dedicated saws and storage racks for glazing beads, as well as a guillotine or bead saw for trimming such components to final dimensions. Finished and reinforced profiles may be transferred to racks 658 or carts staged for delivery to the window assembly workstation 626. In some embodiments, the window profile cutting workstation 624 may be configured to process window profiles made from materials other than PVC, such as wood, aluminum, or composite materials, depending on the architectural specifications of building 142.

In some embodiments, the window assembly workstation 626 may be configured to integrate frame profiles and insulated glass units into complete window units. The window assembly workstation 626 may include multiple ergonomic worktables 660, each paired with transport carts and storage racks containing pre-loaded frame components, insulated glass units, and finishing hardware. Workers may begin by retrieving reinforced profiles and welding the profiles into rigid window frames. After the frame is cleaned and aligned, a corresponding double-glazed unit may be retrieved using a suction-assisted stacker and inserted into the frame. Glazing beads stored on nearby shelves may be cut to length using an integrated guillotine and installed to secure the glass. Racks positioned adjacent to each table may store a wide array of fittings, connectors, and window-specific components. The inventory may be organized according to a Kanban system to ensure single-operator efficiency. Upon completion, finished windows may be transferred to pyramid racks designated for specific buildings 142 for installation. The finished windows may be delivered in a just-in-time manner from intermodal-container-based factory 120 to construction site 140.

Example Exterior-Extended Containers

Figure 7A:
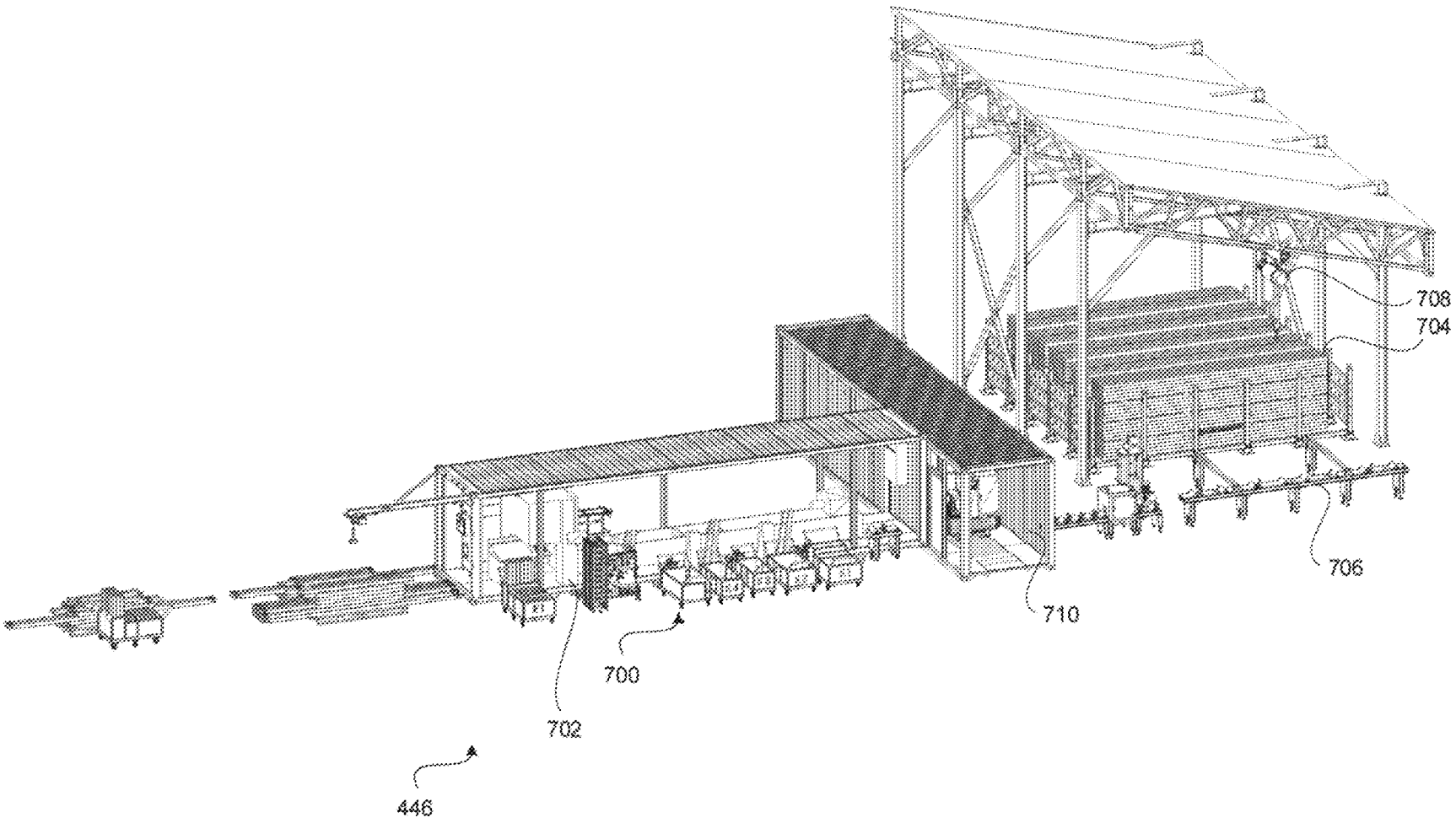
FIG. 7A is a perspective view of a group of intermodal containers that form a laser cutting tube workstation, in accordance with some embodiments.

FIG. 7A is a perspective view of a group of intermodal containers 122 that form a pipe cutting assembly line 446 that includes a laser cutting tube workstation 700, in accordance with some embodiments. In some embodiments, the laser cutting tube workstation 700 may be configured to receive raw pipe material from an outdoor warehouse 704 and perform automated laser cutting operations to produce tubular structural elements for steel frames used in building 142. The laser cutting tube workstation 700 may include a laser tube cutter 702 permanently mounted within an intermodal container 122, along with associated pipe feed rollers 706, cutting belts, and positioning sensors configured to automate material alignment and feeding. A compressor may be connected to the laser cutter 702 to support pneumatic subsystems used in the cutting process. The laser cutting tube workstation 700 may further include an operator console and a working board containing the tools for routine service and filter replacement. A sensor-based notification system may prompt the operator to replace filters.

In some embodiments, the laser cutting tube workstation 700 may be directly connected to an external warehouse 704 containing raw pipe inventory. The external warehouse may be sheltered by a structural canopy and may include stacked pipe bundles positioned adjacent to a rail-fed pipe transfer system. A crane beam 708 with a magnetic grip may be used to lift individual pipes from the external warehouse 704 and place the pipes onto an outdoor pipe feed roller line 706. The pipe feed roller line 706 may include a circular pipe cleaning station that removes surface oxidation and may optionally include a priming application module configured to apply a quick-drying galvanized primer. In some embodiments, one of the intermodal containers 122 forming the laser cutting tube workstation 700 may include a dedicated wall opening 710 aligned with the roller line 706 to receive pipes from the exterior of the intermodal-container-based factory 120. The cleaned and/or primed pipes may then be advanced through motorized rollers into the laser cutting tube workstation 700. Upon reaching the interior, the pipes may be engaged by belt-driven positioning mechanisms and guided into the laser cutter.

In some embodiments, after cutting, the pipe segments may be ejected onto a discharge roller line where they are collected and lifted using an internal crane beam with a magnetic grip. The internal crane beam may be stowed inside the intermodal container 122 during transport and deployed on rollers when the workstation is assembled on-site. Cut pieces may be stacked onto pallets and organized into specific job packs for transfer to downstream workstations such as the welding section. The laser cutting tube workstation 700 may be preassembled with one or more functional systems such as ventilation, exhaust filtration, and handling mechanisms to enable rapid deployment and integration into the overall intermodal-container-based factory 120.

Figure 7B:
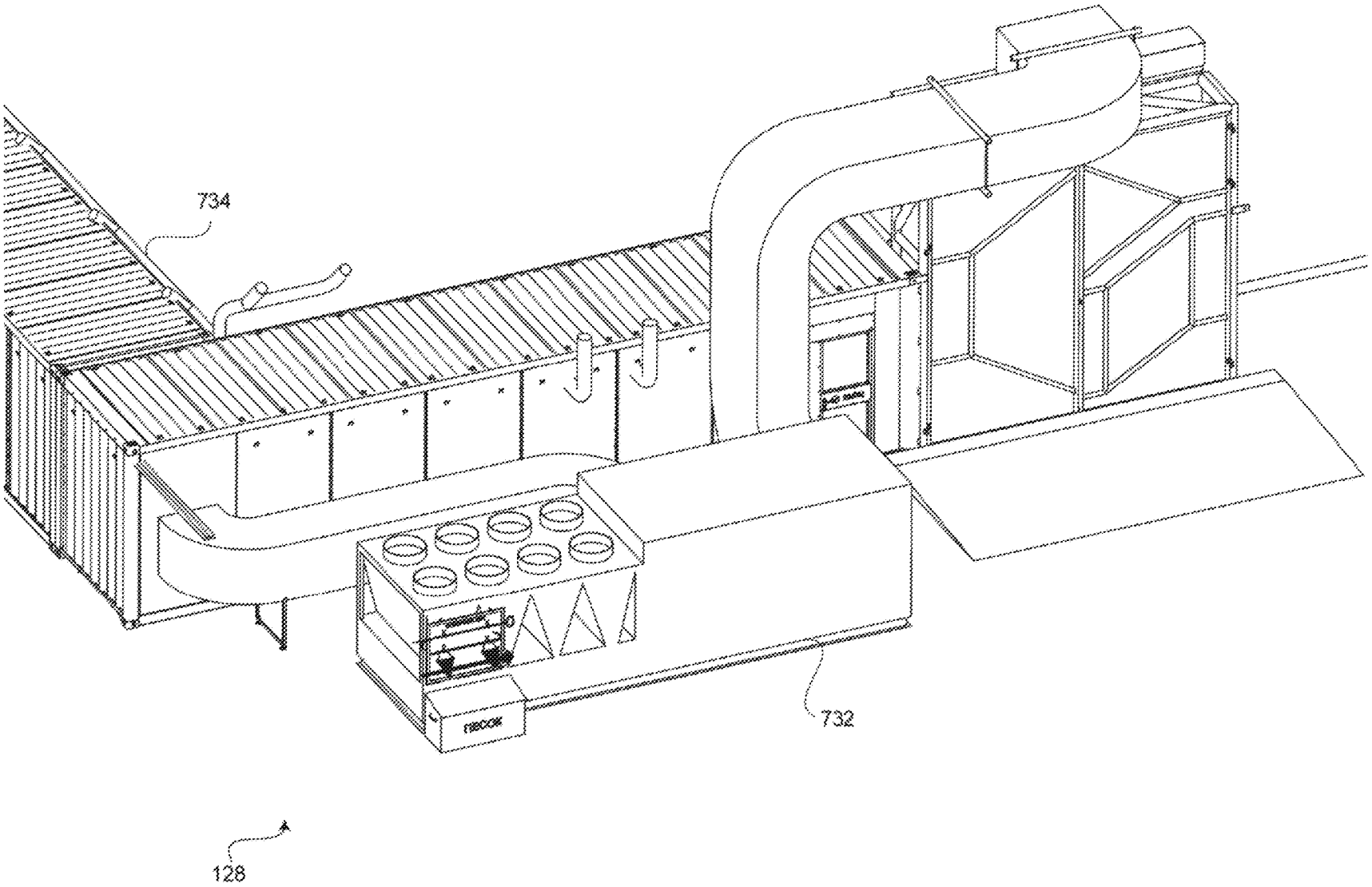
FIG. 7B and FIG. 7C are perspective views of a ventilation unit that is integrated into an intermodal container forming part of the perimeter of the intermodal-container-based factory, in accordance with some embodiments.
Figure 7C:
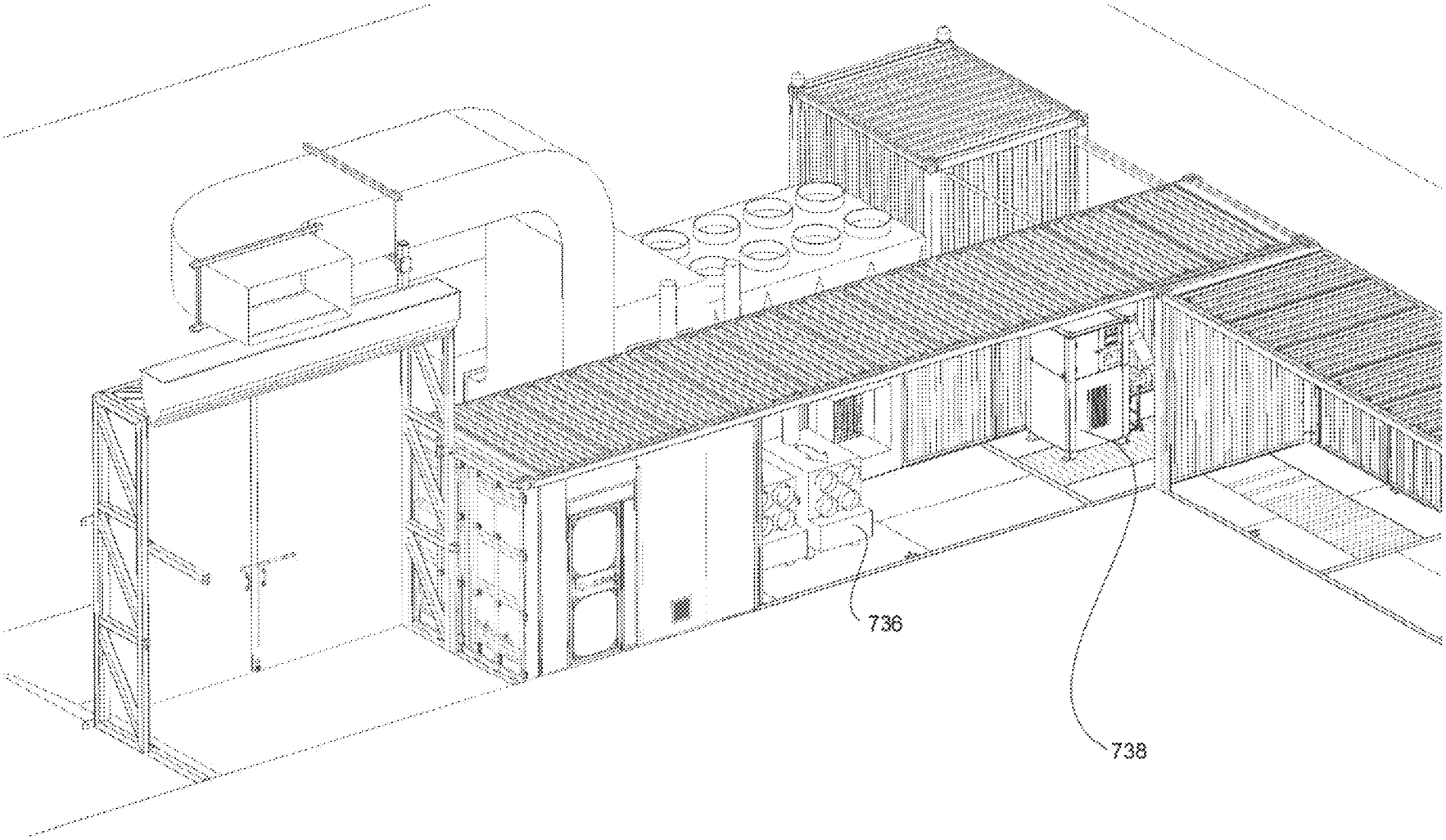

FIG. 7B and FIG. 7C are perspective views of a ventilation unit 128 that is formed with components in one or more intermodal containers 122 and some exterior HVAC machines, in accordance with some embodiments. The intermodal containers 122 may form part of the perimeter of the intermodal-container-based factory 120. In some embodiments, ventilation unit 128 may form part of a factory life support department configured to maintain environmental conditions across the intermodal-container-based factory 120. The ventilation unit 128 may include multiple subsystems such as HVAC ductwork, pressure support systems, and emergency backup components.

In some embodiments, the ventilation unit 128 may include a factory-wide air conditioning system 730 configured to circulate conditioned air through ductwork 734 routed along the perimeter of the intermodal containers 122. The air conditioning system 732 may be connected to an exterior equipment module that includes industrial cooling and air distribution infrastructure. Backup diesel heaters 736 may be installed near the entrance to maintain thermal stability during external power outages. A pressure regulation system 738 may also be provided to support structural stability and inflation of a pneumatic roof or other inflatable membranes connected to the factory.

In some embodiments, the ventilation unit 128 may further include an air compressor for pneumatic system support, as well as centralized power supply equipment to support heating, cooling, and pressure regulation functions throughout the intermodal-container-based factory 120. The components of the ventilation unit 128 may be pre-installed within one or more intermodal containers 122 and are permanently mounted to the one or more intermodal containers 122 to enable rapid deployment and self-contained factory operation in various climate conditions.

Example Side-Extended Containers

Figure 8A:
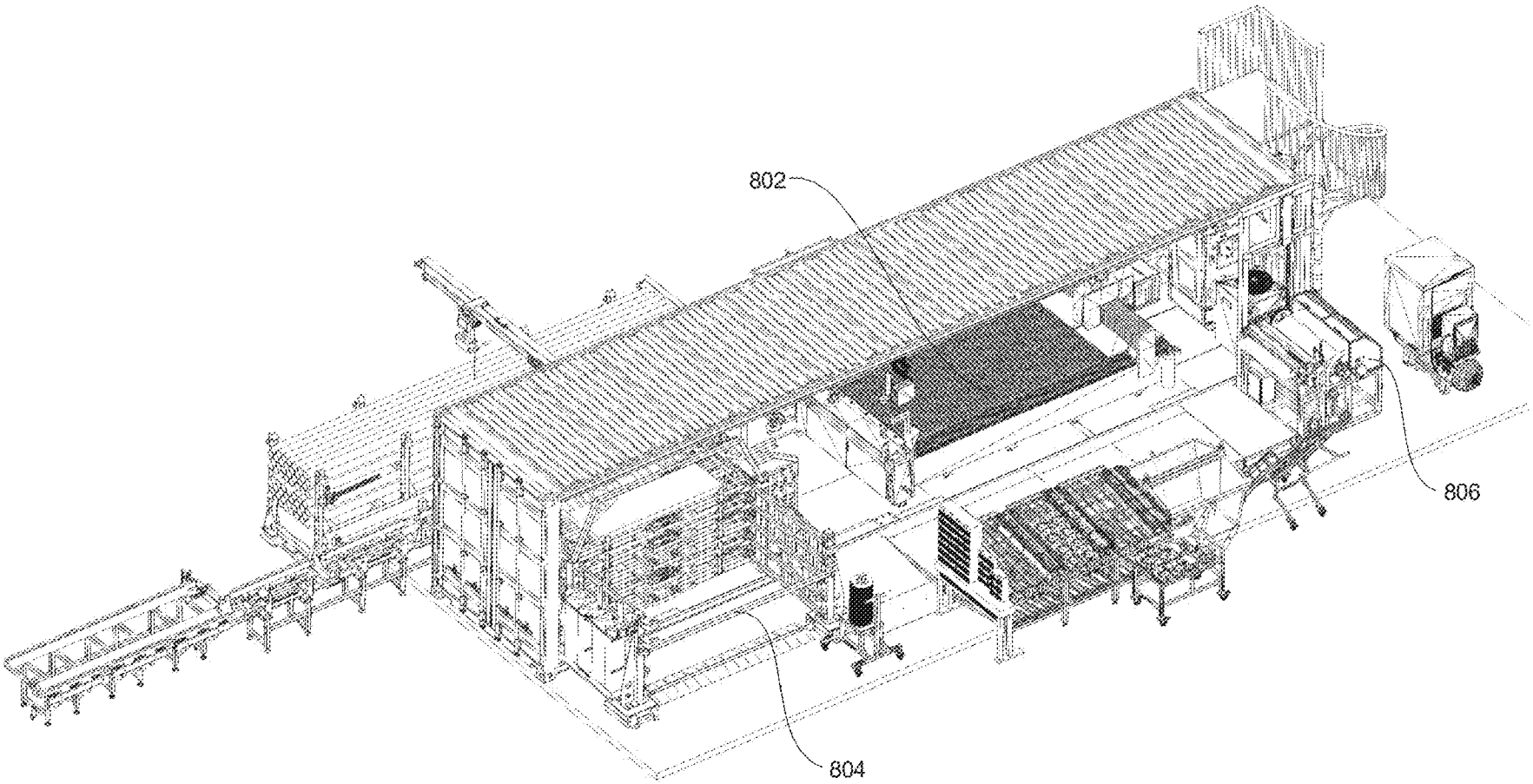
FIG. 8A is a perspective view of an intermodal container that forms a laser cutting workstation, in accordance with some embodiments.
Figure 8B:
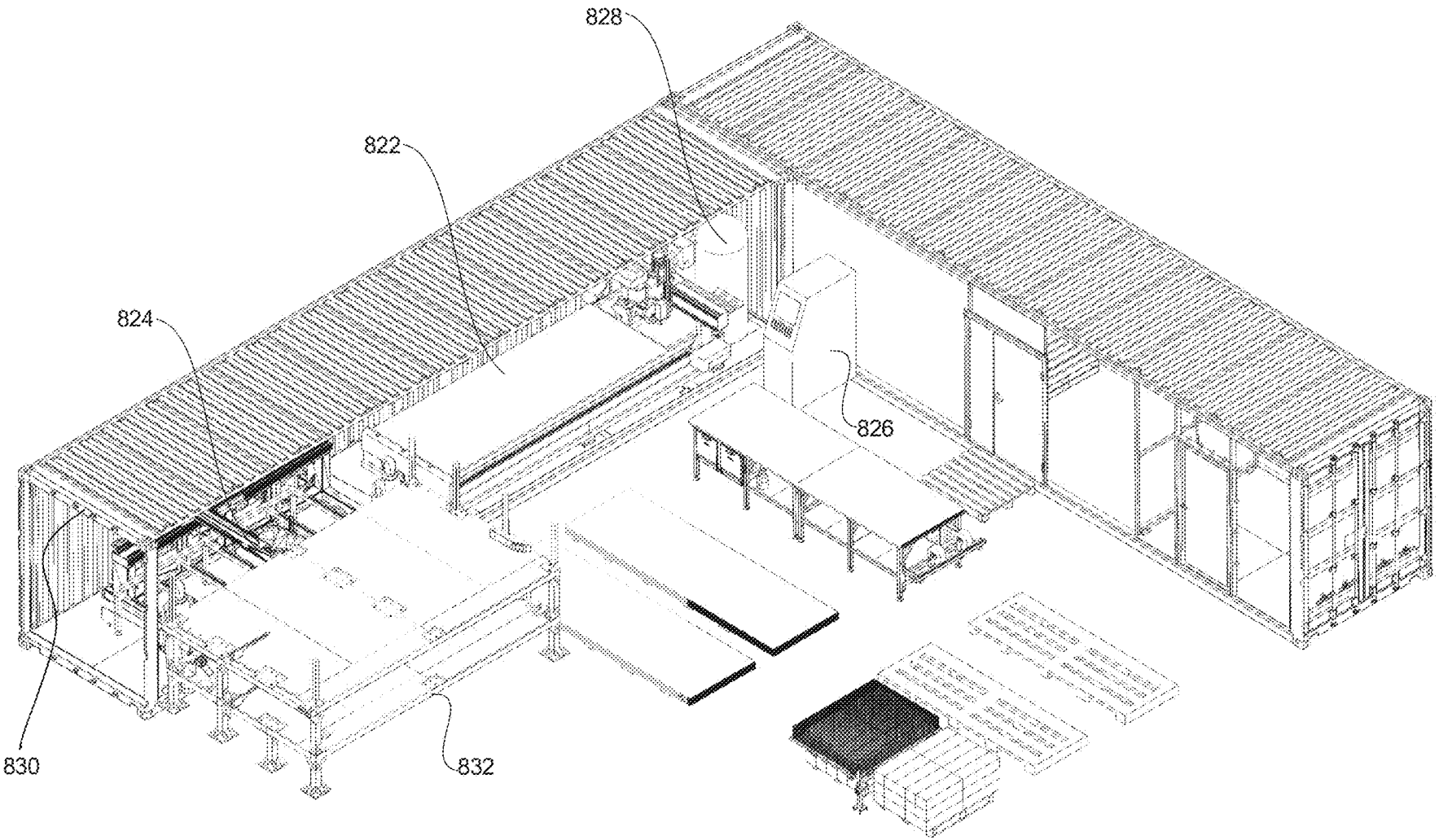
FIG. 8B is a perspective view of an intermodal container that forms an aluminum composite milling workstation, in accordance with some embodiments.

FIG. 8A and FIG. 8B are examples of intermodal containers 122 that are side extended in the lateral direction to form larger workstations. FIG. 8A is a perspective view of an intermodal container 122 that forms a laser cutting workstation 450, in accordance with some embodiments. In some embodiments, the laser cutting workstation 450 may be formed from a modified intermodal container 122 that includes structural side extensions to provide additional lateral space for cutting, material handling, and part staging. The laser cutting workstation 450 may include removable wall panels and integrated structural reinforcements that enable unobstructed access from multiple directions. A laser cutting machine 802 may be permanently mounted within the intermodal container 122 and configured to process both flat sheet metal and tubular materials into part geometries for downstream assembly.

In some embodiments, the laser cutting workstation 450 may include a rack 804 for storing raw sheet metal. Each rack section may hold sheets of different thicknesses. Access to sheet metal may be managed through a Kanban system that prevents retrieval of additional sheets until a Kanban card is triggered and placed into a designated queue. Material loading may be performed using a cantilevered crane beam with integrated suction cups configured to lift and position individual sheets onto the cutting bed. Safety interlocks may prevent machine operation until the crane beam has been retracted to a home position. The laser cutting workstation 450 may also include a strip uncoiling machine configured to unwind coiled painted strip material to desired lengths, with both manual and automatic feed modes. The cut strip material may then be directed to downstream processing such as sandwich panel fabrication.

In some embodiments, the laser cutting workstation 450 may include transport carts and staging racks for segregating cut components based on subsequent operations. For example, transport carts may be provided for transporting laser-cut blanks to welding, bending, or piling sections. A rack for storing cut blanks may be located near the laser cutting machine, with a Kanban-controlled release system that restricts access to replenishment stock until a card is retrieved. Waste material may be collected in designated scrap containers located on both sides of the laser cutting workstation 450. An operator console may be located near the laser cutting machine and configured to receive production task codes and control instructions from factory software. The console may guide the operator through sheet selection, loading sequence, and part output tasks based on a work card.

In some embodiments, the laser cutting workstation 450 may include an upper-level office 520 mounted above the intermodal container 122 that forms the laser cutting workstation 450, accessed by a staircase. The office 520 may provide visibility over the cutting operation and access to digital design files and factory coordination tools. Additional equipment such as compressors, power supply panels, Kanban task boards, and part-specific tooling storage may also be included in one or more intermodal containers 122. The laser cutting workstation 450 may operate as part of a synchronized production flow, with output components delivered to frame welding or structural assembly lines within the intermodal-container-based factory 120.

FIG. 8B is a perspective view of an intermodal container 122 that forms an aluminum composite milling workstation 820, in accordance with some embodiments. In some embodiments, the aluminum composite milling workstation 820 may be configured to process aluminum composite panels using automated equipment for shaping, labeling, and finishing. The milling operations may be performed within an intermodal container 122, while the finishing and staging operations may extend into adjacent floor space within the intermodal-container-based factory 120.

In some embodiments, the aluminum composite milling workstation 820 may include a computer numerical control (CNC) milling machine 822 configured to perform cutting, engraving, or perforation on aluminum composite panels. A liftable scissor table 824 may be positioned near the CNC milling machine 822 and configured to raise and support the aluminum composite panels at the correct loading height. The CNC milling machine 822 may be equipped with suction cups to lift panels from the scissor table automatically and position them for machining. A control console 826 may be used to operate the CNC milling machine and to access predefined milling patterns. A dust extraction unit 828 may be installed behind the CNC milling machine 822 to capture particulates generated during cutting operations. A label printer 830 may also be included for applying stickers to milled panels for tracking or assembly instructions.

In some embodiments, the aluminum composite milling workstation 820 may include a two-tier storage rack 832 for storing color-coded aluminum composite panels. Processed panels may be transferred to one or more finishing tables located outside the intermodal container 122. At the finishing tables 824, self-adhesive magnetic vinyl may be applied to the milled composite panels. A magnetic vinyl unwinder may be included for feeding vinyl sheets to the operator. Material inventory and consumption may be monitored using a Kanban system, wherein the removal of a pallet or vinyl roll may require a Kanban card to be placed into a designated collection bin to trigger replenishment. Completed panels may be stacked on pallets for downstream packaging or project-specific sorting.

Example Longitudinal-Extended Assembly Lines

Figure 9A:
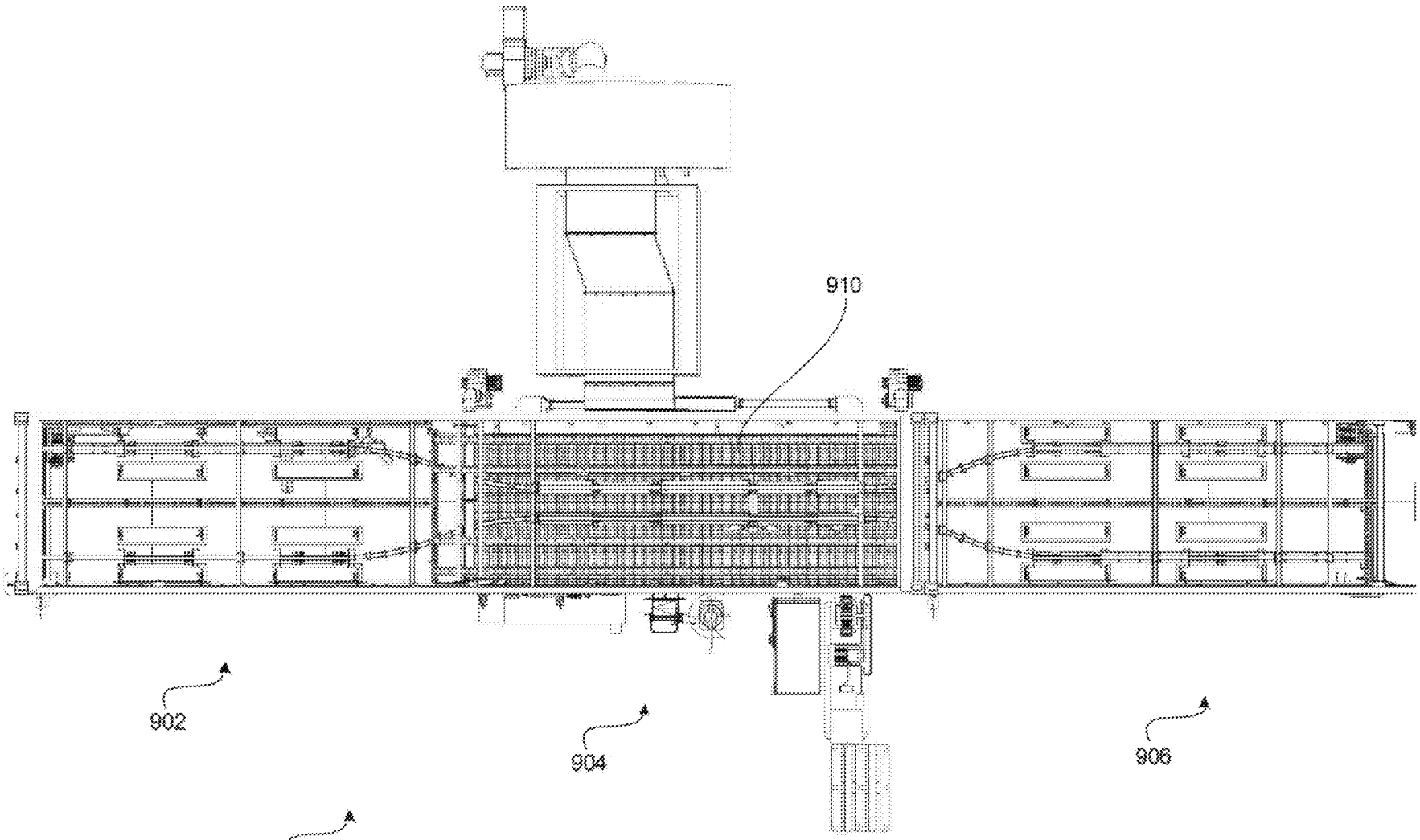
FIG. 9A is a perspective view of a group of intermodal containers that form a painting assembly line of one or more painting workstations, in accordance with some embodiments.
Figure 9B:
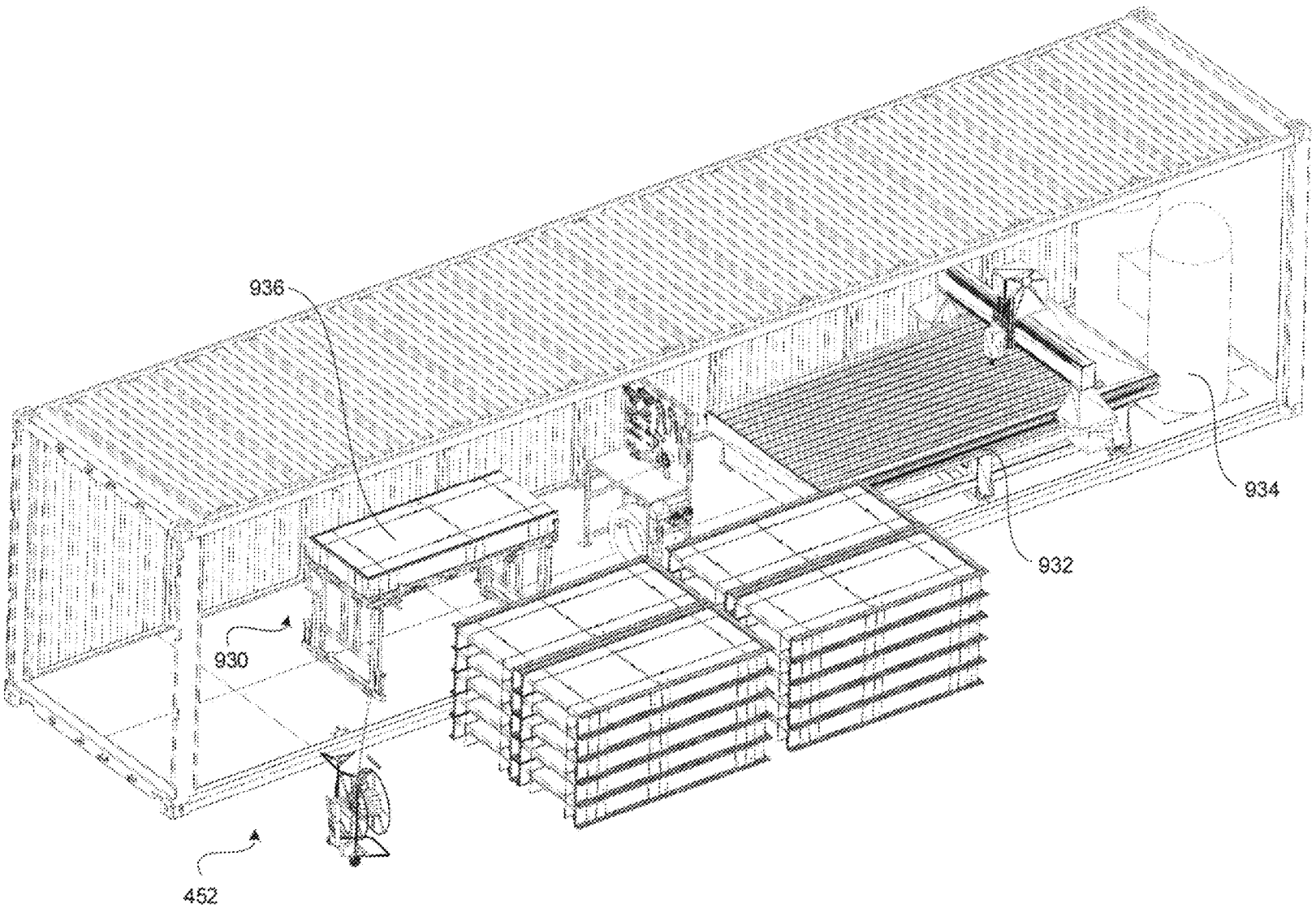
FIG. 9B is a perspective view of a group of intermodal containers that form a door assembly line that includes a door assembly workstation, in accordance with some embodiments.
Figure 9C:
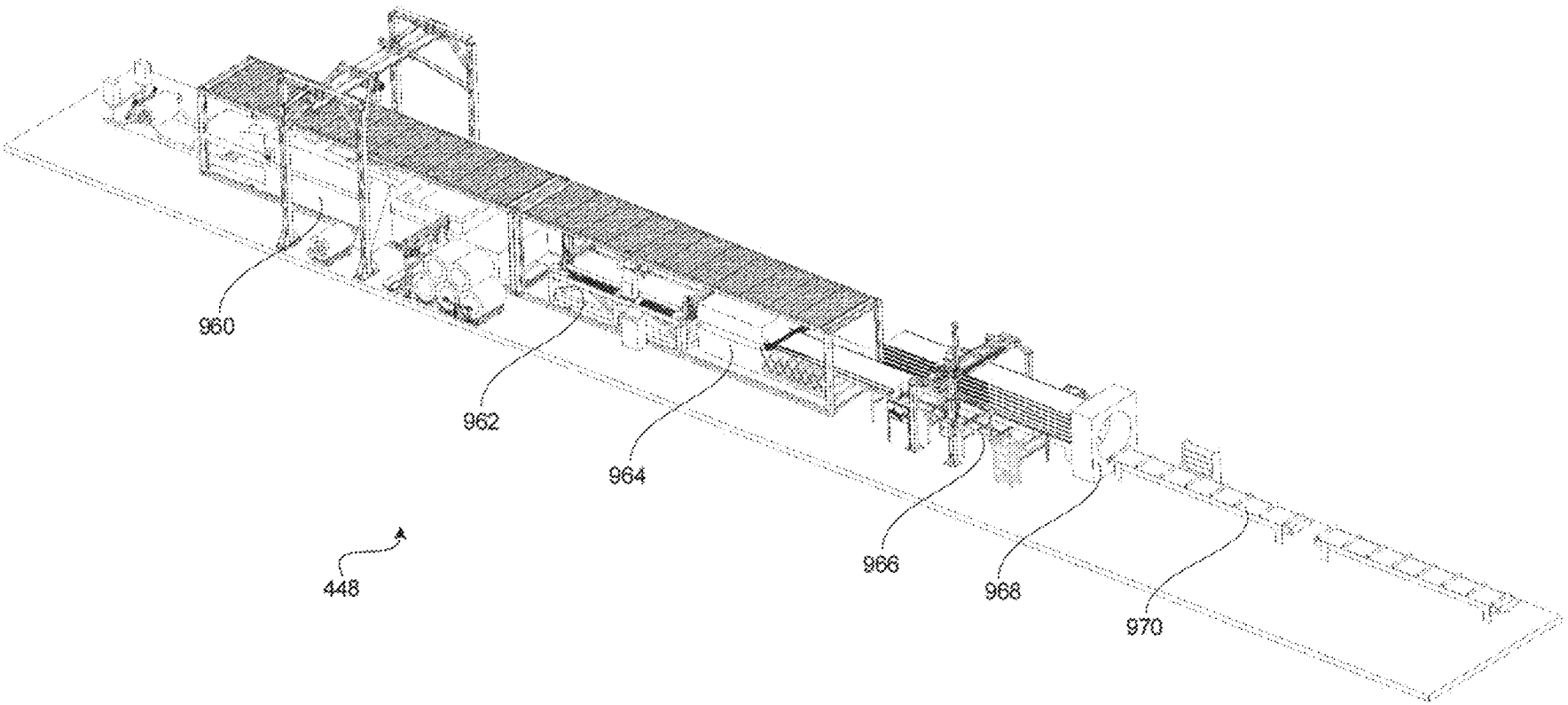
FIG. 9C is a perspective view of a group of intermodal containers that form an assembly line of a sandwich panel manufacturing, in accordance with some embodiments.

FIG. 9A through FIG. 9C are examples of intermodal containers 122 that are connected in series and extended in the longitudinal direction to form larger workstations.

FIG. 9A is a perspective view of a group of intermodal containers 122 that form a painting assembly line 900 of one or more painting workstations 910, in accordance with some embodiments. In some embodiments, the painting assembly line 900 may be formed by longitudinally connecting multiple intermodal containers 122 to define a linear processing corridor configured for coating and drying structural components such as frame elements. The longitudinal container configuration may include adjacent painting zones separated by internal partitions or curtains, with guide tracks and suspension traverses enabling continuous flow of parts between sections.

In some embodiments, the painting assembly line 900 may include three sequential zones: a hanging and drying zone 902, a coating application zone 904, and a second hanging and drying zone 906. The hanging and drying zones 902 and 906 may include traverses suspended from ceiling-mounted rails used to transport and suspend components such as brackets or steel frame elements for painting and drying. The coating application zone 904 may include a filtered air curtain system and a paint spray area enclosed by protective curtains to contain overspray and airborne particulates. Infrared heaters may be installed above the drying sections to accelerate curing and reduce work cycle time.

In some embodiments, the painting workstation 910 may include a spray gun system for applying a two-component, quick-drying, corrosion-resistant primer enamel based on polyurethane-acrylic resin. Operators may use pre-positioned hooks and brackets to suspend parts from traverses, enabling access from all sides. Painted parts may be moved along the guide system and staged in designated drying zones equipped with infrared heating and protective barriers to retain heat. Sliding curtains may be closed to thermally isolate the drying zones and improve process efficiency.

In some embodiments, the painting assembly line 900 may include additional support infrastructure such as ventilation ducts for exhaust filtration, lighting fixtures for workspace visibility, and shelving for storing preloaded hooks and other consumables. Kanban boards may be positioned within each workstation to manage supply and maintenance tasks. Filter cloths and other replaceable elements may be stored in designated compartments adjacent to the painting workstation 910. The painting assembly line 900 may be configured to operate with minimal idle time by enabling a two-worker handoff cycle: one operator paints while another stages or removes parts, maintaining a continuous flow through the intermodal-container-based factory 120.

FIG. 9B is a perspective view of a group of intermodal containers 122 that form a door assembly line 452 that includes a door assembly workstation 930, in accordance with some embodiments. In some embodiments, the door assembly line 452 may be formed by longitudinally connected intermodal containers 122 to support a continuous sequence of door fabrication processes including milling, assembly, and packaging. The longitudinal configuration may include designated work zones for machining door frame components, storing door panels, and assembling complete door modules.

In some embodiments, the door assembly workstation 930 may include a CNC milling machine 932, which may be permanently mounted within an intermodal container 122 and configured to create precision cutouts, grooves, and recesses in door frame elements. A dedicated jig 936 for milling door frame components may be used to position and secure parts during machining. Dust generated from milling may be extracted using an integrated dust collection unit 934, which may also be permanently mounted in an intermodal container 122. Nearby storage areas may be provided for raw door panels and milled frame elements to facilitate efficient material handling.

In some embodiments, the door assembly workstation 930 may also include an assembly jig 936 used for constructing full door modules. The jig 936 may be positioned adjacent to the milling zone. Pre-milled components and door panels may be retrieved from vertically stacked pallets or part-specific shelves. In some embodiments, fully assembled door modules may be staged in a palletized area for collection and downstream handling. Packing personnel may retrieve completed modules from this area and prepare them for installation at a building 142. Each door module may be pre-equipped with hardware, panels, and mounting structures such that the module can be positioned and secured directly into a wall opening. The container-based design of the door assembly line 452 may enable efficient, repeatable fabrication of door systems within the intermodal-container-based factory 120.

FIG. 9C is a perspective view of a group of intermodal containers 122 that form an assembly line 448 of a sandwich panel manufacturing, in accordance with some embodiments. In some embodiments, the assembly line 448 for manufacturing sandwich panels may be formed from a group of intermodal containers 122 that are longitudinally connected to define a continuous enclosed processing corridor. The intermodal containers 122 may be equipped with integrated structural reinforcements and cutaway openings that allow mechanical continuity of the production line across multiple containers, supporting uninterrupted material flow and access. The assembly line 448 may begin with a strip storage and loading zone, where coiled metal strip stock may be staged and introduced into the process via an overhead crane beam configured to position strips into a rolling mill 960.

In some embodiments, the rolling mill 960 may be configured to fabricate sandwich panels by forming a lock seam profile on upper and lower metal facings and integrating insulation cores between the layers. An adhesive application module may deposit bonding material such as polyurethane or EPS foam between the outer facings. In some embodiments, the assembly line 448 may include a milling machine 962 (e.g., a five-axis milling machine) integrated within the continuous flow of the rolling section, the milling machine 962 being configured to form precise openings, cutouts, or channels in the metal facings during or immediately following the rolling process. Such milling may accommodate utility penetrations, mechanical fastening points, or predefined recesses for electrical routing without interrupting the production throughput. Downstream of the milling station, a flying cut-off saw 964 may be used to cut each panel to a specified length in continuous motion, minimizing cycle time. A vacuum-based panel transfer device 966 may reposition cut panels for alignment and stacking, which may be carried out by a palletizing system that forms bundles associated with specific building 142 projects. A pallet wrapping gantry 968 may secure finished panel bundles with protective film, and a roller conveyor 970 may guide the bundled units toward an outbound logistics zone for transport to the construction site 140 for the installation of the panels at a building 142. Each operation along the assembly line 448 may be configured for compatibility with Kanban or digitally triggered workflow signaling, enabling efficient batch formation and traceability of panels for targeted building assemblies.

Example Lateral-Combined Assembly Lines

Figure 10A:
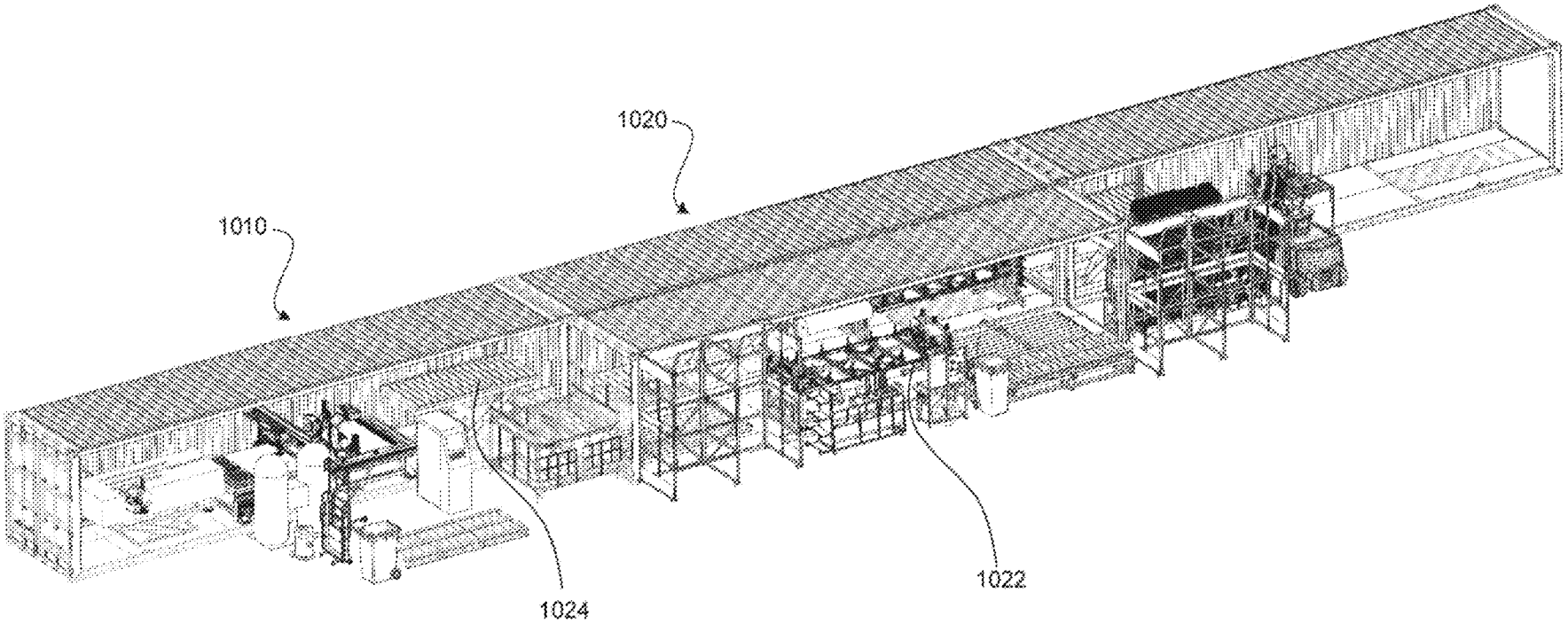
FIG. 10A is a perspective view of a group of intermodal containers that form an assembly line of module assembly workstations, in accordance with some embodiments.
Figure 10B:
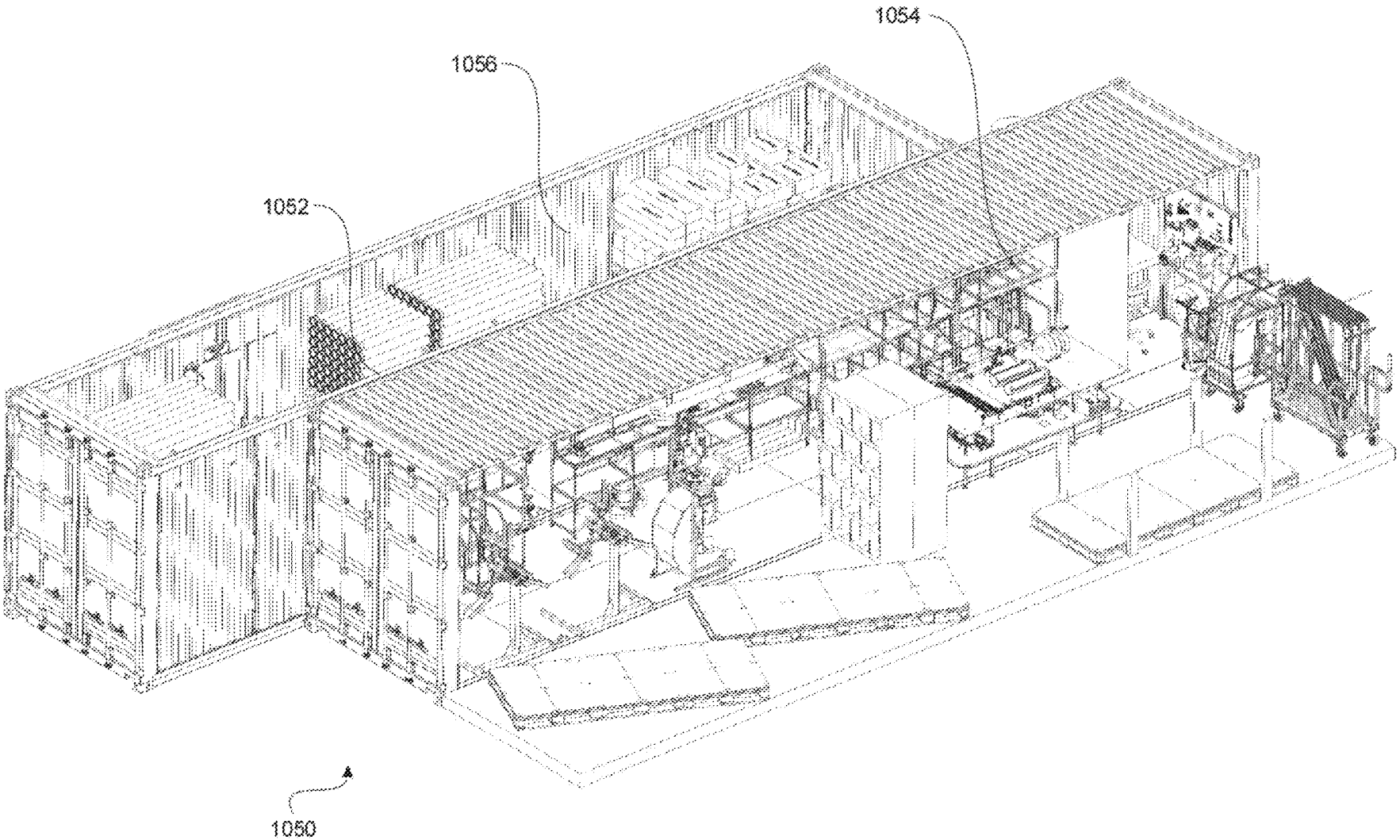
FIG. 10B is a perspective view of an intermodal container that forms a plumbing department workstation, in accordance with some embodiments.

FIG. 10A and FIG. 10B are examples of intermodal containers 122 that are connected in parallel and extended in the lateral direction to form larger workstations.

FIG. 10A is a perspective view of a group of intermodal containers 122 that form an assembly line 1000 of module assembly workstations, in accordance with some embodiments. The assembly line 1000 may be an example of assembly line 434. The assembly line 1000 of the module assembly workstations extends both in the lateral direction and the longitudinal direction.

In some embodiments, the assembly line 1000 for module assembly workstations may include a layout of intermodal containers 122 that are both longitudinally and laterally connected to enable an extended and multifunctional production line. The assembly line 1000 may include a workstation 1010 for milling panel boards and a workstation 1020 assembling interior modules such as ceiling panels, wall units, and structural partitions. A portion of the intermodal-container-based factory 120 may be allocated for receiving OSB panels, which may be stored on vertical pallet racks adjacent to a labeling machine configured to apply identification stickers. After labeling, the panels may be transferred to a CNC milling workstation where predefined milling operations are performed based on programs selected by the operator at a nearby control console.

In some embodiments, the milled OSB panels may be automatically loaded onto a scissor-lift table 1024 that sequentially lowers as each panel is stacked, allowing for efficient accumulation of milled panels for downstream use. From this position, stacks of panels may be transferred to a distribution platform that serves multiple module assembly jigs 1022. The module assembly workstation 1020 may include two or more parallel jig stations 1022, each operated by a pair of workers. Workers may manually pull panels from the distribution platform and position them within the conductor frame of each jig station 1022. To support ergonomic transfer, the assembly line 1000 may include roller platforms that reduce lifting effort and facilitate the loading of large-format panels onto the jigs 1022.

In some embodiments, each jig 1022 may be supplied with light steel thin-walled profiles (LSTK) from vertically arranged shelving units. Workers may manually extract the appropriate profile based on the task card and position it within the jig 1022 according to laser projection markers that indicate profile placement. Insulation may be retrieved from a roll-based shelving rack, cut to size using a designated cutting stand, and temporarily stored before being layered into the module. The insulation may then be inserted between the OSB faces and metal profiles to form a complete composite panel. A dedicated working board may be included in each station for holding tools, fasteners, and consumables required for assembly, ensuring accessibility and efficiency during operation.

In some embodiments, after a module is assembled, the module may be moved onto a scissor-lift platform 1023 where it is added to a stack of completed units. These stacks may then be picked up by downstream packers, who may consult production planning software to determine which modules are assigned to specific buildings 142 in construction site 140. Each module may be labeled, grouped by project batch, and moved into temporary storage or onto a pallet for shipment. The modular design of the assembly line 1000 may allow each station to operate semi-independently while sharing materials, task data, and ergonomic infrastructure. The assembly line 1000 supports parallelized production, rapid scaling, and minimized labor overhead within the intermodal-container-based factory 120.

FIG. 10B is a perspective view of an intermodal container 122 that forms a plumbing department workstation 1050, in accordance with some embodiments. The plumbing department workstation 1050 may be an example of a plumbing module assembly line 442. In some embodiments, the plumbing department workstation 1050 may be configured as a laterally extended workstation, with its primary operations housed in a first intermodal container 122 and a second intermodal container 122 as a storage warehouse unit 1056 connected along the longitudinal sides. The connected intermodal containers 122 may include open sidewalls and shelving systems. One of the longitudinal walls of the plumbing department workstation 1050 may include a personnel-access door 1052 to enable direct entry from the interior of the intermodal-container-based factory 120.

In some embodiments, the plumbing department workstation 1050 may be divided into functional zones for assembling plumbing modules, processing pipe coils, and storing pre-cut plumbing components. The main assembly zone may include shelving 1054 for pipe fittings and fixtures, conductor rigs for module alignment, and worktables where pre-configured plumbing packs are built directly onto pallets. Adjacent carts may be used to transport components such as sheet metal, insulation, or OSB backboards required for fixture mounting.

In some embodiments, a second zone within the plumbing department workstation 1050 may be dedicated to pipe coil processing. This zone may include storage racks for pipe coils, multiple unwinders, and a counter with a small guillotine used to measure and cut flexible pipe segments to predefined lengths. An exhaust system may be positioned nearby to ventilate adhesives or gluing operations used for preparing fittings, particularly in configurations tailored for American plumbing standards. For such assemblies, an enclosed chamber with negative pressure extraction may be included for safe and odor-controlled application of chemical adhesives.

In some embodiments, additional stations within the plumbing department workstation 1050 may include tooling racks, manual pipe cutting stations, and workboards for accessing tools, consumables, and printed instructions. The subcomponents used in the assembly of plumbing modules may be staged using a Kanban system. Carts may circulate between storage zones and workstations to support lean, modular production workflows aligned with the construction requirements of building 142.

Example Manufacturing Workflow

Figure 11:
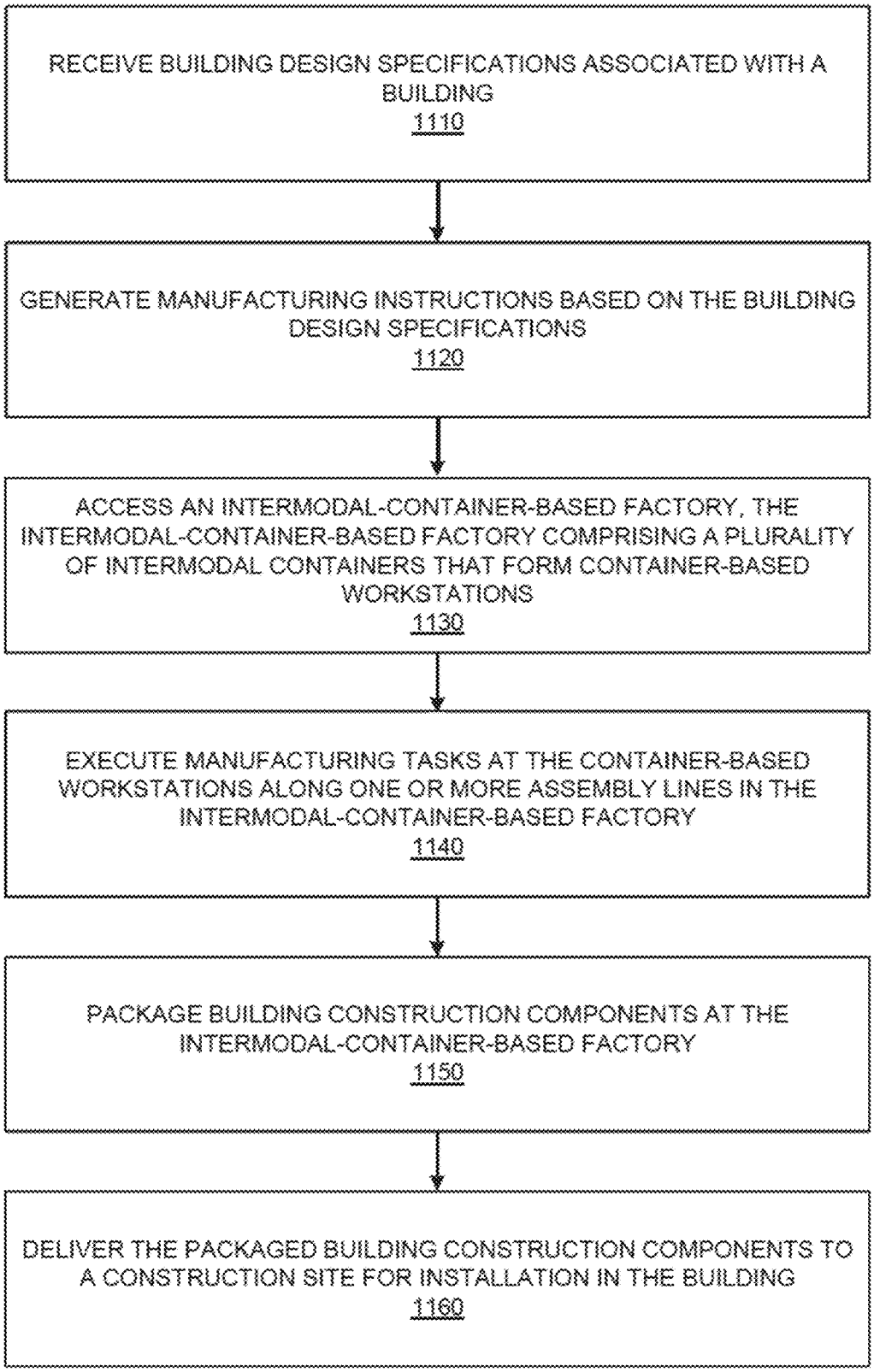
FIG. 11 is a flowchart depicting a process for manufacturing building components, in accordance with some embodiments.

FIG. 11 is a flowchart depicting a process 1100 for manufacturing building components, in accordance with some embodiments. In various embodiments, the process 1100 may include additional, fewer, or different steps. The steps in the process 1100 may also occur in a different order as described in FIG. 11.

In some embodiments, the process 1100 may include receiving 1110 building design specifications associated with a building. The building design specifications may define a set of building construction components that are to be manufactured off-site and delivered for installation in a building 142 at a construction site 140. The building design specifications may include architectural drawings, structural layouts, material selections, and component dimensions. In some embodiments, the building design specifications may be received by a task management system 110, which may include a task management system configured to manage vertically integrated manufacturing and construction operations. The task management system 110 may receive building design specifications from an architect, builder, or construction project coordinator. The task management system 110 may parse the received building design specifications to extract component requirements associated with different zones, systems, or material types. In some embodiments, the building design specifications may be imported as digital building models, CAD files, or other structured formats for further processing by the task management system 110.

In some embodiments, the process 1100 may include generating 1120 manufacturing instructions based on the building design specifications. The task management system 110 may generate the manufacturing instructions to define how the building construction components are to be fabricated at an intermodal-container-based factory 120. In some embodiments, generating manufacturing instructions may comprise assigning task-level instructions to designated container-based workstations. Each container-based workstation may correspond to one or more intermodal containers 122 that are configured with specialized manufacturing equipment and tools. In some embodiments, generating manufacturing instructions may further comprise translating the building design specifications into geometric dimensions, cutting sequences, or assembly steps. For example, the task management system 110 may convert a wall panel layout from the building design specifications into panel dimensions, fastener locations, and insulation profiles. The resulting instructions may be customized to account for tooling capabilities and workstation assignments available in the intermodal-container-based factory 120. The task management system 110 may associate each instruction with a particular intermodal container 122 within an assembly line 130 to support just-in-time task execution. In some embodiments, the generated manufacturing instructions may include production parameters, quality control tolerances, equipment selection criteria, and component-specific packaging preferences. The task management system 110 may transmit the generated instructions to software modules or programmable control systems embedded within the container-based workstations.

In some embodiments, the process 1100 may include accessing 1130 an intermodal-container-based factory. The intermodal-container-based factory includes a plurality of intermodal containers that form container-based workstations. The intermodal containers 122 may be transported to a factory site, such as a temporary or semi-permanent location in geographic proximity to the construction site 140. In some embodiments, deploying may comprise transporting the plurality of intermodal containers to a factory location using standard freight logistics such as trucks, railcars, or ships. The intermodal containers 122 may be arranged in a layout that defines one or more production zones. In some embodiments, deploying may further comprise stacking at least two of the intermodal containers vertically to form a multi-level structure. For example, a second-tier office container may be positioned above production containers to provide visibility and coordination functions. Some container-based workstations may be enclosed using inflatable or stretch roofing systems to create climate-controlled environments. In some embodiments, deploying may include structurally connecting the intermodal containers 122 using mechanical locking pins, bolted brackets, or alignment flanges to ensure structural stability and alignment across adjoining containers. The structural connection may also include foundation anchoring systems or reinforced frames that support vertical loads, particularly where containers are stacked or carry rooftop structures. In some embodiments, deploying may further include installing one or more ventilation units 128, such as HVAC modules or air handling containers, along the perimeter of the intermodal-container-based factory to regulate airflow, temperature, and humidity. The ventilation units 128 may be connected to adjacent containers through ducts or vents routed along container walls or ceilings. In some embodiments, deploying may include mounting a roof 124 over a set of intermodal containers 122. The roof 124 may include inflatable membranes supported by integrated compressors and pressure sensors or may include stretch covers fastened to container edges using hooks, brackets, or cable systems. The roof 124 may provide weather protection, light diffusion, and thermal insulation to support year-round operation of the intermodal-container-based factory.

The deployed intermodal-container-based factory 120 may include input modules, structural supports, and utility connections to facilitate integrated operation of the factory. In some embodiments, each container-based workstation includes specialized manufacturing equipment permanently mounted to at least one of the intermodal containers. Examples of such equipment may include CNC mills, robotic welders, laser cutters, or pipe cutters. The container-based workstations may be pre-installed, climate controlled, and configured to operate without on-site reinstallation.

In some embodiments, the process 1100 may include executing 1140 manufacturing tasks at the container-based workstations along one or more assembly lines in the intermodal-container-based factory. The container-based workstations may be aligned to form one or more assembly lines 130. In some embodiments, the one or more assembly lines comprise intermodal containers configured to produce structural frames, wall panels, plumbing modules, or window assemblies. Each assembly line 130 may support a sequential or parallel workflow. In some embodiments, the manufacturing tasks comprise cutting, bending, welding, or assembling components used in the building. For example, executing manufacturing tasks may comprise operating a cutting station mounted to an intermodal container to produce prefabricated building components. In some embodiments, executing manufacturing tasks may comprise operating a glass cutting station and an assembly table to produce double-glazed window units. In other embodiments, executing manufacturing tasks may comprise assembling wall panels by combining oriented strand board, light steel thin-walled profiles, and expanded polystyrene foam. In further embodiments, executing manufacturing tasks may comprise assembling plumbing modules by cutting pipes and sealing joints to produce preassembled utility systems. Task execution at the workstations may be synchronized with a production plan issued by the task management system 110. Transfer of work-in-progress between containers may be handled by conveyor belts, carts, suction cranes, or manual staging platforms.

In some embodiments, the process 1100 may include packaging 1150 building construction components at the intermodal-container-based factory. Packaging may be performed at designated container-based packaging stations configured for labeling, wrapping, strapping, or palletizing. In some embodiments, packaging comprises palletizing the building construction components for transport. Palletizing may involve stacking finished window units, panel assemblies, or utility modules onto transport pallets and securing them with film wrap, corner protectors, or straps. In some embodiments, packaging comprises labeling the building construction components based on installation sequence. For example, finished wall modules may be labeled with QR codes, barcodes, or RFID tags to identify their target location in the building 142. Labeling may reflect installation order, floor plan location, or component type. Packaged components may be staged for outbound logistics or temporarily stored in covered warehouse containers near the perimeter of the intermodal-container-based factory 120.

In some embodiments, the process 1100 may include delivering 1160 the packaged building construction components to a construction site for installation in the building. In some embodiments, delivering comprises coordinating delivery times based on real-time progress at the construction site. The task management system 110 may monitor progress updates from onsite installation teams and adjust delivery schedules accordingly. Delivery may be carried out using trucks, forklifts, or other transport vehicles to move packaged components from the intermodal-container-based factory 120 to the construction site 140. In some embodiments, the construction site 140 includes one or more onsite workstations configured to receive delivered components for installation into a building 142. Delivery logistics may be optimized to reduce idle time, minimize handling, and synchronize component arrival with installation tasks.

Example Embodiments

Embodiment 1. An intermodal-container-based factory for manufacturing building construction components, the intermodal-container-based factory comprising: a plurality of intermodal containers converted into workstations of the intermodal-container-based factory; and an assembly line configured to produce different types of building components in each of the workstations that is to be used in a building being constructed, the assembly line comprising specialized manufacturing equipment mounted permanently to each of the intermodal containers, the specialized manufacturing equipment each configured to produce a specific type of building component for constructing the building.

Embodiment 2. The intermodal-container-based factory of embodiment 1, wherein the assembly line comprises: a first container-based workstation comprising a glass cutting station permanently mounted to a first intermodal container, the glass cutting station configured to cut a full-size glass sheet into dimensioned glass pane; and a second container-based workstation comprising a window assembly station permanently mounted to a second intermodal container, the window assembly station configured to assemble the dimensioned glass pane and reinforced frame components to form a finished window to be installed in the building.

Embodiment 3. The intermodal-container-based factory of embodiment 1, wherein the assembly line comprises: a first container-based workstation comprising a CNC milling machine permanently mounted to a first intermodal container, the CNC milling machine configured to machine door frame elements; and a second container-based workstation comprising an assembly jig permanently mounted to a second intermodal container, the assembly jig configured to join machined frame elements and door panels to form a door assembly to be installed in the building.

Embodiment 4. The intermodal-container-based factory of embodiment 1, wherein the assembly line comprises: a first container-based workstation comprising a CNC panel mill permanently mounted to a first intermodal container, the CNC panel mill configured to cut a panel according to predefined profile; and a second container-based workstation comprising a panel assembly jig permanently mounted to a second intermodal container, the panel assembly jig configured to combine the panel with insulation form a wall panel to be installed in the building.

Embodiment 5. The intermodal-container-based factory of embodiment 1, wherein the assembly line comprises: a first container-based workstation comprising a rolling mill permanently mounted to a first intermodal container, the rolling mill configured to fabricate a metal-faced panel with insulation core; and a second container-based workstation comprising a flying cut-off saw permanently mounted to a second intermodal container, the flying cut-off saw configured to trim the metal-faced panel to length to form a sandwich panel to be installed in the building.

Embodiment 6. The intermodal-container-based factory of embodiment 1, wherein the assembly line comprises: a first container-based workstation comprising a CNC milling machine permanently mounted to a first intermodal container, the CNC milling machine configured to mill an aluminum composite panel with a predefined pattern; and a second container-based workstation comprising a vinyl application station permanently mounted to a second intermodal container, the vinyl application station configured to apply vinyl to a milled aluminum composite panel to form a cladding panel to be installed in the building.

Embodiment 7. The intermodal-container-based factory of embodiment 1, wherein the assembly line comprises: a first container-based workstation comprising a pipe cutting station permanently mounted to a first intermodal container, the pipe cutting station configured to cut a pipe to a length; and a second container-based workstation comprising a plumbing module assembly table permanently mounted to a second intermodal container, the plumbing module assembly table configured to the pine with a fitting and a structural support to form a preassembled plumbing module to be installed in the building.

Embodiment 8. The intermodal-container-based factory of embodiment 1, wherein at least one of the intermodal containers comprises removable composite wall panels to enable open access to the specialized manufacturing equipment mounted permanently to the at least one of the intermodal containers.

Embodiment 9. The intermodal-container-based factory of embodiment 1, wherein the assembly line comprises three or more intermodal containers that are interconnected and arranged in a predefined sequence such that raw materials are received at a first container, processed through intermediate containers, and a finished building component is produced at a final container, the finished building component to be installed in the building.

Embodiment 10. The intermodal-container-based factory of embodiment 1, wherein the manufacturing equipment in the intermodal-container-based factory comprises: a laser cutting machine configured to process metal profiles, a press brake for bending metal sheets, a computer numerical control (CNC) milling machine for aluminum panels, and a profile saw bed for cutting window frame components.

Embodiment 11. The intermodal-container-based factory of embodiment 1, wherein at least one of the intermodal containers includes pre-installed environmental control systems comprising ventilation, heating, and air conditioning for climate control.

Embodiment 12. The intermodal-container-based factory of embodiment 1, further comprising a first intermodal container that includes lockers and a changing room and a second intermodal container that includes a dining area.

Embodiment 13. The intermodal-container-based factory of embodiment 1, wherein the plurality of intermodal containers comprises a finishing section container includes a packaging station that includes a strapping machine, a motorized turntable, and a film wrapping table for palletizing completed building components.

Embodiment 14. The intermodal-container-based factory of embodiment 1, wherein the intermodal containers in the assembly line are arranged in linear configuration such that the intermodal containers are physically aligned end-to-end.

Embodiment 15. The intermodal-container-based factory of embodiment 1, wherein at least a subset of the plurality of intermodal containers are interconnected to form an exterior wall of the intermodal-container-based factory.

Embodiment 16. The intermodal-container-based factory of embodiment 1, further comprising an inflatable roof connected to the intermodal containers on two sides of the intermodal-container-based factory.

Embodiment 17. The intermodal-container-based factory of embodiment 1, further comprising a second plurality of intermodal containers that are used as storage units for the building components produced by the assembly line.

Embodiment 18. The intermodal-container-based factory of embodiment 1, further comprising a plurality of assembly lines, the plurality of assembly lines comprise three or more assembly lines below: a window assembly line, a wall panel assembly line, a door panel assembly line, a structural wall framing line, a sandwich panel manufacturing line, an aluminum composite cladding line, a plumbing module assembly line, and an electrical module assembly line.

Embodiment 19. The intermodal-container-based factory of embodiment 18, wherein at least one workstation that includes specialized manufacturing equipment mounted permanently to an intermodal container is shared between two or more assembly lines.

Embodiment 20. The intermodal-container-based factory of embodiment 18, wherein at least two of the assembly lines are separated by distinguishable regions in the intermodal-container-based factory.

Embodiment 21. A method of manufacturing building construction components using an intermodal-container-based factory, the method comprising: receiving building design specifications associated with a building; generating manufacturing instructions based on the building design specifications; deploying an intermodal-container-based factory by arranging a plurality of intermodal containers to form container-based workstations; executing manufacturing tasks at the container-based workstations along one or more assembly lines in the intermodal-container-based factory; packaging building construction components at the intermodal-container-based factory; and delivering the packaged building construction components to a construction site for installation in the building.

Embodiment 22. The method of embodiment 21, wherein generating manufacturing instructions comprises assigning task-level instructions to designated container-based workstations.

Embodiment 23. The method of embodiment 21, wherein generating manufacturing instructions comprises translating the building design specifications into geometric dimensions, cutting sequences, or assembly steps.

Embodiment 24. The method of embodiment 21, wherein deploying the intermodal-container-based factory comprises transporting the plurality of intermodal containers to a factory location.

Embodiment 25. The method of embodiment 21, wherein deploying the intermodal-container-based factory comprises stacking at least two of the intermodal containers vertically to form a multi-level structure.

Embodiment 26. The method of embodiment 21, wherein each container-based workstation includes specialized manufacturing equipment permanently mounted to at least one of the intermodal containers.

Embodiment 27. The method of embodiment 21, wherein the manufacturing tasks comprise cutting, bending, welding, or assembling components used in the building.

Embodiment 28. The method of embodiment 21, wherein the one or more assembly lines comprise intermodal containers configured to produce structural frames, wall panels, plumbing modules, or window assemblies.

Embodiment 29. The method of embodiment 21, wherein executing manufacturing tasks comprises operating a cutting station mounted to an intermodal container to produce prefabricated building components.

Embodiment 30. The method of embodiment 21, wherein executing manufacturing tasks comprises operating a glass cutting station and an assembly table to produce double-glazed window units.

Embodiment 31. The method of embodiment 21, wherein executing manufacturing tasks comprises assembling wall panels by combining oriented strand board, light steel thin-walled profiles, and expanded polystyrene foam.

Embodiment 32. The method of embodiment 21, wherein executing manufacturing tasks comprises assembling plumbing modules by cutting pipes and sealing joints to produce preassembled utility systems.

Embodiment 33. The method of embodiment 21, wherein packaging comprises palletizing the building construction components for transport.

Embodiment 34. The method of embodiment 21, wherein packaging comprises labeling the building construction components based on installation sequence.

Embodiment 35. The method of embodiment 21, wherein delivering comprises coordinating delivery times based on real-time progress at the construction site.

ADDITIONAL CONSIDERATIONS

The foregoing description of the embodiments has been presented for the purpose of illustration; it is not intended to be exhaustive or to limit the patent rights to the precise forms disclosed. While particular embodiments and applications have been illustrated and described, it is to be understood that the invention is not limited to the precise construction and components disclosed herein and that various modifications, changes and variations which will be apparent to those skilled in the art may be made in the arrangement, operation and details of the method and apparatus disclosed herein without departing from the spirit and scope of the present disclosure. Persons skilled in the relevant art can appreciate that many modifications and variations are possible in light of the above disclosure.

The term "steps" does not mandate or imply a particular order. For example, while this disclosure may describe a process that includes multiple steps sequentially with arrows present in a flowchart, the steps in the process do not need to be performed by the specific order claimed or described in the disclosure. Some steps may be performed before others even though the other steps are claimed or described first in this disclosure. Likewise, any use of (i), (ii), (iii), etc., or (a), (b), (c), etc. in the specification or in the claims, unless specified, is used to better enumerate items or steps and also does not mandate a particular order.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein. In addition, the term "each" used in the specification and claims does not imply that every or all elements in a group need to fit the description associated with the term "each." For example, "each member is associated with element A" does not imply that all members are associated with an element A. Instead, the term "each" only implies that a member (of some of the members), in a singular form, is associated with an element A. In claims, the use of a singular form of a noun may imply at least one element even though a plural form is not used.

Finally, the language used in the specification has been principally selected for readability and instructional purposes, and it may not have been selected to delineate or circumscribe the patent rights. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights.

What is claimed is:

1. A method of manufacturing building construction components using an intermodal-container-based factory, the method comprising:

receiving building design specifications associated with a building;

generating manufacturing instructions based on the building design specifications;

accessing an intermodal-container-based factory, the intermodal-container-based factory comprising a plurality of intermodal containers that form container-based workstations;

executing manufacturing tasks at the container-based workstations along one or more assembly lines in the intermodal-container-based factory;

packaging building construction components at the intermodal-container-based factory; and delivering the packaged building construction components to a construction site for installation in the building.

2. The method of claim 1, wherein the step of generating manufacturing instructions comprises assigning task-level instructions to designated container-based workstations of the container-based workstations.

3. The method of claim 1, wherein the step of generating manufacturing instructions comprises translating the building design specifications into geometric dimensions, cutting sequences, or assembly steps.

4. The method of claim 1, wherein the intermodal-container-based factory is deployed by transporting the plurality of intermodal containers to a factory location.

5. The method of claim 1, wherein the step of deploying the intermodal-container-based factory is deployed by stacking at least two of the intermodal containers vertically to form a multi-level structure.

6. The method of claim 1, wherein each container-based workstation includes specialized manufacturing equipment permanently mounted to at least one of the intermodal containers.

7. The method of claim 1, wherein the manufacturing tasks comprise cutting, bending, welding, or assembling components used in the building.

8. The method of claim 1, wherein the one or more assembly lines comprise intermodal containers configured to produce structural frames, wall panels, plumbing modules, or window assemblies.

9. The method of claim 1, wherein the step of executing manufacturing tasks comprises operating a cutting station mounted to an intermodal container to produce of said plurality of intermodal containers the building construction components.

10. The method of claim 1, wherein the step of executing manufacturing tasks comprises operating a glass cutting station and an assembly table to produce double-glazed window units.

11. The method of claim 1, wherein the step of executing manufacturing tasks comprises assembling wall panels by combining oriented strand board, light steel thin-walled profiles, and expanded polystyrene foam.

12. The method of claim 1, wherein the step of executing manufacturing tasks comprises assembling plumbing modules by cutting pipes and sealing joints to produce preassembled utility systems.

13. The method of claim 1, wherein the step of packaging comprises palletizing the building construction components for transport.

14. The method of claim 1, wherein the step of packaging comprises labeling the building construction components based on installation sequence.

15. The method of claim 1, wherein the step of delivering comprises coordinating delivery times based on real-time progress at the construction site.

* * * * *